US009823611B2

(12) United States Patent
Osada et al.

(10) Patent No.: US 9,823,611 B2
(45) Date of Patent: Nov. 21, 2017

(54) SHEET PROCESSING DEVICE AND IMAGE FORMING DEVICE PROVIDED WITH THE SAME

(71) Applicants: Hisashi Osada, Yamanashi-ken (JP); Takashi Saito, Yamanashi-ken (JP); Isao Kondo, Yamanashi-ken (JP)

(72) Inventors: Hisashi Osada, Yamanashi-ken (JP); Takashi Saito, Yamanashi-ken (JP); Isao Kondo, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/078,465

(22) Filed: Mar. 23, 2016

(65) Prior Publication Data

US 2016/0313687 A1 Oct. 27, 2016

(30) Foreign Application Priority Data

Apr. 23, 2015 (JP) ..... 2015-088021
May 27, 2015 (JP) ..... 2015-107405
May 27, 2015 (JP) ..... 2015-107406

(51) Int. Cl.
*G03G 15/00* (2006.01)
*B65H 37/04* (2006.01)
(Continued)

(52) U.S. Cl.
CPC ..... *G03G 15/6541* (2013.01); *B42C 1/125* (2013.01); *B42C 3/00* (2013.01);
(Continued)

(58) Field of Classification Search
CPC ..... G03G 15/6541
(Continued)

(56) References Cited

U.S. PATENT DOCUMENTS 6,003,853 A * 12/1999 Nakazawa ..... B65H 45/12 270/58.08
6,196,959 B1 * 3/2001 Jorg ..... B65H 45/12 493/23
(Continued)

FOREIGN PATENT DOCUMENTS

JP 4660506 B2 3/2011
JP 2011-201698 A 10/2011
(Continued)

*Primary Examiner* — Anthony Nguyen
(74) *Attorney, Agent, or Firm* — Manabu Kanesaka

(57) ABSTRACT

A sheet processing device includes: an adhesive-binding unit that applies an adhesive onto sheets stored in a stacker section one by one and adhesive-binds the sheets; a staple-binding unit that staple-binds sheets accumulated in the stacker section by means of staples; and a folding mechanism section having a folding roller that folds the adhesive-bound or staple-bound sheet bundle in two at a binding position of the adhesive-binding unit or staple-binding unit and a folding blade that pushes the bound sheet bundle into the folding roller. A folding speed of the folding mechanism section for the sheet bundle bound by the adhesive-binding unit is lower than a folding speed for the sheet bundle bound by the staple-binding unit; thereby, productivity of the folding processing is improved and occurrence of the peeling-off or break during the folding processing is reduced.

12 Claims, 31 Drawing Sheets

(51) Int. Cl.

| | |
|---|---|
| ***B65H 45/18*** | (2006.01) |
| ***B65H 45/30*** | (2006.01) |
| ***B42C 9/00*** | (2006.01) |
| ***B42C 3/00*** | (2006.01) |
| ***B42C 19/00*** | (2006.01) |
| ***B65H 31/02*** | (2006.01) |
| ***B65H 43/00*** | (2006.01) |
| ***B42C 1/12*** | (2006.01) |
| ***B42C 19/02*** | (2006.01) |

(52) U.S. Cl.
CPC ..... *B42C 9/0006* (2013.01); *B42C 9/0056* (2013.01); *B42C 19/00* (2013.01); *B42C 19/02* (2013.01); *B65H 31/02* (2013.01); *B65H 37/04* (2013.01); *B65H 43/00* (2013.01); *B65H 45/18* (2013.01); *B65H 45/30* (2013.01); *B65H 2301/4213* (2013.01); *B65H 2301/42146* (2013.01); *B65H 2301/5113* (2013.01); *B65H 2301/51611* (2013.01); *B65H 2513/10* (2013.01); *B65H 2801/27* (2013.01)

(58) Field of Classification Search
USPC ..... 399/410
See application file for complete search history.

(56) References Cited

U.S. PATENT DOCUMENTS

| | | | | |
|---|---|---|---|---|
| 7,673,863 | B2 * | 3/2010 | Iguchi | B65H 39/10 270/32 |
| 2002/0117793 | A1 * | 8/2002 | Hosoya | B65H 45/142 270/4 |
| 2008/0315489 | A1 | 12/2008 | Iguchi et al. | |
| 2012/0061900 | A1 * | 3/2012 | Sekigawa | B42C 1/12 270/58.08 |
| 2012/0155944 | A1 | 6/2012 | Matsue et al. | |
| 2012/0184423 | A1 * | 7/2012 | Hattori | B65H 45/18 493/405 |
| 2013/0133837 | A1 | 5/2013 | Naraoka | |
| 2015/0174941 | A1 | 6/2015 | Osada et al. | |
| 2015/0175379 | A1 | 6/2015 | Osada et al. | |
| 2015/0210503 | A1 | 7/2015 | Osada et al. | |

FOREIGN PATENT DOCUMENTS

| | | | |
|---|---|---|---|
| JP | 5168474 | B2 | 3/2013 |
| JP | 2013-112527 | A | 6/2013 |
| JP | 5382597 | B2 | 1/2014 |

* cited by examiner

SHEET PROCESSING DEVICE AND IMAGE FORMING DEVICE PROVIDED WITH THE SAME

BACKGROUND OF THE INVENTION

Field of the Invention

The present invention relates to a processing device that bonds sheets carried out from an image forming device such as a copier or a printer to form a sheet bundle and folds the sheet bundle at a predetermined folding position as needed and, more particularly, to a processing device capable of creating a booklet by means of an adhesive or a booklet by means of staplers according to a user's request.

Description of the Related Art

A sheet processing device that aligns sheets carried out from an image forming device and staples the sheets or folds the sheets in a booklet form is widely known. Such a sheet processing device is provided with a plurality of sheet storage means for sheet post-processing. Further, there is disclosed a device capable of performing stapling or bonding for binding sheets according to a user's request, followed by folding of the resultant bound sheet bundle in two.

For example, Japanese Patent No. 5,168,474 discloses a bookbinding device provided with a unit housing section that can alternatively houses one of a staple-binding unit that staples a sheet bundle and a paste binding unit that applies pasting onto sheets and pressure-bonds them to form a sheet bundle. To this end, one of the staple-binding unit and the paste binding unit is set so as to be detachably attached to the unit housing section. Further, this device includes a folding section that folds the sheet bundle bound by one of the above units in two.

Further, Japanese Patent No. 5,382,597 discloses a device provided with both a paste binding unit that applies pasting onto sheets and pressure-bonds them to form a sheet bundle and a staple-binding unit that performs staple-binding processing. The device alternatively executes the paste binding and the staple-binding followed by folding processing. With this configuration, a booklet can be created by paste binding or staple-binding.

SUMMARY OF THE INVENTION

However, in both the devices disclosed in Japanese Patent No. 5,168,474 and Japanese Patent No. 5,382,597, when the sheet bundle bound by the staple-binding unit or paste binding unit is folded by a folding mechanism section, more specifically, a folding roller and a folding knife (folding blade) that pushes the sheet bundle into the folding roller, whether the sheet bundle has been bound by the staple-binding unit or paste binding unit is not taken into account.

The sheet bundle bound by the staple-binding unit has high strength since metal staples are used to bind the sheet bundle at its folding position. That is, in this case, a rotation speed of the folding roller or a moving speed of the folding blade can be made high. On the other hand, for the sheet bundle bound by the paste binding unit, when the sheet bundle is folded, the paste serving as an adhesive between the sheets is also subjected to the folding, and the paste on the folding roller side is largely deformed and moved. Therefore, when a folding speed for the sheet bundle bound by the staple-binding unit, i.e., a comparatively high speed is applied as it is to the folding of the sheet bundle bound by the paste binding unit, the adhesive applied to the outermost side cannot withstand the folding speed, which may result in peeling-off of the adhesive or break of the sheet. On the other hand, when a folding speed for the sheet bundle bound by the paste binding unit, i.e., a comparatively low speed is applied as it is to the folding of the sheet bundle bound by the staple-binding unit, staple-binding processing speed is also lowered, resulting in deterioration of the entire processing speed. The above tendencies become more conspicuous as the number of sheets to be bound is increased.

The present invention has been made based on an idea that it is preferable to perform folding of the sheet bundle bound by the staple-binding at a comparatively high speed while perform folding of the sheet bundle bound by the paste binding at a comparatively low speed so as to prevent peeling-off of the sheets from one another or break of the sheets, and a first object thereof is to provide a device that performs both staple-binding and adhesive-binding, capable of improving productivity in the folding processing for the sheet bundle bound by the staple-binding unit and reducing occurrence of the peeling-off or break during the folding processing for the sheet bundle bound by the adhesive-binding unit. A second object of the present invention is to reduce an amount of the adhesive to be used in the adhesive-binding processing even when the number of sheets to be bound is large while maintaining adhesive strength.

To achieve the first objects, the present invention adopts the following configuration.

There is provided a sheet processing device that binds sheets and then folds a resultant sheet bundle, the device including: a stacker section that stores sheets conveyed along a conveying path; an adhesive-binding unit that applies an adhesive onto the sheets stored in the stacker section to adhesive-bind the sheets; a staple-binding unit that binds the sheets stored in the stacker section by means of staples; a folding mechanism section that includes a folding roller that folds a sheet bundle in two at a binding position of the sheet bundle by the adhesive-binding unit or a binding position thereof by the staple-binding unit and a folding blade that pushes the sheet bundle into the folding roller; and a controller that controls the folding mechanism section. The controller controls a folding speed of the folding mechanism section such that a folding speed for the sheet bundle bound by the adhesive-binding unit is lower than a folding speed for the sheet bundle bound by the staple-binding unit. Further, to achieve the second object, the present invention adopts the following configuration. That is, when the number of sheets to be bonded by the adhesive-binding unit applying the adhesive onto the sheets exceeds a predetermined number, the adhesive is applied at a two position separated from each other across the folding position.

According to the present invention, the folding processing for the sheet bundle bound by the adhesive-binding unit is performed at a lower speed than that of the folding processing for the sheet bundle bound by the staple-binding unit. Thus, the adhesive-bound sheet bundle is folded with the adhesive following a shape of the folded part well. As a result, peeling-off of the adhesive or break of the sheet during the folding processing can be suppressed. On the other hand, the staple-bound sheet bundle can be folded at a comparatively high speed, making it possible to improve productivity of the folding processing for the sheet bundle bound. Further, it is possible to reduce an amount of the adhesive to be used while maintaining a sufficient bonding strength of the adhesive-bound sheet bundle.

BRIEF DESCRIPTION OF THE DRAWINGS

FIGS. 5A to 5C are views explaining the adhesive-binding unit of FIG. 3, in which FIG. 5A is a plan view of adhesive tape stampers, FIG. 5B illustrates an engagement state between a stamper holder and a cam member that moves the stamper holder, and FIG. 5C is an explanatory view of the cam member;

FIGS. 6A to 6D are explanatory views of an adhesive tape stamper for applying an adhesive, in which FIG. 6A is an outer appearance view, FIG. 6B is a view illustrating a state where an adhesive tape is wound around a reel, FIG. 6C is a view illustrating a gear state before pressing of the adhesive tape stamper, and FIG. 6D is a view illustrating a gear state upon pressing of the adhesive tape stamper;

FIGS. 7A to 7C are explanatory views illustrating an operation state of a stamper holder supporting the adhesive tape stamper, in which FIG. 7A illustrates a state where two stamper holders are situated at a raised position, FIG. 7B illustrates a state where one stamper holder starts to descending, and FIG. 7C illustrates a state where a sheet presser presses a sheet;

FIGS. 8A to 8C are explanatory views, continued from FIG. 7C, illustrating the operation state of the stamper holder supporting the adhesive tape stamper, in which FIG. 8A illustrates a state where another stamp holder starts to descend, FIG. 8B illustrates a state where the adhesive tape stampers of the one stamper holder press and apply an adhesive onto the sheet, and FIG. 8C illustrates a state where the adhesive tape stampers of both stamper holders press and apply an adhesive onto the sheet;

FIGS. 9A and 9B are views each illustrating a configuration of the staple-binding unit positioned downstream of the adhesive-binding unit, in which FIG. 9A is a side view of the staple-binding unit, and FIG. 9B is a configuration view of a driver unit of the staple-binding unit;

FIGS. 13A to 13D are explanatory views of folding processing for a staple-bound sheet bundle performed in the folding mechanism section illustrated in FIGS. 11 and 12, in which FIG. 13A illustrates a state where the sheet bundle is stored, FIG. 13B illustrates a state where the sheet bundle is inserted into a folding roller by the folding blade, FIG. 13C illustrates an initial state of the folding processing by the folding roller, and FIG. 13D illustrates a state where the sheet bundle is being folded by the folding roller;

FIGS. 14A to 14D are explanatory views of folding processing for an adhesive-bound sheet bundle, in which FIG. 14A illustrates a state where the sheet bundle is stored, FIG. 14B illustrates a state where the sheet bundle is inserted into a folding roller by the folding blade, FIG. 14C illustrates a state where an initial state of the folding processing by the folding roller, and FIG. 14D illustrates a state where the sheet bundle is being folded by the folding roller;

FIGS. 15A to 15D are views illustrating the staple-bound sheet bundle and adhesive-bound sheet bundles which are in a folded state, in which FIGS. 15A and 15B illustrate a folded state of the staple-bound sheet bundle and FIGS. 15C and 15D illustrate a folded state of the adhesive-bound sheet bundle;

FIGS. 16A to 16C are sheet flow diagrams for explaining a process in which the adhesive-binding unit is used to bond the sheets to form a sheet bundle, in which FIG. 16A illustrates a state where a first sheet is carried in a carry-in path, FIG. 16B illustrates a state where a rear end of the first sheet passes through a branching point between the carry-in path and a retreat path, and FIG. 16C illustrates a state where an adhesive is applied to a surface of the first sheet which has been retreated to the retreat path;

FIGS. 17A to 17C are sheet flow diagrams continued from FIG. 16C, in which FIG. 17A illustrates a state where an adhesive applied position of the first sheet is moved to the retreat path for carry-in of a second sheet, FIG. 17B illustrates a state where a center of the second sheet is bonded to the adhesive applied position of the first sheet and then the bonded sheets are moved to a stacker downstream side, and FIG. 17C illustrates a state where rear ends of the bonded sheets that have passed through the carry-in path and the retreat path are biased toward the retreat path side by a deflection guide;

FIGS. 18A to 18C are sheet flow diagrams continued from FIG. 17C, in which FIG. 18A illustrates a state where an adhesive is applied to the second sheet, and the application position thereof is retreated to the retreat path for carry-in of a third sheet, FIG. 18B illustrates a state where the bonded sheets in the retreat path and the third sheet are aligned and carried in the stacker section, and FIG. 18C illustrates a state where the adhesive applied position of the bonded three sheets is conveyed to a folding processing position for folding processing;

FIGS. 19A to 19C are sheet flow diagrams for explaining a process in which the staple-binding unit as a saddle-stitching stapler is used to bind the sheets, in which FIG. 19A illustrates a state where a first sheet is carried in a carry-in path, FIG. 19B illustrates a state where a rear end of the first sheet that has passed through the branching point between the carry-in path and the retreat path is biased to the retreat path side by the deflection guide, and FIG. 19C illustrates a state where a second sheet is carried in the stacker section;

FIGS. 20A to 20C are sheet flow diagrams continued from FIG. 19C, in which FIG. 20A illustrates a state where a third sheet is carried in the stacker section, FIG. 20B illustrates a state where a center of the third sheet is situated at a position corresponding to the staple-binding unit, and FIG. 20C illustrates a state where a saddle-stitched position of the sheet bundle saddle-stitched by means of metal staples is conveyed to the folding mechanism section for folding processing;

FIGS. 25A to 25D are views for explaining transfer of the adhesive onto the sheet by the adhesive tape stamper, in which FIG. 25A is a bottom view of the adhesive tape stamper, FIG. 25B is a view for explaining that the adhesives are transferred with the same length, FIG. 25C is a view explaining a state where the adhesive is applied at two positions on a cover sheet across the folding position (Y), and FIG. 25D is a view explaining a state where a pressing portion of the stamper holder is pressed against the sheets including the cover sheet for bonding;

FIGS. 26A to 26C are views illustrating a state where the adhesive tape (adhesive) is transferred onto the folding position (Y), in which FIG. 26A illustrates adhesive transfer processing for a small number of sheets, where the adhesive tape is transferred across the folding position; FIG. 26B illustrates the adhesive transfer processing for a large number of sheets, where the adhesive tape is transferred at two positions slightly separated from each other (very close to each other) in the sheet conveying direction across the folding position; and FIG. 26C illustrates the adhesive transfer processing for a further large number (exceeding a predetermined number) of sheets, where the adhesive tape is transferred at two positions separated from each other by a predetermined interval (S) across the folding position Y;

FIGS. 27A to 27D are views for explaining a state where the sheet bundle formed by a number of sheets exceeding a predetermined number bonded in FIG. 26C is folded by the folding mechanism section illustrated in FIGS. 11 and 12, in which FIG. 27A illustrates a state where the sheet bundle is stored, FIG. 27B illustrates a state where the sheet bundle is inserted into the folding roller by the folding blade, FIG. 27C illustrates a state where an initial state of the folding processing by the folding roller, and FIG. 27D illustrates a state where the sheet bundle is being folded by the folding roller;

FIGS. 28A to 28D are views illustrating an adhesive-bound sheet bundle and a folded state thereof, in which FIG. 28A is a view for explaining a state where the adhesives are applied with the same length irrespective of whether the number of sheets is small or large, FIG. 28B illustrates a booklet obtained by folding the adhesive-bound sheet bundle of FIG. 28A at the folding position (Y), FIG. 28C is a view explaining the adhesive application for sheets whose number exceeds a predetermined number, where the adhesive is applied at two positions separated from each other by an interval (S) across the folding position (Y), and FIG. 28D illustrates a booklet obtained by folding the adhesive-bound sheet bundle of FIG. 28C at the folding position (Y);

DESCRIPTION OF THE PREFERRED EMBODIMENTS

Figure 1:
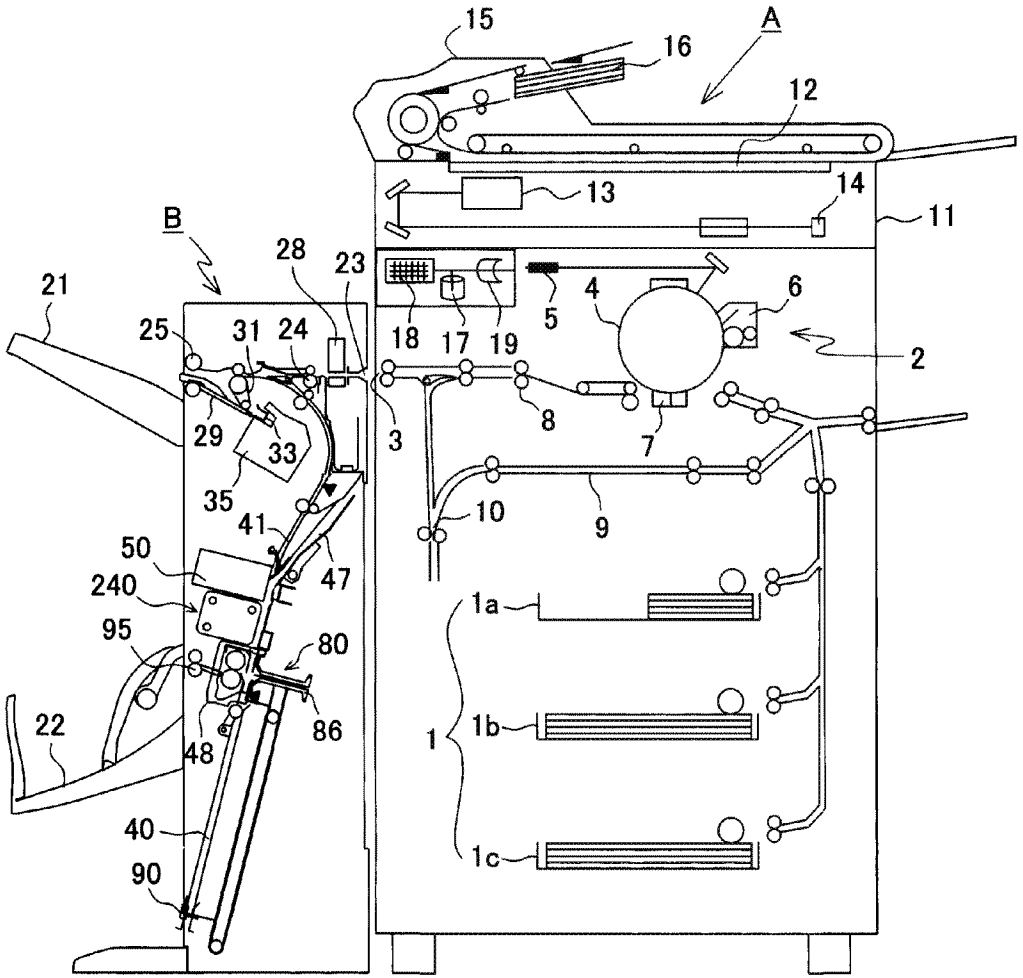
FIG. 1 is an explanatory view illustrating an entire configuration that combines an image forming device and a sheet processing device according to the present invention.
Figure 2:
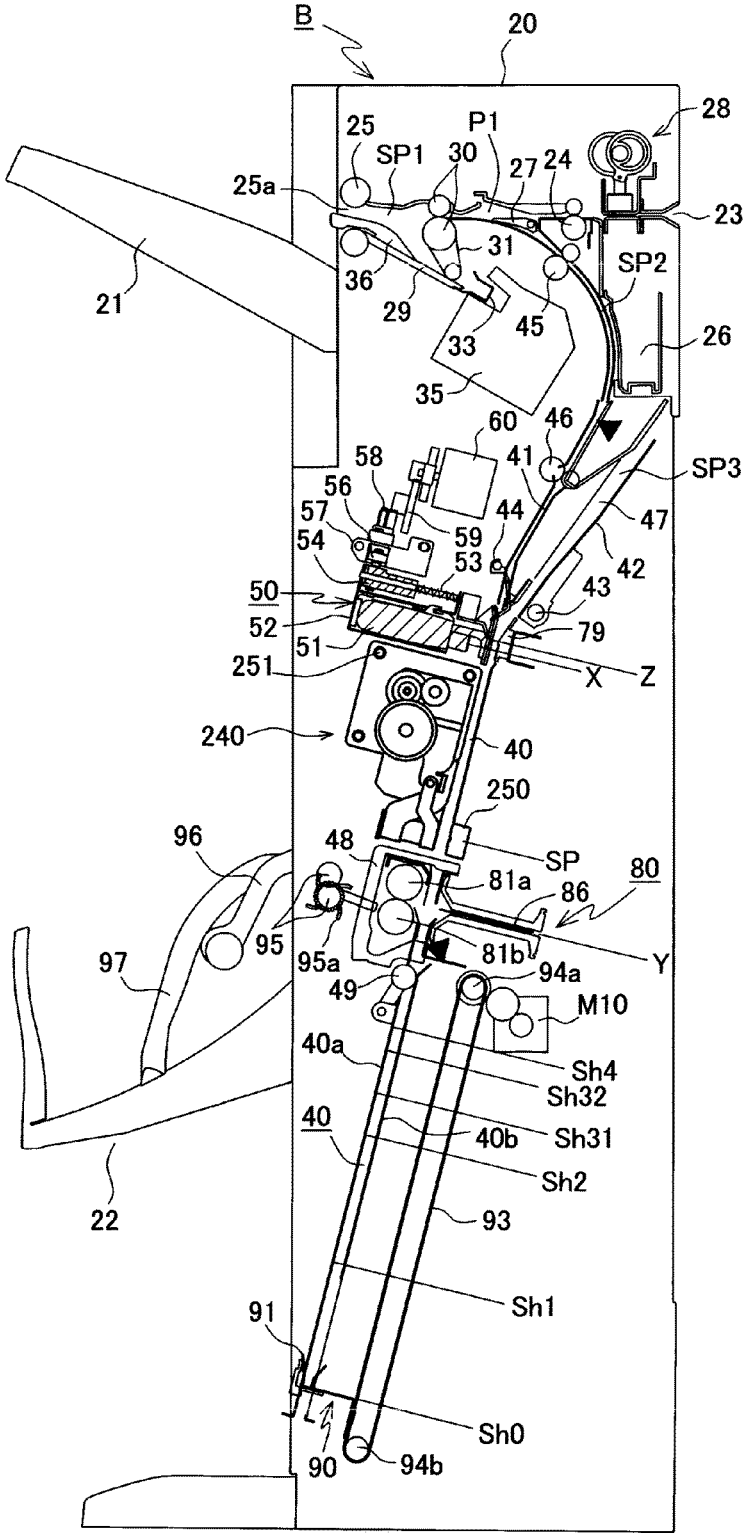
FIG. 2 is an explanatory view illustrating an entire configuration of the sheet processing device provided with an adhesive-binding unit and a staple-binding unit according to the present invention.
Figure 3:
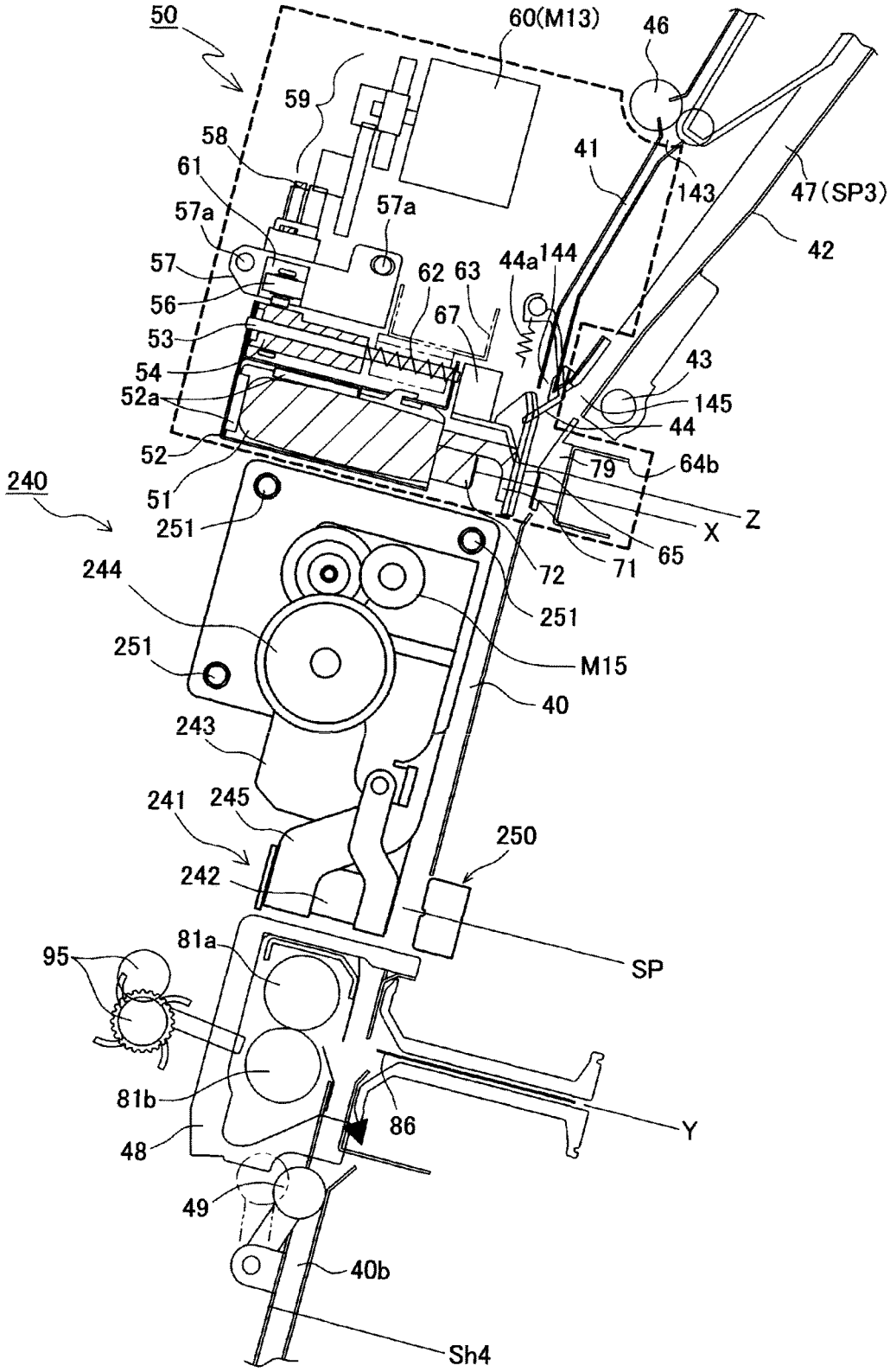
FIG. 3 is an explanatory view illustrating mechanisms around the adhesive-binding unit and the staple-binding unit of FIG. 2.

Hereinafter, the present invention will be described in detail based on illustrated preferred embodiments. FIG. 1 illustrates an entire system that combines an image forming device and a sheet processing device according to the present invention. FIG. 2 is an explanatory view illustrating an entire configuration of the sheet processing device. FIG. 3 and subsequent drawings are explanatory views illustrating configurations of mechanisms provided in the sheet processing device. A system illustrated in FIG. 1 is constituted by an image forming device A and a sheet processing device B. The sheet processing device B incorporates therein, as a unit, an adhesive-binding unit 50 that applies an adhesive to a center of sheets in a sheet conveying direction and a staple-binding unit 240 that saddle-stitches, with staple needles, a sheet bundle at a center in the sheet conveying direction.

[Configuration of Image Forming Device]

The image forming device A illustrated in FIG. 1 feeds a sheet from a sheet supply section 1 to an image forming section 2, performs printing on the sheet in the image forming section 2, and carries out the sheet after printing from a main body discharge port 3. Sheets of a plurality of sizes are accommodated in sheet cassettes 1*a*, 1*b*, and 1*c* of the sheet supply section 1, and the sheet supply section 1 separates, one from another, sheets of a specified size and feeds them one by one to the image forming section 2. The image forming section 2 includes, e.g., an electrostatic drum 4, a print head (laser emitter) 5, a developing unit 6, a transfer charger 7, and a fixing unit 8. The print head 5, the developing unit 6, the transfer charger 7, and the fixing unit 8 are disposed around the electrostatic drum 4. An electrostatic latent image is formed on the electrostatic drum 4 using the laser emitter 5, the developing unit 6 adds toner to the image, the transfer charger 7 transfers the image onto the sheet, and the fixing unit 8 thermally-fixes the image onto the sheet. The sheet with thus formed image is sequentially carried out from the main body discharge port 3. A reference numeral 9 in FIG. 1 denotes a circulation path, which is a path for two-side printing in which the sheet printed on the front side from the fixing unit 8 is reversed via a main body switchback path 10 and is conveyed to the image forming section 2 again for printing on the back side thereof. The sheet thus printed on both sides is reversed in the main body switchback path 10 and is carried out from the main body discharge port 3.

A reference numeral 11 in FIG. 1 denotes an image reader, where a document sheet set on a platen 12 is scanned by a scan unit 13 and is electrically read by a photoelectric conversion element 14 through a reflective mirror and a condensing lens. This image data is subjected to, e.g., digital processing by an image processing section and is subsequently transferred to a data storage section 17, and an image signal is sent to the laser emitter 5. A reference numeral 15 denotes a document feeder that feeds document sheets stored on a stacker 16 to the platen 12.

The image forming device A having the above-described configuration is provided with a control section (controller). Image forming conditions such as, printout conditions such as a sheet size specification, a color or black-and-white printing specification, a print copy count specification, single- or double-side printing specification, and enlarged or reduced printing specification are set via a control panel 18. On the other hand, in the image forming device A, image data read by the scan unit 13 or transferred through an external network is stored in the data storage section 17. The image data stored in the data storage section 17 is transferred to a buffer memory 19, which sequentially transfers data signals to the laser emitter 5.

Simultaneously with the image forming conditions, sheet processing conditions are input and specified via the control panel 18. The sheet processing conditions will be described later. The image forming device A forms an image on the sheet in accordance with the image forming conditions and the sheet processing conditions.

[Configuration of Sheet Processing Device]

The sheet processing device B connected to the above-described image forming device A receives a sheet with the image formed thereon from the main body discharge port 3 of the image forming device A and is configured to (1) store the sheet in a first sheet discharge tray 21 (printout mode), (2) align the sheets from the main body discharge port 3 in a bundle to staple them and then store the aligned sheet bundle in the first sheet discharge tray 21 (staple-binding mode), (3) bond the sheets from the main body discharge port 3 one by one to form a sheet bundle, fold the resultant sheet bundle into a booklet form, and store the resultant booklet in a second sheet discharge tray 22 (adhesive-bound sheet bundle folding mode), or (4) accumulate and align the sheets from the main body discharge port 3, then staple them, fold them into a booklet form, and then store the resultant booklet in the second sheet discharge tray (staple-bound sheet bundle folding mode).

Thus, as illustrated in FIG. 2, the sheet processing device B is provided with the first sheet discharge tray 21 and the second sheet discharge tray 22 in a casing 20. Further, the sheet processing device B is provided with a sheet carry-in path P1 having a carry-in port 23 continued to the main body discharge port 3. The sheet carry-in path P1 is formed of a straight-line path extending in a substantially horizontal direction in the casing 20. Further, there are provided a first switchback conveying path SP1 and a second switchback conveying path SP2 that branch off from the sheet carry-in path P1 to convey a sheet in a reverse direction. The first switchback conveying path SP1 branches off from the sheet carry-in path P1 at the downstream side of the sheet carry-in path P1, the second switchback conveying path SP2 branches off from the sheet carry-in path P1 at the upstream side of the sheet carry-in path P1, and the paths SP1 and SP2 are disposed spaced apart from each other.

In such a path configuration, in the sheet carry-in path P1, there are disposed a carry-in roller 24 and a sheet discharge roller 25, and the rollers 24 and 25 are coupled to a drive motor (M1) capable of rotating forward and backward. Further, in the sheet carry-in path P1, there is disposed a path switching piece 27 for guiding a sheet to the second switchback conveying path SP2, and the piece is coupled to an operation means such as a solenoid. Further, the sheet carry-in path P1 has, on the downstream side of the carry-in roller 24, a punch unit 28 for punching the sheet from the carry-in port 23. The illustrated punch unit 28 is disposed, on the upstream side of the carry-in roller 24, at the carry-in port 23 so as to be detachably mounted to the casing 20 depending on a device specification. Further, below the punch unit 28, a punch chip box 26 for housing punch chips generated upon the punch processing is detachably attached to the casing 20.

[Configuration of First Switchback Conveying Path SP1]

The first switchback conveying path SP1 disposed, as illustrated in FIG. 2, on the downstream side (rear end portion of the device) of the sheet carry-in path P1 is configured as described below. The sheet carry-in path P1 is provided, at its exit end, with a sheet discharge roller 25 and a sheet discharge port 25*a*. A first processing tray (hereinafter, referred to as "processing tray 29") is provided downward of the sheet discharge port 25*a* across a level difference formed therebetween. The processing tray includes a tray for loading and supporting the sheet discharged from the sheet discharge port 25*a*. There is disposed, above the processing tray 29, a forward/backward rotation roller 30. The forward/backward rotation roller 30 is coupled with the forward/backward rotation motor M1 and is controlled to be rotated in a clockwise direction in FIG. when a sheet approaches the processing tray 29, while rotating in a counterclockwise direction after a sheet rear end enters the tray. The forward/backward rotation roller 30 has a lifting roller 31 coupled to a caterpillar belt so as to be movable between positions contacting the tray and separated therefrom. Therefore, the first switchback conveying path SP1 is configured above the processing tray 29.

Further, the first sheet discharge tray 21 is located downstream of the first switchback conveying path SP1 and is configured to support a leading end of a sheet guided to the first switchback conveying path SP1 and the second switchback conveying path SP2.

With the above-described configuration, the sheet from the sheet discharge port 25*a* reaches the processing tray 29 and is conveyed toward the first sheet discharge tray 21 by the forward/backward rotation roller 30. Once the rear end of the sheet reaches the processing tray 29 from the sheet discharge port 25*a*, the forward/backward rotation roller 30 is reversely rotated (counterclockwise in the figure) to convey the sheet on the processing tray 29 in a direction opposite to a sheet discharge direction. At this time, the lifting roller 31 coupled to the caterpillar belt cooperates with the forward/backward rotation roller 30 to switchback-convey the rear end of the sheet along the processing tray 29.

A rear end regulating member 33 and an end surface stapler 35 are disposed at a rear end portion of the processing tray 29 in the sheet discharge direction. The rear end regulating member 32 regulates a position of the rear end of the sheet. The illustrated end surface stapler staples rear end edge of a sheet bundle stored on the tray at one or more portions. The rear end regulating member 33 is also used to provide a function of carrying out the staple-bound sheet bundle to the first sheet discharge tray 21 located downstream of the processing tray 29. To this end, the rear end regulating member 33 is configured to be able to reciprocate in the sheet discharge direction along the processing tray 29. The illustrated rear end regulating member 33 is coupled to a not illustrated bundle discharge motor (M7) so as to be reciprocated.

The processing tray 29 has a side aligning plate 36 with which the sheets stored on the tray are aligned in a width direction thereof. The side aligning plate 36 includes a pair of left and right (front and rear in FIG. 2) aligning plates so as to align the sheets with reference to a sheet center and is configured to approach and leave the sheet center. The side aligning plate 36 is coupled to a not illustrated side aligning plate motor (M6).

The first switchback conveying path SP1 configured as described above aligns the sheets from the sheet discharge port 25*a* on the processing tray 29 in the "staple-binding mode" described above, and the end surface stapler 35 staples the sheet bundle at one or more portions of the rear end edge of this sheet bundle. In the "printout mode", a sheet from the sheet discharge port 25*a* is not subjected to the switchback, but the sheet conveyed along the processing tray 29 is carried out to the first sheet discharge tray 21 by the forward/backward rotation roller 30. Thus, the illustrated device is characterized in that the sheet to be staple-bound is bridged between the processing tray 29 and the first sheet discharge tray 21 to allow the device to be compactly configured.

[Configuration of Second Switchback Conveying Path SP2]

The following describes a configuration of the second switchback conveying path SP2 branching off from the sheet carry-in path P1. As illustrated in FIG. 2, the second switchback conveying path SP2 is located in a substantially vertical direction inside the casing 20. A path carry-in roller 45 is located at an entrance of the second switchback conveying path SP2, and a conveying roller 46 is located at an exit of the second switchback conveying path SP2. The conveying roller 46 is configured to be movable between a position nipping the sheet and a position separated from the sheet. Although this configuration is not illustrated, a pinch roller or the like pressure contact to the conveying roller 46 is separated therefrom by an arm mechanism.

The path carry-in roller 45, located at the entrance of the second switchback conveying path SP2, is configured to be rotatable forward and backward. A sheet carried in the first switchback conveying path SP1 located downstream is temporarily held (temporarily reside) on the second switchback conveying path SP2. The reason for the temporary holding is as follows. That is, the preceding sheets are stored on the processing tray 29, staple-bound in response to a job completion signal, and the resultant sheet bundle is carried out to the first sheet discharge tray 21. During this carry-out, a sheet conveyed from the image forming device A to the sheet carry-in path P1 is temporarily held on the second switchback conveying path SP2. Then, after the processing of the preceding sheet bundle is finished, the standing-by sheet is conveyed from the first switchback conveying path SP1 onto the processing tray 29.

A stacker section 40 constituting the second processing tray that aligns and temporarily stores the sheets conveyed along the second switchback conveying path SP2 is provided downstream of a carry-in path 41 constituting the second switchback conveying path SP2 and serving also as a sheet carry-in path. The illustrated stacker section 40 includes a conveying guide that conveying the sheets. The conveying guide is constituted by a stacker upper guide 40*a* and a stacker lower guide 40*b* and configured so that the sheets are loaded and housed therein. The illustrated stacker section 40 is connected to the carry-in path 41 and located in a center portion of the casing 20 in the left-right direction so as to extend in the substantially vertical direction. This allows the device to be compactly configured. The stacker section 40 is shaped to have an appropriate length to house maximum sized sheets therein. There are provided, inside the stacker section 40, an adhesive-binding unit 50 as an adhesive applying section for applying an adhesive to the sheet, a staple-binding unit 240 that saddle stitches the sheet bundle with staples, and a folding mechanism section 80 including a folding blade 86 and a folding roller 81 for folding the sheet bundle. These components will be described later in detail.

[Configuration of Retreat Path (Third Switchback Path SP3)]

A retreat path 47 constituting a third switchback path SP3 is continuously provided from a rear end side of the stacker section 40 in a sheet conveying direction. The retreat path 47 branches off from the carry-in path 41 constituting the above-described second switchback conveying path SP2 and serving also as a path for carrying the sheet in the stacker section 40 and configured to overlap an exit end of the carry-in path and make the sheet advance thereinto in a switchback manner. As illustrated in FIGS. 2 and 3, the retreat path 47 is constituted by a switchback guide 42 formed of a plate material. Ribs are formed on a surface of the switchback guide 42 along the sheet conveying direction to smooth sheet conveying operation. Further, to cope with a case where a jam of the sheet bundle occurs in the retreat path, the switchback guide 42 is configured to turn about a guide releasing shaft 43 to be released.

When the rear end of the sheet carried in from the carry-in path 41 to the stacker section 40 passes through a position at which the retreat path 47 branches off from the carry-in path 41, the sheet is moved (lifted up) by a stopper section 90 as a regulating member for regulating the leading end of the sheet, and the rear end side of the sheet is switchback-conveyed to the retreat path 47 together with the sheet bundle in the stacker section 40.

At a merging point between the carry-in path 41 and the retreat path 47, a deflection guide 44 biased by a guide tension spring 44*a* toward the switchback guide 42 side of the retreat path 47 is provided. Further, at the merging point, the adhesive-binding unit 50 for applying an adhesive onto the sheet is located so as to immediately follow the deflection guide 44. The adhesive-binding unit has adhesive tape stampers 51 each serving as an adhesive means. Although details will be described later, when a sheet (second sheet) is carried in from the carry-in path 41 after an adhesive tape is applied (transferred) onto a preceding sheet (first sheet) by the adhesive tape stampers 51 of the adhesive-binding unit 50, the leading end of the second sheet is adhered to the adhesive-applied portion of the first sheet, making it impossible to apply the adhesive onto a center portion of the second sheet in the sheet conveying direction, thus failing to form a sheet bundle. For this reason, it is necessary to convey the sheet to the adhesive tape stampers 51 after the preceding sheet is switchback-conveyed to the retreat path 47. Thus, the retreat path 47 functions as a retreat path for the adhesive-applied sheet.

[Outline of Configurations of Components Provided Along Path Between Retreat Path and Stopper Section]

Based on FIGS. 2 and 3, an outline of configurations of components provided along a path between the retreat path 47 branching off from the carry-in path 41 and the stopper section 90 will be described.

At the merging point between the carry-in path 41 and the retreat path 47, the deflection guide 44 is provided, in which a spring is stretched so as to slightly press the sheet toward the switchback guide 42 of the retreat path 47. The deflection guide 44 has such a comb shape as to avoid the adhesive-applied position of the sheet. Thus, even when the adhesive-applied sheet passes under the deflection guide 44, the adhesive is not adhered to the conveying path. A flow of the sheet in this section will be described separately later.

As illustrated in detail in FIG. 3, at the merging point between the carry-in path 41 on the downstream side of the deflection guide 44 and the retreat path 47, the adhesive-binding unit 50 for applying an adhesive onto the sheet is provided in the stacker section 40. A sheet presser 65 for pressing a sheet stopped at an adhesive position for regulation is mounted to the adhesive-binding unit 50 so as to be vertically movable. Further, a sheet pressing slider 71 configured to be moved vertically to press the sheet and feed an adhesive tape AT as an adhesive is provided on a leading end side of the sheet presser 65. A transfer head 72 for backing up the adhesive tape AT fed from a reel is provided above the sheet pressing slider 71. The transfer head 72 is also moved between the adhesive position at which it presses the sheet to apply the adhesive tape AT onto the sheet and a separated position at which it is separated from the sheet to allow the sheet to be conveyed/moved therethrough.

The "application" in the present invention includes so-called "transfer" that transfers the adhesive from a tape to the sheet by pressing the sheet. Further, the "application"

includes spraying of the adhesive to the sheet while pressing the sheet. Further, a member to be applied may be a pasting member.

Figure 9A:
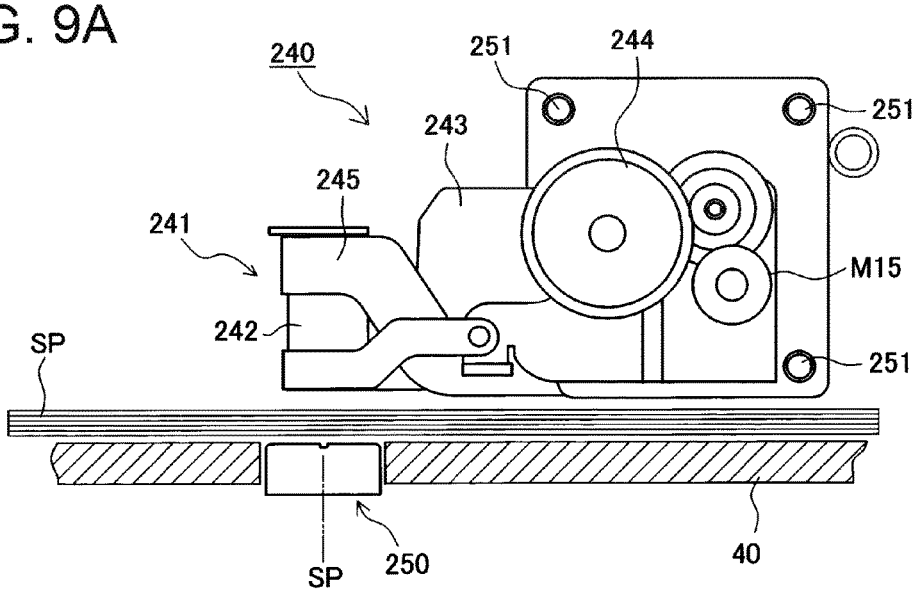

The staple-binding unit 240 is disposed downstream of the adhesive-binding unit 50. The staple-binding unit 240 is a saddle-stitching stapler that performs saddle-stitching for a sheet bundle using a metal staple 239. The staple-binding unit 240 uses a driver unit 241 to drive the metal staple 239 into a conveying direction center portion (staple-binding position SP) of a sheet bundle aligned/stored on the stacker section 40 and then uses a clincher unit 250 to bend leg portions of the driven staple in a direction facing each other, whereby the sheet bundle is bound. The details will be described later in FIGS. 9A and 9B.

When the sheet bundle is bound by the staple-binding unit 240, the sheet bundle to be bound is once housed in the stacker section 40. In this case, when a rear end of a previously housed sheet is jumped up, a leading end of the next sheet collides with the jumped up rear end of the previously housed sheet. This may prevent the next sheet from being inserted into the stacker section 40 properly or make the next sheet enter between the previously housed sheets to disturb the order of pages. Thus, in the device of the present embodiment, the above-mentioned deflection guide 44 is used to bias the sheet toward the retreat path 47 to allow the next sheet to be stacked onto the preceding sheet properly. Further, by switching back the preceding sheet bundle to the retreat path upon insertion of the next sheet, a surface of the preceding sheet guides the next sheet to more smoothly carry the next sheet in the stacker section.

An aligning member 48 configured to be moved in the sheet width direction to press a side edge of the sheet housed in the stacker section 40 is disposed downstream of the staple-binding unit. The aligning member 48 has a substantially U-shape, at a center portion of which folding rollers 81*a* and 81*b* serving as the folding mechanism section and the folding blade 86 for pressing the sheet against the folding rollers 81*a* and 81*b* are movably provided so as to press and separate from the sheet. Further, a pressure roller 49 is provided so as to immediately follow the aligning member 48 and to contact and separate from the stacker lower guide 40*b* which is one of the guide members constituting the stacker section 40. The pressure roller 49 is separated from the sheet until the leading end of the sheet passes therethrough and, after the sheet leading end passes through the pressure roller 49, the pressure roller 49 is rotated while pressing the sheet against the stacker lower guide 40*b*.

A sheet regulating member (hereinafter, referred to as "stopper section 90") for regulating a leading end of the sheet in the sheet conveying direction is provided on a lower end side of the stacker section 40. The stopper section 90 is supported by a guide rail of a device frame and is configured to be movable vertically by an elevating belt 93 stretched between vertically arranged upper and lower pulleys 94*a* and 94*b*. These pulleys 94 are moved by a motor (M10) to move the elevating belt 93. As described below, the elevating belt 93 is configured to move the stopper section 90 to and stop the same at positions of Sh0, Sh1, Sh2, Sh31, Sh32, and Sh4.

The Sh0, which is the lowermost position, is a home position of the stopper section 90. A sensor (not illustrated) is used to detect this position for initial position setting. The Sh1 is a receiving position of a first sheet and a position at which the rear ends of the sequentially stacked sheets that have passed through the carry-in path 41 are pressed by the deflection guide 44 toward the switchback guide 42 of the retreat path 47. The Sh2 is a position at which the sheet bundle is subjected to the folding at a substantially half position of the sheet in the sheet conveying direction. The Sh31 is a position at which the staple-binding unit 240 is used to drive, in the sheet width direction, the metal staple 239 into a substantially half position of the sheet bundle in the sheet conveying direction for binding. The Sh32 is a position at which the adhesive-binding unit 50 is used to apply (transfer), in the sheet width direction, the adhesive tape AT onto the sheet at a substantially half position of the sheet in the sheet conveying direction. The Sh4 is a position at which the adhesive-applied position at which the adhesive tape AT is applied onto the sheet is moved to the retreat path 47. More specifically, when a sheet (second sheet) is carried in from the carry-in path into the stacker section 40, the adhesive-applied position of the preceding sheet (first sheet) can be retracted to a position (application retreat position 100) separated away from the carry-in path of the second sheet so as to prevent a sheet jam or adherence of the adhesive to an unintended position due to contact of the second sheet with the adhesive-applied position of the first sheet.

As described above, in this device, carry-in of the sheet, application of the adhesive onto the sheet or staple-binding of the sheet bundle, movement of the adhesive-applied position to the retract path, carry-in of the subsequent sheet, and application of the adhesive onto the subsequent sheet are performed to bond the sheets by the adhesive, and the above operations are repeatedly performed to form the sheet bundle.

The resultant sheet bundle is then folded in two by the folding mechanism section 80 and discharged to the second sheet discharge tray by a bundle discharge roller 95 provided with a bundle kick-out piece 95*a*. The discharged sheet bundle is stored on the second sheet discharge tray by a bundle press guide 96 and a bundle presser 97 positioned downward of the bundle press guide 96. The bundle press guide 96 and the bundle presser 97 are used for preventing a sheet loading range from being narrowed due to opening of the bundle. The above sheet bundle formation and operation of the folding mechanism section will be described more in detail later.

[Configuration of Adhesive Application Device]

Figure 4:
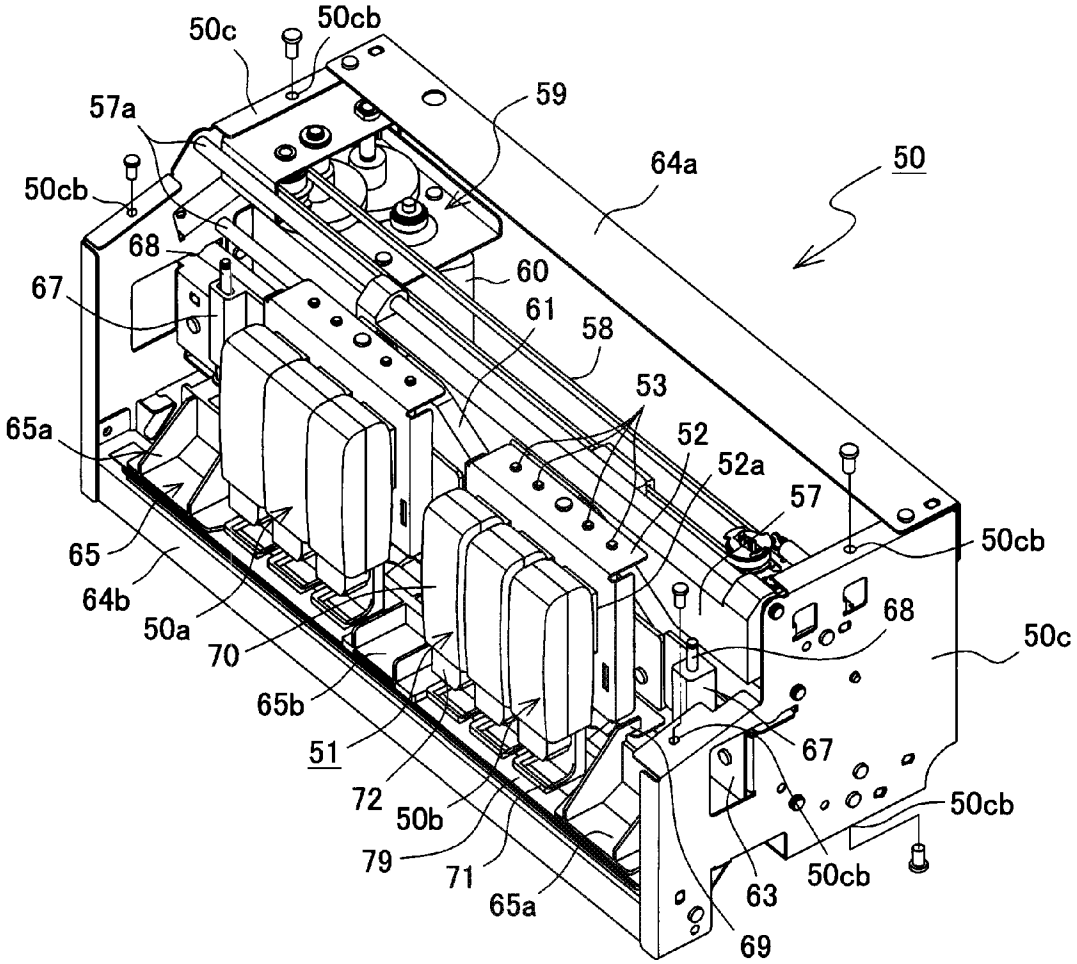
FIG. 4 is a perspective view of the adhesive-binding unit of FIG. 2.

The following describes the adhesive-binding unit 50 with reference to FIG. 3 to FIGS. 8A to 8C. A range surrounded by a dashed line of a cross-sectional view of FIG. 3 corresponds to the adhesive-binding unit 50 in the present embodiment. FIG. 4 is a perspective view of the adhesive-binding unit 50, and the adhesive-binding unit 50 is attached to the sheet processing device B with an illustrated range as a unit. FIGS. 5A to 5C are explanatory views of a main part of adhesive tape units 50*a* and 50*b* constituting an adhesive section. FIG. 5A is a plan view of a cam member 57 and the like. FIG. 5B is a front view illustrating an engagement state between the cam member 57 and a stamper holder 52. An upper part of FIG. 5C illustrates a state where the cam member 57 is moved to a position causing the adhesive tape stampers 51 to be separated from the sheet, and a lower part of FIG. 5C illustrates a state where the cam member 57 is moved to a position causing the stamper holders 52 to be pressed against the platen 79, at which the adhesive tape stampers contact the sheet. FIGS. 6A to 6D are explanatory views of the adhesive tape stampers 51. FIG. 6A is a perspective view, FIG. 6B is an internal mechanism view, and FIGS. 6C and 6D are views for explaining a drive mechanism for winding the adhesive tape AT in a stamping operation. FIGS. 7A to 7C and FIGS. 8A to 8C are explanatory views illustrating an operation of applying/transferring the adhesive tape AT onto the sheet performed by the adhesive tape units 50*a* and 50*b* each supporting a plurality of adhesive tape stampers 51.

There are disposed, within the dashed-line range of FIG. 3, members constituting the adhesive-binding unit 50. The members are: an adhesive tape stamper 51, a stamper holder for grouping the adhesive tape stampers 51 and supporting them in parallel, a cam member 57 that moves vertically the stamper holder 52 between a position at which the stamper holder 52 is brought close to a platen 79 to press the adhesive tape stampers 51 against the sheet for application of the adhesive thereonto and a position at which the stamper holder 52 is separated from the platen 79, and a cam moving motor 60 (M13) that moves the cam member in a direction crossing the sheet conveying direction. Further, a plurality of adhesive tape units 50*a* and 50*b* are configured to be attachable, as units, respectively, to the sheet processing device B, more specifically, to an upstream position of the stacker section 40. Further, in order to prevent the sheet from being shifted upon carry-in of the sheet into the stacker section 40 or switchback thereof to the retreat path 47, a part of the carry-in path (more specifically, a portion from a unit path entrance 143 to a carry-in path exit 144 of FIG. 3), deflection guide 44, a part of the branching retreat path 47 (more specifically, a retreat path exit 145), and the platen 79 are incorporated in the adhesive-binding unit 50 as units, respectively. The adhesive-binding unit 50 corresponding to the range surrounded by the dashed line of FIG. 3 is thus configured and is illustrated in a perspective view of FIG. 4.

Attachment of the adhesive-binding unit 50 to the sheet processing device B is made by fixing a not illustrated fixing portion of the sheet processing device B and a stop screw hole 50*cb* formed in a frame of the adhesive-binding unit 50 by an illustrated screw, as illustrated in FIG. 4. In place of the fixing structure using the screw, rails may be provided in the sheet processing device B and the adhesive-binding unit 50, respectively, so as to allow the adhesive-binding unit 50 to be pulled out.

The above unitized configuration allows an increase in accuracy of a positional relationship among the components as compared to a case where the components are individually attached to the sheet processing device B, thereby, in particular, suppressing adherence of the adhesive to an unintended position due to displacement upon movement of the sheet after application of the adhesive.

In the adhesive-binding unit 50, left and right application device frames 50*c*, a center support frame 63, a rear support frame 64*a*, and a lower support frame 64*b* constitute one casing. The center support frame 63 connects the left and right application device frames 50*c* at center portions thereof. The rear support frame 64*a* connects the left and right application device frames 50*c* at rear portions thereof. The lower support frame 64*b* connects the left and right application device frames 50*c* at portions thereof below the platen 79. The cam moving motor 60 (M13) is mounted to one of the left and right application device frames 50*c*. Drive of the cam moving motor 60 (M13) is transmitted to a moving belt 58 through a gear train 59. The moving belt 58 is connected to the cam member 57 which is configured to be slidable along two cam guide rods 57*a* extending between the left and right application device frames 50*c* in the sheet width direction. Thus, when the cam moving motor 60 (M13) is driven, the cam member 57 is moved to the left or right according to a rotating direction of the cam moving motor 60.

Figure 5A:
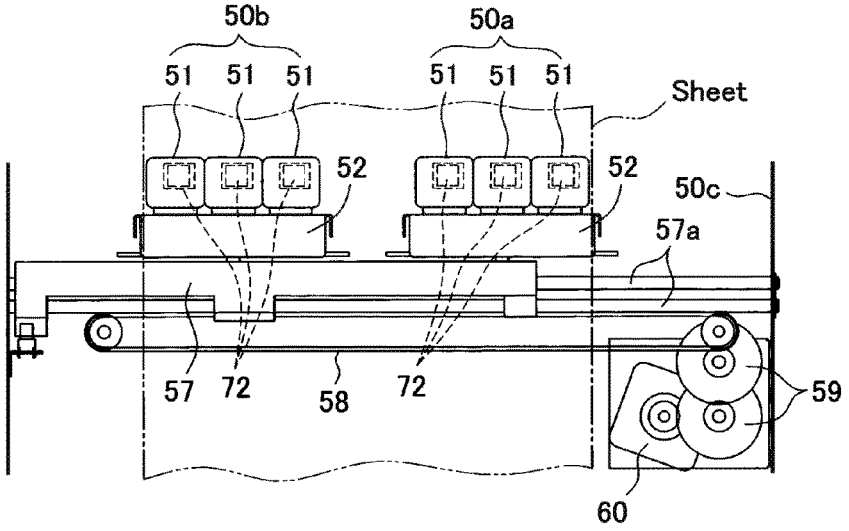
Figure 5B:
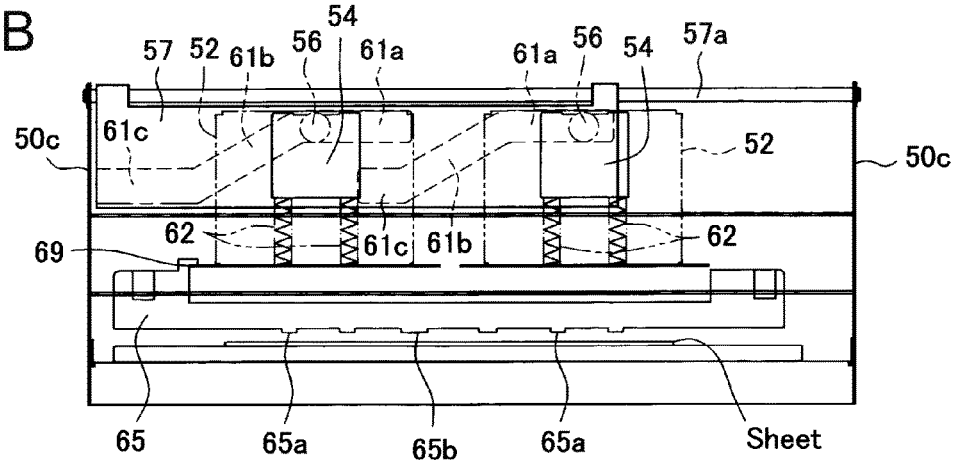
Figure 5C:
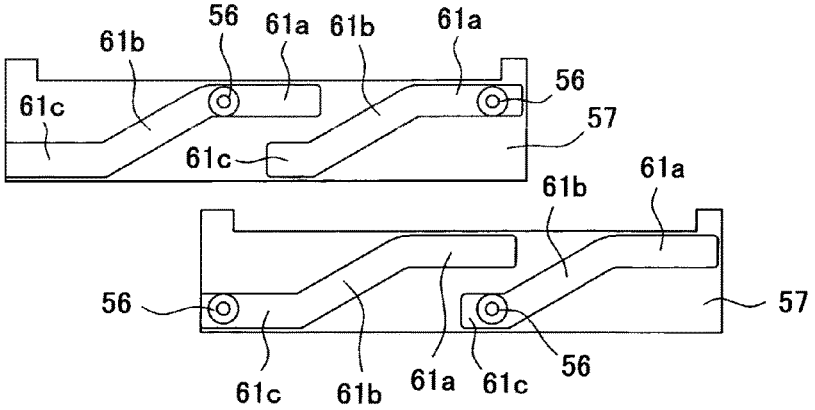

Cam grooves 61 as illustrated in FIGS. 5B and 5C are formed in the cam member 57. As illustrated, the cam member includes an upper horizontal cam groove 61*a*, a lower horizontal cam groove 61*c*, and an inclined cam groove 61*b*. The upper horizontal cam groove 61*a* is positioned at an upper portion of the cam member 57. The lower horizontal cam groove 61*c* is positioned at a lower portion of the cam member 57. The inclined cam groove 61*b* connects the upper horizontal cam groove 61*a* and the lower horizontal cam groove 61*c*. As illustrated, two left and right cam grooves are formed in the cam member 57 and are slightly different in phase. A roller 56 serving as a cam follower and fixed to a moving block 54 for moving vertically the stamper holder 52 is fitted into each of the cam grooves 61.

The roller engaged with (fitted into) each cam member is fixed to the moving block 54 through a shaft.

Figure 7A:
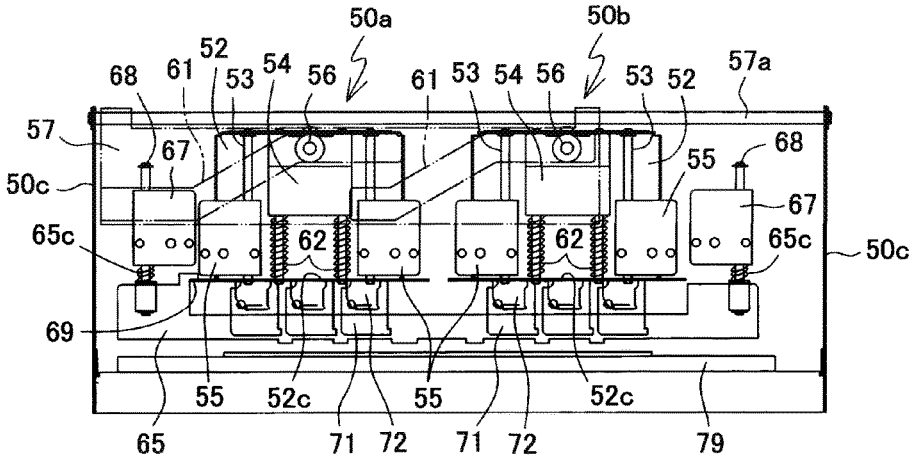

Referring to FIG. 7A (which is an explanatory view as viewed from the back of the cam member 57 of FIG. 4), the moving block 54 is slidably supported by inner two guide rods 53 of four guide rods 53 provided in the stamper holder 52 that supports the adhesive tape stamper 51 so as to vertically extend. On the other hand, each of the remaining (outer) two guide rods 53 is slidably supported by a support block 55 fixed to the center support frame 63 connecting the left and right application device frames 50*c*. Accordingly, the stamper holder 52 supporting the adhesive tape stampers 51 is supported by the support block 55 in which the outer guide rods 53 slide.

On the other hand, the moving block 54 is mounted to the two guide rods 53 at a center of the stamper holder 52 so as to be freely slidable. The moving block 54 is fixed to the roller 56 engaged, as a cam follower, with the above cam groove 61. Further, a pressure spring 62 is wound around the center two guide rods 53 between a bottom surface of the moving block 54 and a rear surface 52*c* of a bottom surface of the stamper holder 52. The pressure spring 62 constantly biases the moving block 54 in a direction pressing the same against an upper portion of the stamper holder 52. Accordingly, when the cam member 57 is moved to cause the roller 56 engaged with the cam groove 61 to descend, a transfer head 72 to be described later of the adhesive tape stamper 51 abuts against the sheet to stop the descent of the stamper holder 52. Then, the pressure spring 62 is compressed between the bottom surface of the moving block 54 and the rear surface 52*c* of the bottom surface 52*b* of the stamper holder 52. As a result, the transfer head 72 is pressed more strongly against the sheet by an elastic force of the pressure spring 62 compressed by the moving block 54, allowing the adhesive on the transfer tape AT to be reliably applied (transferred) onto the sheet.

Further, as illustrated in FIG. 5C, the left and right cam grooves 61 with which the rollers 56 are engaged respectively are different in phase and the initial position of the roller 56. Thus, the left side roller 56 starts to descend earlier, and the right side roller 56 reaches the lower horizontal cam groove 61*c* later. Therefore, the left side lower horizontal cam groove 61*c* is formed longer than the right side lower horizontal cam groove 61*c*. As a result, the left side adhesive tape unit 50*a* having the adhesive tape stampers 51 presses the sheet earlier than the right side adhesive tape unit 50*b*, and the right side adhesive tape unit 50*b* presses the sheet later. A considerable pressing force is required in order for the adhesive tape units 50*a* and 50*b* press the sheet at a time, so that a more powerful drive motor needs to be used to move the cam member 57; however, by deviating the timing of pressing the sheet as described above, it is possible to reduce a size of the motor or weight of the frame.

[Adhesive Means (Adhesive Tape Stamper)]

Figure 6A:
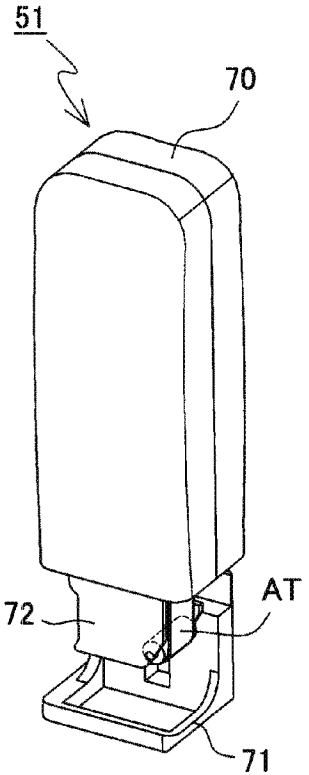

The adhesive tape stamper 51 configured to be detachably mounted to the stamper holder 52 constituting each of the adhesive tape units 50*a* and 50*b* will be described using FIGS. 6A to 6D. FIG. 6A illustrates an outer appearance of the adhesive tape stamper 51. There are shown, in FIG. 6A, a stamper cover 70, a transfer tape AT having an adhesive on a tape base material and configured to be sequentially delivered, a transfer head 72 around which the transfer tape AT is wound and configured to back up the transfer tape AT so as to press the same against the sheet, and a sheet pressing slider 71 positioned beside the transfer head 72 and configured to be moved vertically between a position protruding from the transfer head 72 and a retreat position corresponding to the transfer head 72. When the transfer head 72 is moved down and applies/transfers the transfer tape AT onto the sheet, the sheet pressing slider 71 presses the sheet positioned thereunder. With this pressing operation, the transfer tape AT is delivered, and a new adhesive surface appears. The transfer head 72 then backs up and presses the adhesive surface to thereby apply/transfer the adhesive onto the sheet.

Figure 6B:
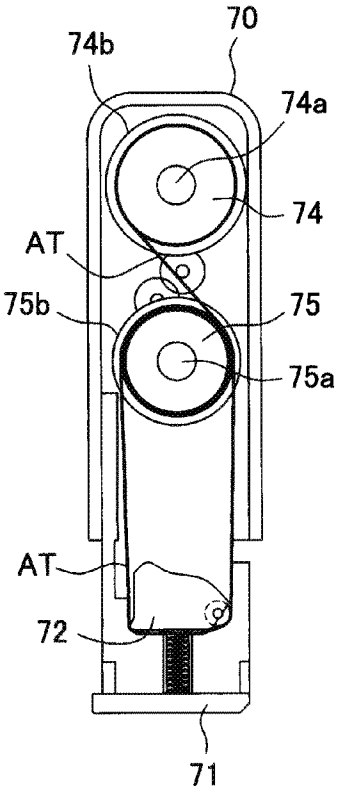
Figure 6C:
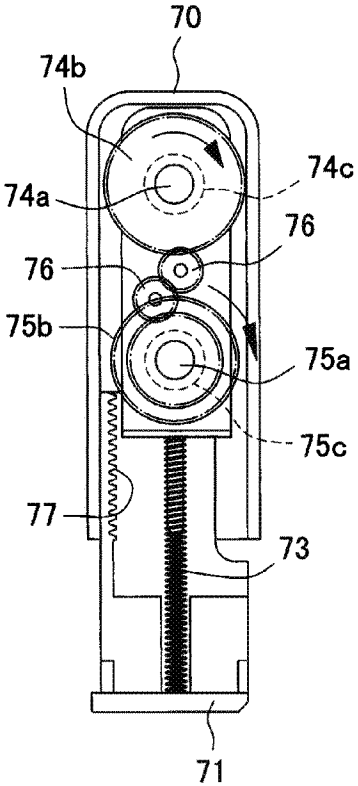

The following describes a configuration in which the transfer tape AT is delivered by extension/contraction of the sheet pressing slider 71. As illustrated in FIG. 6B, there are disposed, inside the stamper cover 70, a supply reel 74 freely rotatable about a supply reel shaft 74*a*, around which an unused transfer tape AT is wound and a winding reel 75 free rotatable about a winding reel shaft 75*a* and configured to wind the transfer tape AT that is delivered from the supply reel 74 and stretched over the transfer head 72. FIG. 6C illustrates a state before the transfer tape AT is delivered from the supply reel 74. Above the sheet pressing slider 71 provided inside the stamper cover 70 so as to be extendable/contractible, a resin slider rack 77 is provided. The slider rack 77 is engaged with a gear rotating together with the winding reel 75. Further, the gear of the winding reel 75 is engaged with a gear rotating together with the supply reel 74 through inter-reel gears 76.

Figure 6D:
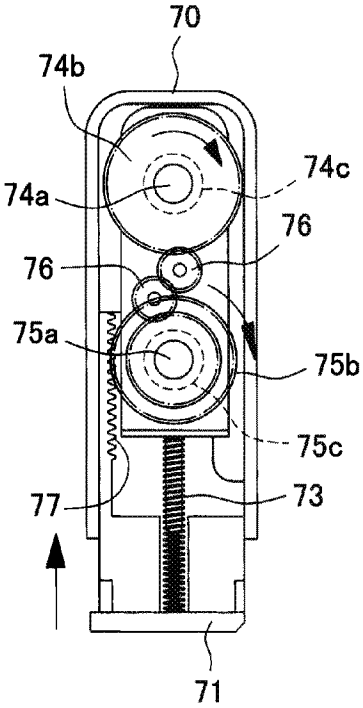

Further, a slider spring 73 is provided in the sheet pressing slider 71 and constantly biases outward (downward in FIGS. 6A to 6D) the sheet pressing slider 71. Thus, when the adhesive tape stamper 51 in a state of FIG. 6C where the slider spring 73 is extended is pressed down, the slider spring 73 is compressed as illustrated in FIG. 6D. At the same time, the slider rack 77 is engaged with a winding reel gear 75*b* of the winding reel 75 to rotate the winding reel 75 in a clockwise direction in the drawing. The winding reel gear 75*b* is engaged with one of the inter-reel gears 76, and the other one of the inter-reel gears 76 is engaged with a supply reel gear 74*b*. Thus, when the winding reel 75 is rotated in the clockwise direction in the drawing, the supply reel 74 is also rotated to cause the adhesive tape AT to be wound around the winding reel. At the same time, the transfer tape AT is delivered from the supply reel, and a new adhesive surface is positioned at the transfer head 72.

Then, when the adhesive tape stamper 51 is moved up in the state of FIG. 6D, the slider spring 73 is elastically restored to press down the sheet pressing slider 71. At this time, the winding reel gear 75*b* is engaged with the slider rack 77 and is thus rotated in a counterclockwise direction; however, a ratchet mechanism that transmits rotation only in one direction is interposed between the winding reel gear 75*b* and the winding reel 75, so that the winding reel 75 is not rotated. Further, the inter-reel gear 76 engaged with the winding reel gear 75*b* and the supply reel gear 74*b* are also rotated in the counterclockwise direction; however, a ratchet mechanism that transmits rotation only in one direction is interposed between the supply reel gear 74*b* and the supply reel 74, so that the supply reel 74 is not rotated. With this mechanism, only when the sheet pressing slider 71 is pressed down, the supply reel 74 and the winding reel 75 are rotated, and a new adhesive surface of the adhesive tape AT is delivered to the transfer head 72 and positioned thereat. In the present embodiment, as the ratchet mechanisms which are not illustrated, a one-way clutch that transmits rotation only in one direction between the reel gear and the reel may be adopted.

The movement from the state of FIG. 6C to state of FIG. 6D is made by the cam member 57 vertically moving the stamper holder 52 that supports a plurality of adhesive tape stampers 51 in the sheet width direction. This mechanism is as described above. Note that, as illustrated in FIG. 3, a foamed resin cushion material 52*a* for buffering an impact upon the vertical movement is interposed between the stamper holder 52 and the adhesive tape stamper 51. This improves application (transfer) performance of the adhesive from the adhesive tape AT onto the sheet.

The adhesive tape AT in the present embodiment has the adhesive on the tape base material and is configured to press the tape base material against the sheet to thereby transfer the adhesive onto the sheet.

[Sheet Bundle Presser Adjacent to Stamper Holder]

The following describes, using FIGS. 3 and 4, and particularly FIG. 7A, a sheet presser 65 that regulates movement or flapping of the sheet before the sheet pressing slider 71 of the adhesive tape stamper 51 described using FIGS. 6A to 6D presses the sheet against the platen 79 as the adhesive position.

As described above, the sheet presser 65 for regulating the sheet stopped at the adhesive position for bonding is mounted to the adhesive-binding unit 50 so as to be vertically movable with respect to the platen 79. As illustrated in FIG. 7A, there is provided, on both side of the two stamper holders 52 each supporting the adhesive tape stampers 51, a sheet presser support block 67 that slidably supports a sheet presser guide rod 68 having the sheet presser 65. The sheet presser support block 67 is fixed to the center support frame 63 by screws or the like inserted into illustrated round holes formed therein. Further, a pressing pressure spring 65*c* wound around the sheet presser guide rod 68 is provided at both side ends of the sheet presser support block 67 and a side edge presser 65*a* of the sheet presser 65.

The sheet presser 65 is constantly biased in a direction pressing the sheet, and one (left side of FIGS. 7A to 7C) stamper holder 52 and the sheet presser 65 are engaged with each other through an engagement portion 69 to stop the sheet presser 65 at a position separated from the sheet on the platen 79. Thus, when the stamper holder 52 is not moved down, the sheet presser 65 stays at the position separating from the sheet, allowing passage of the sheet. When the stamper holder 52 starts being moved down toward the sheet with the movement of the cam member 57, the engagement portion 69 between the stamper holder 52 and the sheet presser 65 is moved down as illustrated in FIG. 7C, and the sheet presser 65 is moved down to regulate displacement or flapping of the sheet on the platen 79. This can prevent the displacement or flapping of the sheet when the stamper holder 52 is moved down to cause the sheet pressing slider 71 to press the sheet, or when the stamper holder 52 is further moved down to cause the transfer head supporting the adhesive tape AT and pressing the same against the sheet to press the sheet.

Figure 7B:
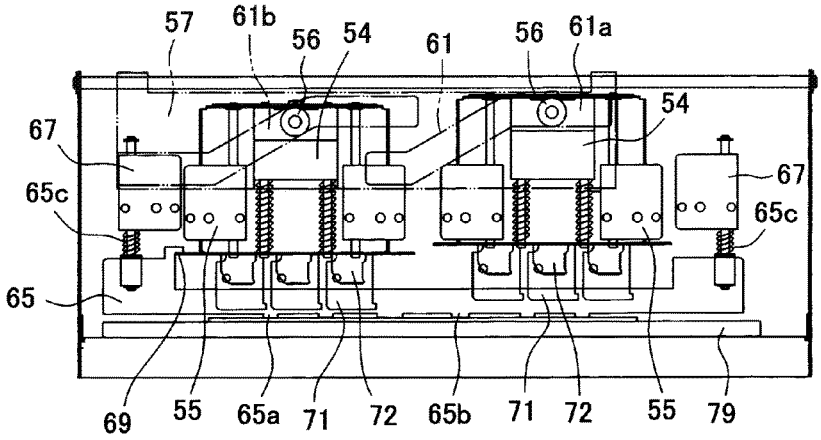
Figure 7C:
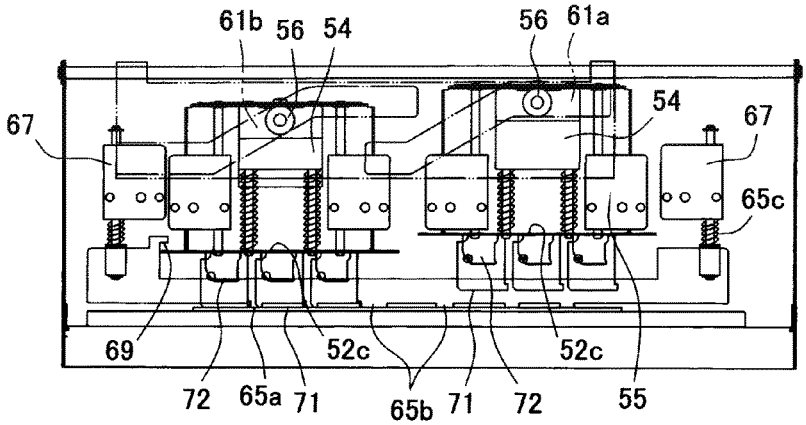

After each adhesive tape stamper 51 applies (transfers) the adhesive of the adhesive tape AT onto the sheet in the width direction thereof with the moving down of the two stamper holders 52, the cam member is returned to a state of FIG. 7B, and the engagement portion of the sheet presser 65 is engaged with the stamper holder 52 and moved up to a position retreated from the sheet by moving up of the stamper holder 52. As described above, the sheet presser 65 in the present embodiment presses the sheet, interlocking with the vertical movement of the stamper holder 52, before other members do. This sheet presser may be moved down before the moving down of the stamper holder 52 by means of a solenoid or the like. Further, although the side edge presser 65*a* and a center presser 65*b* are provided so as to press the sheet over the entire width thereof, only one of them suffices. That is, it is only necessary to prevent the sheet from being moved before application of the adhesive.

[Operation of Adhesive-Binding Unit]

The following describes an operation of applying (transferring) the adhesive onto the sheet by the adhesive-binding unit 50 using FIGS. 7A to 7C and FIGS. 8A to 8C. FIGS. 7A to 7C and FIGS. 8A to 8C are each an explanatory view as viewed from the back of the cam member 57, that is, from an opposite side to the tape stamper 51.

In a state of FIG. 7A, the cam member 57 is situated at an initial position, and the moving block 54 that makes the stamper holder 52 mounted with the adhesive tape stampers slide along the inner guide rods 53 and roller 56 are engaged with the cam groove 61 of the cam member 57. As described above, the moving block 54 has the pressure spring 62 which is interposed between itself and the moving block 54 and brings the pressure spring 62 into contact with and presses the rear surface 52*c* of the stamper holder 52, as illustrated in FIG. 7A. Further, the stamper holder is configured to slide along the outside guide rods 53 slidably supported by the support block 55, which is fixed to the center support frame 63 connecting the left and right application device frames 50*c*, so as to be moved vertically.

In FIG. 7A, the stamper holder 52 and the sheet presser locked to the stamper holder 52 are separated from the platen 79, thereby maintaining a space for allowing passage of the sheet. In this state, the sheet pressing slider 71 and the transfer head 72 of each adhesive tape stamper 51 are situated at a position farthest from the sheet. The other stamper holder 52 is situated at the same position.

In FIG. 7B, the sheet is situated at the adhesive position, and the cam moving motor 60 (M13) is driven by a signal for commanding application of the adhesive tape AT to move the cam member 57 to the right in the drawing. Then, the roller 56 on the left side in the drawing starts being moved down along the inclined cam groove 61*b*. This movement causes the left side stamper holder 52 to be moved down with the support block 55 sliding along the guide rods 53. The moving down of the stamper holder 52 causes the engagement portion 69 engaged with the stamper holder 52 to be moved down, thereby starting pressing the sheet on the platen 79. On the other hand, the sheet pressing slider 71 and the transfer head 72 of each adhesive tape stamper 51 are also moved down, but do not contact the sheet. The stamper holder 52 on the right side in the drawing is not moved down since the roller 56 is only slid in the upper horizontal cam groove 61*a* of the cam groove 61.

When the cam member 57 is further moved, the roller 56 on the left side in the drawing is further slid down along the inclined cam groove as illustrated in FIG. 7C. This sliding down releases the engagement between the sheet presser 65 and the right side stamper holder 52 which are engaged with each other at the engagement portion 69. When the engagement is released, the sheet presser 65 presses the sheet more reliably for position regulation by means of the pressing pressure spring 65*c* interposed between itself and the sheet presser support block 67. On the other hand, the sheet pressing slider 71 of the adhesive tape stamper starts to contact the sheet. With this contact, the adhesive tape AT is moved from the state of FIG. 6C to state of FIG. 6D to expose a new adhesive surface. In this state, the transfer head 72 has not yet contact the sheet. The stamper holder 52 on the right side in the drawing is not moved down since the roller 56 is only slid in the upper horizontal cam groove 61*a* of the cam groove 61.

Figure 8A:
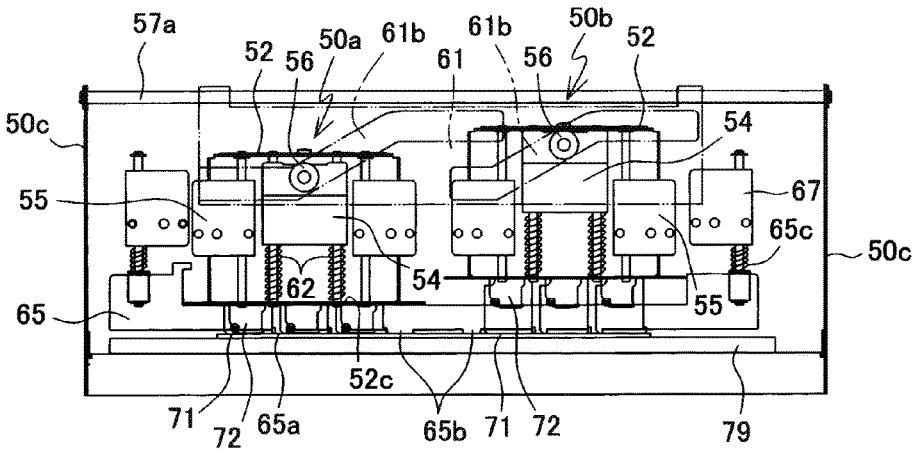

Subsequently, when the cam member 57 is moved to the right as illustrated in FIG. 8A, the stamper holder 52 on the left side in the drawing is moved down to cause the sheet pressing slider 71 and the transfer head 72 to abut against the sheet. When the transfer head 72 abuts against the sheet, the moving down of the stamper holder 52 is stopped, while the moving block 54 is slid along the inclined cam groove 61*b* and moved down. With this movement, the pressure spring 62 starts being compressed, and the elastic force of the pressure spring 62 acts on the transfer head 72 through the stamper holder 52 as a pressurizing force, with the result that the adhesive tape AT is pressed against the sheet more strongly. Thus, the adhesive can be reliably applied/transferred onto the sheet.

On the other hand, the roller 56 of the right side stamper holder 52 starts being slid down along the inclined cam groove 61*b*, and the sheet pressing slider 71 of the adhesive tape stamper 51 of the right side stamper holder 52 starts pressing the sheet.

Figure 8B:
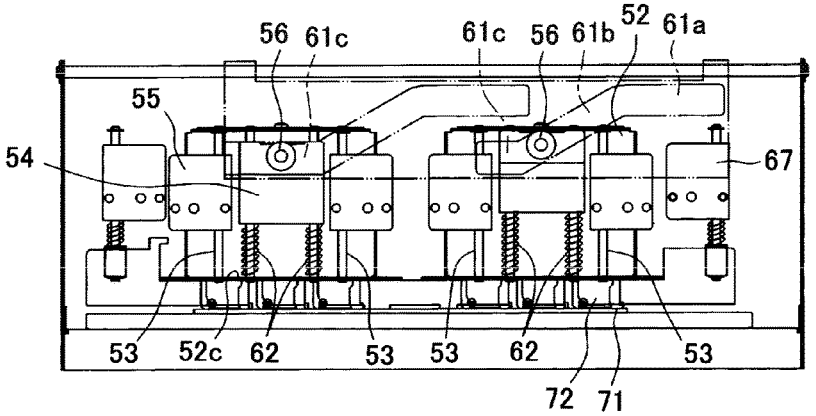

When the cam member 57 is further moved, a state of FIG. 8B is reached. In this state, the stamper holder 52 on the left side in the drawing is maintained in a pressurized state by the elastic force of the pressure spring 62. On the other hand, the roller 56 of the stamper holder 52 on the right side in the drawing reaches an end point of the inclined cam groove 61*b*, with the result that the sheet pressing slider 71 and the transfer head 72 of the adhesive tape stamper 51 of the right side stamper holder 52 press the sheet.

Figure 8C:
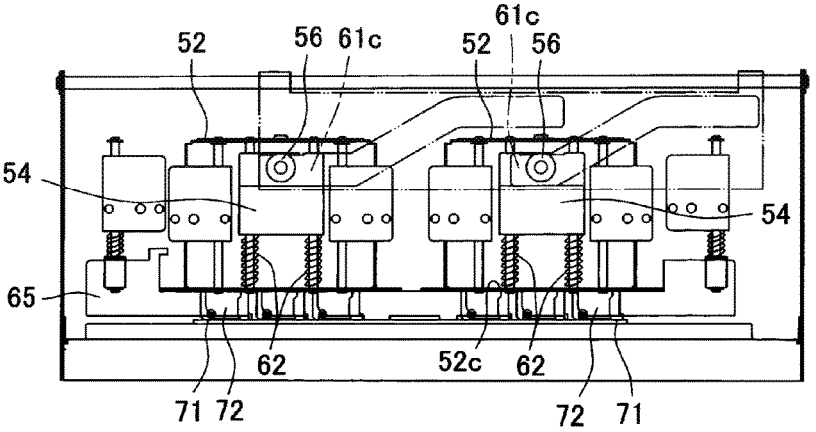

When the cam member 57 is situated at the rightmost position as illustrated in FIG. 8C, the left side stamper holder 52 is maintained in a more pressurized state by the elastic force of the pressure spring 62. On the other hand, the roller 56 of the stamper holder 52 on the right side in the drawing reaches the lower horizontal cam groove 61*c*, with the result that the sheet pressing slider 71 and the transfer head 72 of the adhesive tape stamper 51 of the stamper holder 52 on the left side press the sheet and that the pressure spring 62 is compressed. This elastic force acts on the transfer head 72 through the stamper holder 52 as a pressurizing force, with the result that the adhesive tape AT is pressed against the sheet more strongly. Thus, the adhesive can be reliably applied (transferred) onto the sheet. When there exists a preceding sheet applied with the adhesive, bonding between the sheets is strengthen.

After the transfer heads 72 have applied the adhesive onto the sheet by the moving down of the left- and right-side stamper holders 52, the cam member 57 is moved to the left in the drawing to move up the stamper holder 52 in a reverse order of the moving-down procedure. When the state of FIG. 7B is reached, the stamper holder 52 on the left side is engaged with the engagement portion 69 of the sheet presser 65 to move the sheet presser 65 to a position separated from the sheet. Subsequently, the state of FIG. 7A is restored, and the application of the adhesive onto a next sheet is prepared for.

As described above, in the present embodiment, the sheet is previously pressed by the sheet presser 65 to regulate movement of the sheet before the transfer head 72 of the adhesive tape stamper 51 applies the adhesive onto the sheet. This prevents displacement or flapping of the sheet, thus making it possible to apply the adhesive onto a predetermined position on the sheet. Further, even after the transfer head 72 abuts against the sheet, the stamper holder 52 that supports the transfer head 72 is pressed by the pressure spring 62. This makes it possible to press the transfer head 72 against the sheet more strongly, allowing the adhesive on the adhesive tape AT to be reliably transferred onto the sheet.

Further, as described in the explanation of the operation of the adhesive-binding unit, the left and right stamper holders 52 illustrated in FIGS. 7A to 7C and FIGS. 8A to 8C do not press the transfer heads 72 simultaneously, but the timing of pressing the sheet is deviated such that first the left side transfer head 72 group is pressed against the sheet, and then the right side transfer head 72 group is pressed against the sheet while the pressuring state of the left side transfer head 72 group is maintained. Thus, it is possible to reduce a drive force as compared to a case where the both the left- and right-side transfer head 72 groups are pressed against the sheet at a time, which in turn can reduce a size of the cam moving motor 60 (M13). Further, the device can be formed even with a slightly brittle frame structure, allowing a reduction in weight of the device.

The following sequentially describes the staple-binding unit 240 positioned downstream of the adhesive-binding unit 50, aligning member 48, conveying roller 46 and the pressure roller 49 which are configured to be separated from the sheet during the alignment operation, stopper section 90 as a leading end regulating member that regulates a leading end of the sheet carried in into the stacker section 40, and the gripper 91 provided in the stopper section 90 and configured to grip the sheet.

[Staple-Binding Unit]

The following describes the staple-binding unit 240 disposed, in the stacker section 40, downstream of the adhesive-binding unit 50. The staple-binding unit 240 is a saddle stitching stapler that saddle stitches, in the stacker section 40, a sheet bundle with a metal staple 239 at a center of the sheet bundle in the sheet conveying direction. A configuration of the staple-binding unit 240 will be described based on FIGS. 9A and 9B. The staple-binding unit 240 includes a driver unit 241 and a clincher unit 250. The driver unit 241 includes a head member 242 that inserts the metal staple 239 through the sheet bundle set at the binding position, a cartridge 243 housing the metal staples 239, a drive cam 244, and a staple motor (M16) that drives the drive cam 244. The head member 242 as a frame body incorporates, as illustrated in FIG. 3B, a driver member 246, a former 247, and a bending block 248 which are vertically arranged in this order from above. The driver member 246 and the former 247 are vertically slidably supported by the head member 242 so as to be reciprocatable between a top dead center and a bottom dead center. The bending block 248 is fixed to the head member 242 as a molding die that bends the metal staple 239 having a linear shape into a U-shape.

The clincher unit 250 is disposed at a position facing the above-described driver unit 241 across the sheet bundle. The illustrated clincher unit 250 is constituted by a structure separated from the driver unit 241 and bends a needle point (leading end) of the metal staple 239 inserted through the sheet bundle by the driver unit 241. To this end, the clincher unit 250 has a bending groove 250*a* for bending the leading end of the metal staple 239. Particularly, the illustrated clincher unit 250 has two bending grooves 250*a* which are arranged in the width direction of the sheet bundle stacked in the stacker section 40, and the driver units 241 corresponding to the bending grooves 250*a* staple-bind the sheet bundle at the plurality of positions in the sheet width direction.

That is, as illustrated in FIG. 3A, the driver unit 241 is fixed and supported on the sheet bundle by stapler support rods 251. With this configuration, it is possible to staple-bind the sheet bundle supported by the stacker section 40 at the left and right positions without moving the clincher unit 250 but with the same in a fixed state.

The clincher unit 250 may be configured to have a wing member (not illustrated) for bending the leading end of the staple and to swing/rotate the wing member in conjunction with (in synchronization with) the needle point to be inserted through the sheet bundle by the driver unit 241. In this case, a pair of bending wings are axially swingably supported on a frame of the clincher unit 250 at a position facing both ends of the U-shaped needle. Then, the pair of bending wings are swung in conjunction with the insertion operation of the metal staple 239 through the sheet bundle by the driver unit 241. The swinging of the pair of wings causes the leading ends of the staple to be bent along a back surface of the sheet bundle in a flat state. That is, when the metal staple 239 is bent by means of the bending groove, the needle leading end is bent in a U-shape (eyeglass clinch); while when the metal staple 239 is bent by means of the wing member, the needle leading end is bent linearly (flat clinch). In the present embodiment, the clincher unit 250 may adopt either the eyeglass clinch type or a flat clinch type.

Figure 9B:
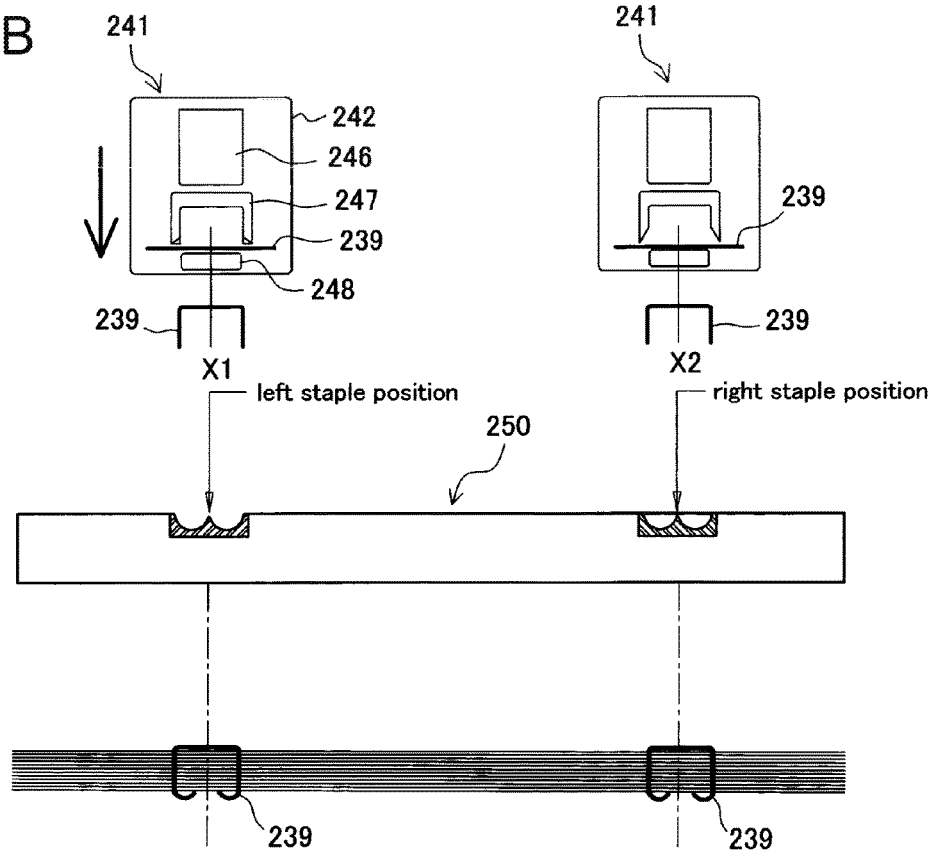

In the configuration described above, a rotation of the staple motor MD causes the drive cam 244 to press down the drive lever 245 through the energy accumulating spring from the top dead center to bottom dead center, with the result that the driver member 246 and the former 247 incorporated in the head member 242 and connected to the drive lever 245 move down from the top dead center to bottom dead center. The driver member 246 is formed of a plate-like member so as to press down a back part of the staple bent in a U-shape, and the former 247 is formed of a U-shaped member as illustrated in FIG. 9B so as to bend the staple into a U-shape with the bending block 248. That is, the metal staple 239 is supplied from the above-described cartridge 243 to bending block 248. The linear metal staple 239 is press-molded into the U-shape between the former 247 and the bending block 248. Then, the driver member 41*e* forcefully presses down the U-shaped metal staple 239 toward the sheet bundle to thereby insert the metal staple 239 through the sheet bundle, whereby the sheet bundle is saddle-stitched.

[Sheet Alignment Mechanism]

As described in FIG. 3, the aligning member 48 configured to be moved in the sheet width direction to press a side edge of the sheet in the stacker section 40 is disposed on both sides of the downstream side of the adhesive-binding unit 50.

Although not illustrated particularly, an aligning motor M12 (not illustrated) that drives the aligning member is drive/rotation controlled by a sheet binding/bonding operation controller 201 to be described later. In the present embodiment, an application position at which the adhesive is applied onto the sheet is retreated to the retreat path 47. This allows a new sheet to be bonded to be positioned in the carry-in path 41. That is, it is possible to align the new and preceding sheets in a state where the leading ends thereof whose rear ends are positioned in the different paths (the carry-in path 41 and the retreat path 47) abut against the stopper section 90. Further, the aligning member 48 is positioned at this position, allowing the alignment processing to be performed immediately before the bonding between the sheet on a surface of which the adhesive has been applied and a next sheet, which improves alignment accuracy of the sheet to be bonded.

[Separating Mechanism (Conveying Roller, etc.)]

It is necessary to release nipping and pressure contact with the sheet upon the alignment operation using the aligning member 48. Although this mechanism is not illustrated particularly, in a case of the conveying roller illustrated in FIG. 3, for example, a pinch roller configured to be brought into pressure contact with the conveying roller 46 is supported by an arm, and this arm is moved to thereby allow the pinch roller to contact and separate from the conveying roller 46. Similarly, the pressure roller positioned downstream of the aligning member 48 is supported by an illustrated arm so as to be moved between a position denoted by a continuous line and a position denoted by a dashed line. As a result, at the continuous line position, the pressure roller conveys the sheet downstream while pressuring the sheet; while at the dashed line position, the pressure roller is separated from the sheet to allow the sheet to be moved upstream by the stopper section 90. The pressure roller 49 may be lifted and lowered by a solenoid or the like directly connected thereto.

[Stopper Section Gripper Opening/Closing Mechanism]

Figure 10B:
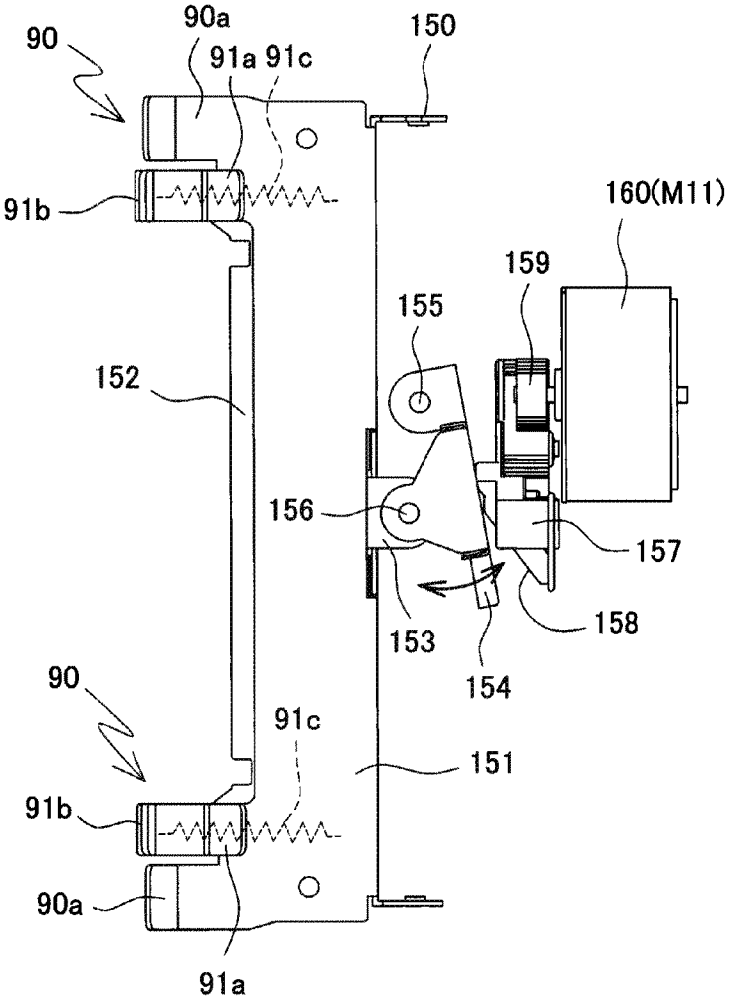
FIG. 10B is a plan view of the stopper section and the gripper.
Figure 10A:
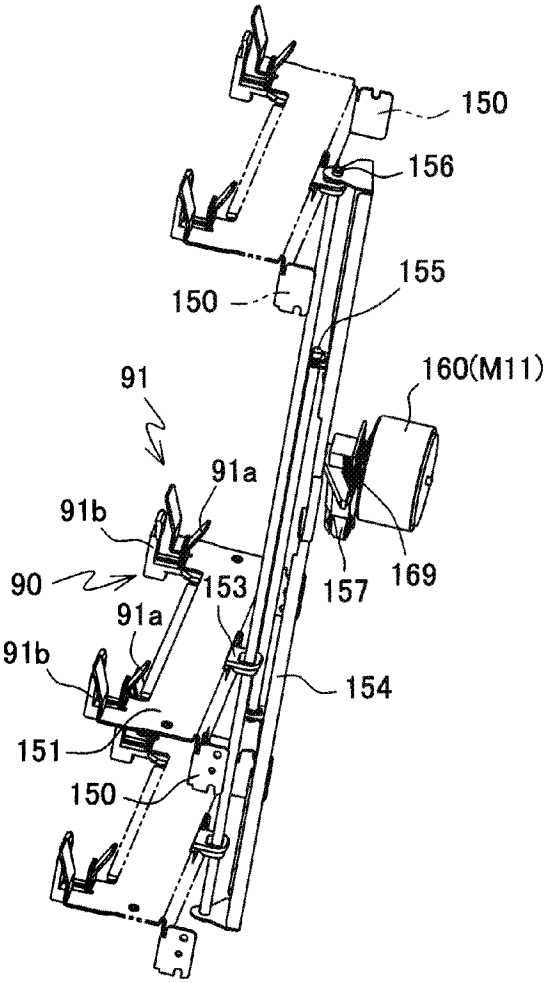
FIG. 10A is an explanatory view of a stopper section moved vertically in a stacker section and a gripper.

With reference to FIGS. 10A and 10B, a closing state where the gripper 91 positioned at a leading end of the stopper section 90 grips the sheet and an opening state where the gripping of the sheet by the gripper 91 is released will be described. The vertical movement of the stopper section 90 has already been described, so description thereof will be omitted here.

FIG. 10A illustrates the entire moving range of the gripper 91, in which the gripper 91 at the uppermost and lowermost positions is denoted by a virtual line. FIG. 10B is a plan view illustrating the gripper 91 and the stopper section 90 as viewed from above. The gripper 91 is disposed at the leading end of the stopper section 90, and a moving piece 91*b* of the gripper 91 is separated from a fixed piece 91*a* of the stopper section 90. A gripper connecting portion 152 connecting the moving pieces 91*b* is disposed below the stopper section 90 and a stopper section connecting portion 151 so as to be overlapped therewith and to freely advance and retreat with respect thereto. Further, a closing spring 91*c* constantly biasing the moving piece 91*b* in a closing direction is provided below the moving piece 91*b*.

The gripper connecting portion 152 has a connecting arm 153 protruding rearward from the stopper section 90. The connecting arm 153 has an opening hole. A turning bracket 154 supports upper and lower portions of a turning bar 156 penetrating the opening hole of the connecting arm 153. The turning bracket 154 is turned in a direction denoted by an arrow of FIG. 10B about a turning support point 155. The turning bracket 154 has a turning cam 157 having a bracket pressing surface 158. The turning cam 157 is rotated by a gripper opening/closing motor 160 (M11). When the bracket pressing surface 158 presses the turning bracket 154 with the rotation of the turning cam 157, the turning bracket 154 swings about the turning support point 155. With this swing, the turning bar 156 whose upper and lower portions are supported by the turning bracket 154 advances/retreats. Since the turning bar 156 penetrates the opening hole of the connecting arm 153, the moving piece 91*b* at the leading end of the connecting arm 153 contacts and separates from the fixed piece 91*a* of the stopper section 90.

Further, as illustrated in FIG. 10A, the turning bar 156 is positioned in the vertical movement range of the stopper section 90, so that even when the stopper section is moved vertically, the above connecting arm 153 can make the moving piece 91*b* constituting the gripper 91 advance/retreat at any vertical position. Thus, the closing state where the gripper 91 grips the sheet by the turning of the gripper opening/closing motor 160 and opening state where the gripping of the sheet is released are realized by the stacker section storage operation controller 200. As illustrated in FIG. 10A, the stacker section 40 is disposed in an inclined manner, so that the turning bracket 154 is constantly brought into abutment against the turning cam 157. The turning bracket 154 may be brought into abutment against the turning cam 157 by a spring or the like.

[Drive Mechanism of Folding Mechanism Section]

Figure 11:
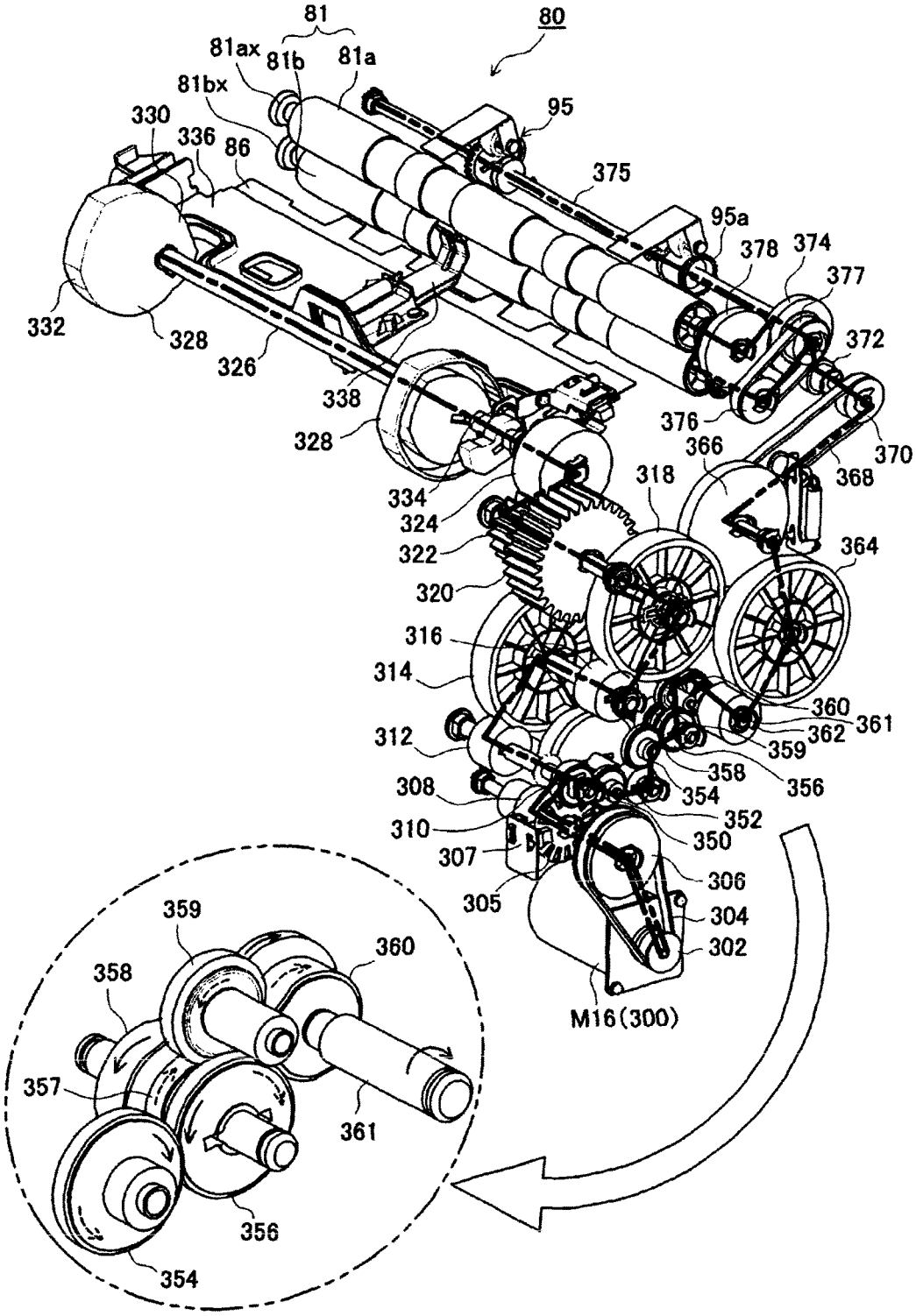
FIG. 11 is a perspective view of a drive mechanism in the folding mechanism section illustrated in FIGS. 2 and 3, which illustrates a state where a folding blade is situated at a home position.
Figure 12:
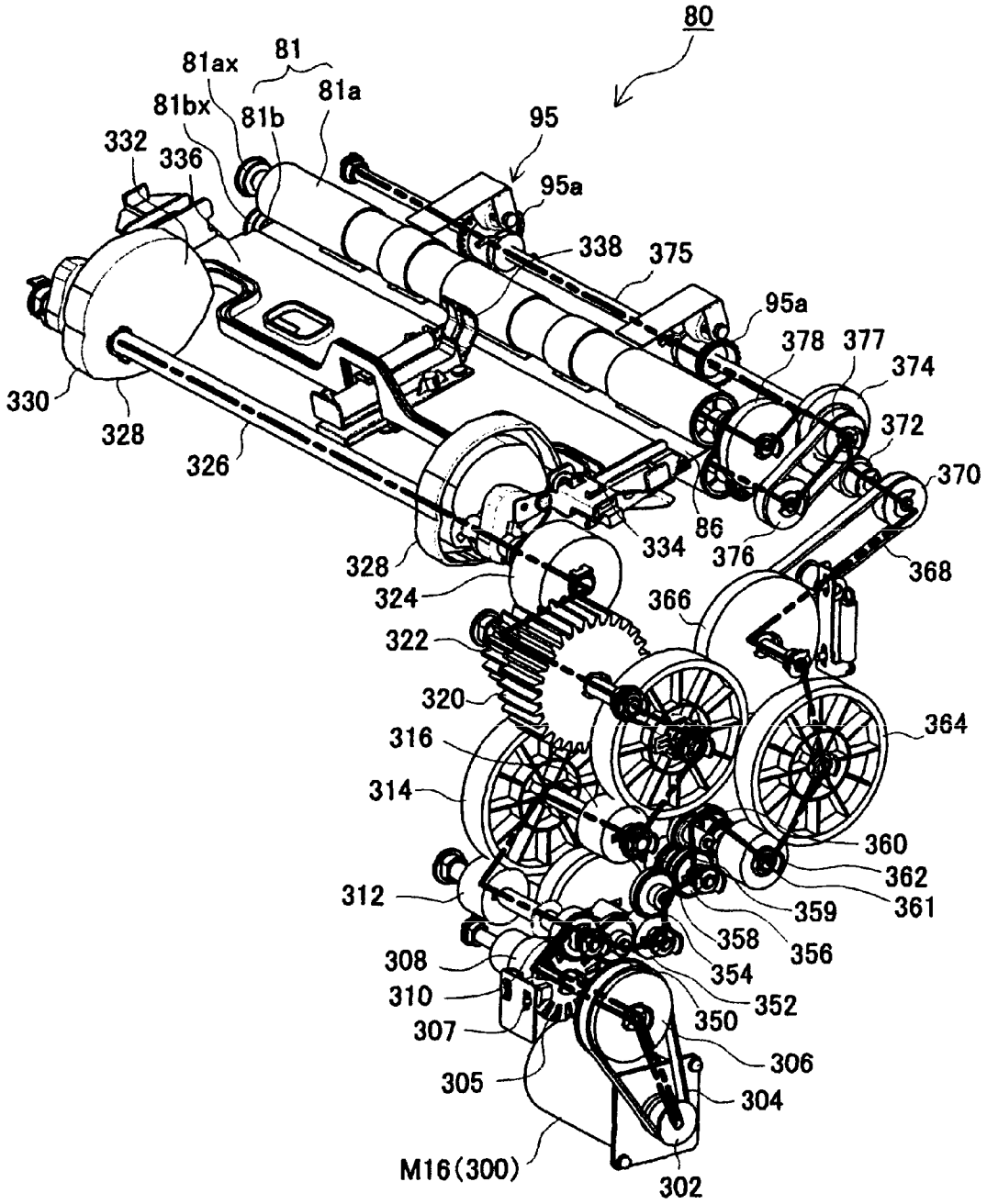
FIG. 12 is a perspective view of the drive mechanism illustrated in FIG. 11, which illustrates a state where the folding blade is situated at a sheet folding position.

The following describes, using FIGS. 11 and 12, a drive mechanism of the folding mechanism section 80 that folds in two a sheet bundle bound by the adhesive-binding unit 50 or staple-binding unit 240. FIG. 11 is a perspective view of the drive mechanism, illustrating a state where the folding blade 86 waits at a home position, and FIG. 12 is a perspective view of the drive mechanism, illustrating a state where the folding blade 86 enter between the folding rollers 81*a* and 81*b* and reaches a sheet folding position.

[Drive Path for Folding Blade]

A drive path for reciprocating the folding blade 86 illustrated in FIGS. 11 and 12 is denoted by a long dashed double-short dashed line in the drawing. Drive of the folding blade 86 is made by a folding drive motor 300 (M16) disposed at a lowermost part in the drawing. The drive is transmitted from a pulley 302 mounted to a drive shaft of the folding drive motor 300 to a drive pulley 306 through a drive belt 304. Then, the drive is further transmitted from a transmission gear 308 mounted to a shaft of the drive pulley 306 to a one-way clutch gear 310. When the one-way clutch gear 310 is rotated in one direction, it is engaged with the shaft to rotate a transmission gear 312; on the other hand, when the one-way clutch gear 310 is rotated in the other direction, the engagement with the shaft is released, and only the one-way clutch gear 310 is rotated in the other direction.

The drive is transmitted to a shaft gear 324 through illustrated transmission gears 314, 316, 318, 320, and 322. A moving cam 328 is turnably mounted to both sides of a rotary shaft 326 mounted with the shaft gear 324. A rotation of the drive motor 300 in one direction rotates the moving cam 328; however, the rotary shaft 326 of the moving cam 328 is provided at a decentered position. Therefore, a cam engagement member 334 engaged with a groove formed in the moving cam 328, a blade support plate 336 mounted with the cam engagement member 334, and the folding blade 86 mounted to the blade support plate 336 are moved in a front-rear direction in the drawing. That is, the folding blade 86 is moved to a home position (330) of FIG. 11 separated from the folding roller 81 and a moved position (328) of FIG. 12 where the folding blade 86 is inserted between the folding rollers 81*a* and 81*b*. A sheet biasing plate that presses the sheet bundle against the folding roller before sheet pushing operation of the folding blade 86 to the folding roller is movably mounted to the blade support plate 336 so as to be biased by a not illustrated spring.

[Drive Path for Folding Roller]

A rotational drive path of the folding roller 81 that folds the sheet bundle in two is denoted by a long dashed short dashed line in FIGS. 11 and 12. That is, the drive is transmitted from the same drive motor as that used as a drive source for moving the folding blade, i.e., the drive motor 300 to a transmission gear 350 through the transmission gear 308 and the one-way clutch gear 310. That is, the drive of the drive motor 300 branches off at the transmission gear 350 to a drive system of the folding roller 81. Therefore, the transmission gear 350 is rotated normally or reversely according to the rotation direction of the drive motor. The drive of the transmission gear 350 is transmitted to a transmission gear 354 through a transmission gear 352.

As illustrated in a circle outlined by a long dashed double-short dashed line of FIG. 11 (lower-left part), there are arranged downstream of the transmission gear 354, a normal/reverse transmission gear 356 that transmits the drive to a shaft thereof according to the rotation direction of the folding drive motor 300, a normal rotation one-way clutch gear 358 that is coaxially mounted to the normal/reverse transmission gear 356 and receives transmission of the drive only when the folding drive motor 300 is rotated normally, and a reverse rotation one-way clutch gear 357 that is coaxially mounted to the normal/reverse transmission gear 356 and receives transmission of the drive only when the folding drive motor 300 is rotated reversely. The normal rotation one-way clutch gear 358 is engaged with a large diameter part of a two-stage transmission gear 360. The reverse rotation one-way clutch gear 357 is engaged with an intermediate gear 359, and the intermediate gear 359 is engaged with a small diameter part of the two-stage transmission gear 360.

Thus, when the folding drive motor 300 is normally rotated, the drive of the folding drive motor 300 is transmitted sequentially to the transmission gear 354, normal/reverse transmission gear 356, normal rotation one-way clutch gear 358, and the two-stage transmission gear 360 in this order. On the other hand, when the folding drive motor 300 is reversely rotated, the drive of the folding drive motor 300 is transmitted sequentially to the transmission gear 354, the normal/reverse transmission gear 356, reverse rotation the one-way clutch gear 357, the intermediate gear 359, and the two-stage transmission gear 360 in this order. That is, irrespective of whether the folding drive motor 300 is rotated normally or reversely, a shaft 361 of the two-stage transmission gear 360 is rotated in one same direction (sheet folding direction of the folding roller 81).

The shaft 361 configured to be rotated only in one direction is provided with, at its outside, a transmission gear 362. The drive of the transmission gear 362 is transmitted sequentially to transmission gears 364 and 366, a transmission belt a368, a belt pulley 370, a transmission gear 372, and a bundle discharge roller gear 374 in this order. The drive of the bundle discharge roller gear 374 is transmitted, through a shaft thereof, to a bundle discharge roller 95. The drive of the bundle discharge roller 95 is transmitted to folding rollers 81*a* and 81*b* through a transmission gear 378 and a transmission belt b377, respectively.

In the thus configured drive transmission configuration of the folding mechanism section 80, the normal rotation of the folding drive motor 300 causes the folding blade 86 to be reciprocated between the home position and moved position where the folding blade 86 pushes the sheet bundle into the folding roller 81 and causes the folding roller 81 to be rotated in the folding direction. On the other hand, with the reverse rotation of the folding drive motor 300, the folding blade 86 is stopped by action of the one-way clutch gear 310; however, the folding roller 81 is not stopped, but rotated in the folding direction by action of the normal rotation one-way clutch gear 358 and reverse rotation one-way clutch gear 357. Thus, even when the folding drive motor 300 is rotated reversely after completion of the reciprocation of the folding blade 86, the folding roller 81 continues being rotated in the folding direction. That is, even a sheet bundle formed by long sized sheets can be folded with a single drive motor.

[Speed Control for Folding Blade and Folding Roller]

An encoder 305 is mounted to the shaft of the drive pulley 306 that drives the transmission gear 308, and a detection sensor 307 that detects a rotation amount of the encoder 305 is provided. A rotation speed of the folding drive motor 300 is detected by a signal from the detection sensor, and the detection sensor is input to a sheet bundle folding processing controller 202 to be described later. The sheet bundle folding processing controller 202 controls a supply current such that the folding roller 81 and the folding blade 86 operate at high speed (in the present embodiment, a rotation speed of the folding roller is 200 mm/sec, and a moving speed of the folding blade is 260 mm/sec) when the sheet bundle to be folded has been staple-bound by the staple-binding unit 240 to maintain a drive speed of the folding drive motor 300 at high speed. On the other hand, when the sheet bundle to be folded has been bonded by the adhesive-binding unit 50, the sheet bundle folding processing controller 202 controls the supply current such that the folding roller 81 and the folding blade 86 operate at low speed (in the present embodiment, the rotation speed of the folding roller is 100 mm/sec, and the moving speed of the folding blade is 130 mm/sec). As described above, in the present embodiment, the rotation amount of the folding drive motor 300 is controlled to thereby realize high and low speed operation.

The moving speed of the folding blade 86 is set to about 1.3 times the rotation speed of the folding roller 81 irrespective of whether the operation speed is high or low. That is, if the rotation speed of the folding roller 81 is increased due to speed fluctuation upon pushing of the sheet bundle into the folding roller 81 by the folding blade 86, outside sheets of the folded sheet bundle advance faster to leave inside sheets behind. The above speed setting is to prevent this phenomenon.

Further, in the embodiment illustrated in FIGS. 11 and 12, the folding roller 81 and the bundle discharge roller are operated by the same drive system. That is, the folding roller 81 and the bundle discharge roller 95 change their rotation speeds depending on the binding type of the sheet bundle, thereby suppressing peeling-off of the bonded sheets from one another or generation of wrinkles. The above-described folding drive motor 300 according to the present embodiment is a DC motor. Thus, when resistance is high, that is, when the number of sheets that form the sheet bundle is large, a torque of the folding drive motor 300 is increased to cope with the high resistance. Further, by controlling the speed, folding processing according to the binding type can be performed in a certain range. When a stepping motor is used as the folding drive motor 300, operation control can be made finer by controlling both the rotation speed and torque.

[Operation of Folding Mechanism Section]

The following describes an operation of the folding mechanism section 80 that applies folding processing to the staple-bound or adhesive-bound sheet bundle at the adhesive-bound sheet bundle folding position Sh2. First, in FIGS. 13A to 13D, an operation of folding the sheet bundle that has been staple-bound by the staple-binding unit 240 using the metal staples will be described. Then, in FIGS. 14A to 14D, an operation of folding the sheet bundle that has been adhesive-bound by the adhesive-binding unit will be described.

[Folding Processing for Staple-Bound Sheet Bundle]

Figure 13A:
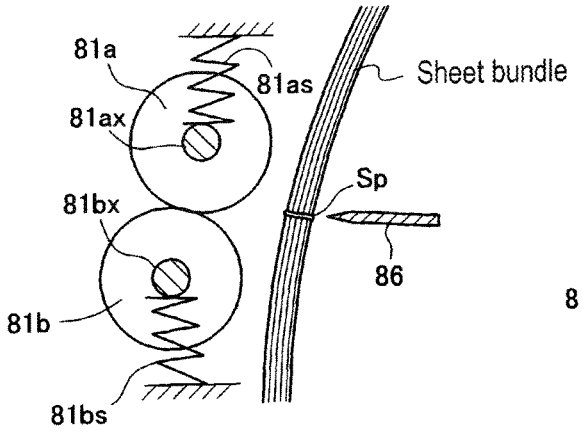

As illustrated in FIG. 13A, there are provided, at a folding position Y disposed downstream of the staple-binding unit 240, the folding roller 81 for folding the staple-bound sheet bundle and the folding blade 86 for inserting the sheet bundle into a nip position of the folding roller 81. The folding roller 81 is constituted by the rollers 81*a* and 81*b* brought into pressure contact with each other. The rollers 81*a* and 81*b* are each formed to have a length substantially corresponding to the maximum width of the sheet. Rotary shafts 81*ax* and 81*bx* of the respective rollers 81*a* and 81*b* constituting the folding roller 81 are fitted respectively into long grooves of a not illustrated device frame and are biased in a pressure-contact direction by respective compression springs 81*a*S and 81*b*S so as to allow the rollers 81*a* and 81*b* to be brought into pressure contact and coupled with each other. The folding roller may have a structure in which at least one of the rollers 81*a* and 81*b* is axially supported so as to be movable to the pressure-contact direction and is provided with the compression spring.

The pair of rollers 81*a* and 81*b* are each formed of a material, such as a rubber, having a large friction coefficient. This is for conveying the sheet bundle in a roller rotation direction while folding the same by a soft material such as a rubber, and the rollers 81*a* and 81*b* may be formed by applying lining to a rubber material.

Figure 13B:
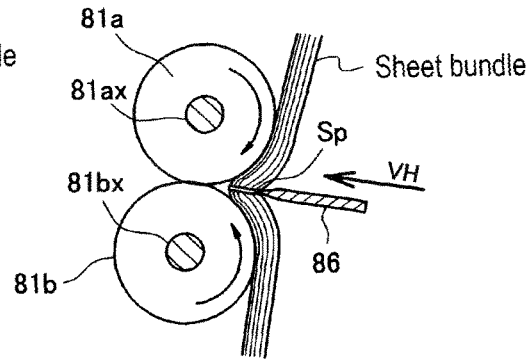
Figure 13C:
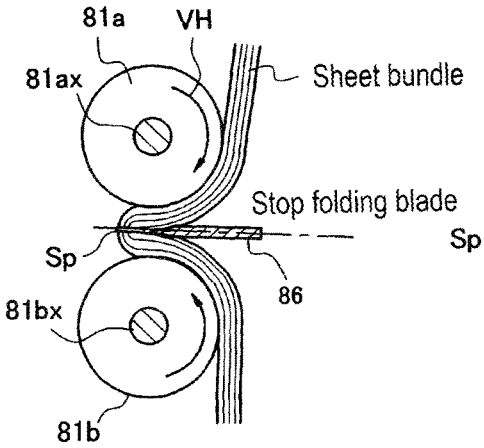
Figure 13D:
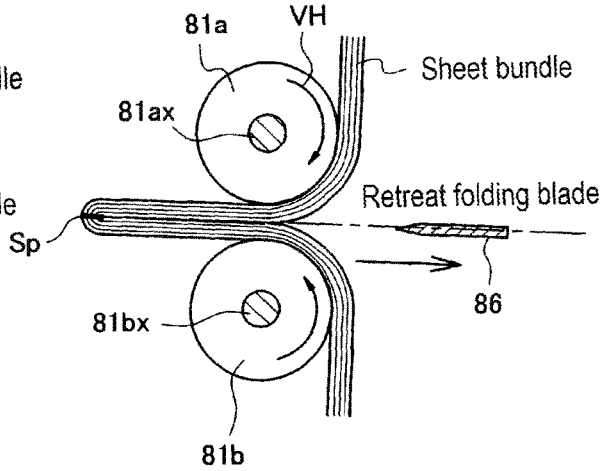

The following describes an operation of folding the sheet bundle by means of the above folding roller 81 with reference to FIGS. 13A and 13D. The pair of rollers 81*a* and 81*b* are positioned above the stacker section 40 and below the adhesive-binding unit 50, and the folding blade 86 having a knife edge is provided at a position facing the roller pair 81*a* and 81*b* with the adhesive-bound sheet bundle supported by the stacker section 40 interposed therebetween. The folding blade 86 is supported by a device frame so as to be reciprocatable between a home position illustrated in FIG. 13A and an operation position illustrated in FIG. 13C.

The sheet bundle supported in a bundle in the stacker section 40 is stopped by the stopper section 90 at a leading end of the stacker section 40 in a state illustrated in FIG. 13A, and a fold position of the sheet bundle is set to a staple-bound position of the sheet bundle.

The sheet bundle folding processing controller 202 moves the folding blade 86 from the standby position to nip position at a comparatively high speed VH (in the present embodiment, the moving speed of the folding blade is 260 mm/sec). Then, as illustrated in FIG. 13B, the sheet bundle is bent by the folding blade 86 at the fold position and is inserted between the rollers 81*a* and 81*b*. At this time, the pair of rollers 81*a* and 81*b* are driven into rotation along with the movement of the sheet bundle by the folding blade 86. Then, the sheet bundle folding processing controller 202 reversely rotates the folding drive motor 300 after elapse of an estimated time period during which the sheet bundle reaches a predetermined nip position to stop the folding blade 86 at a position illustrated in FIG. 13C. On the other hand, the folding roller 81 continues to be rotated in the folding direction. As a result, the sheet bundle is fed in a delivery direction (leftward in FIG. 13C). Thereafter, the sheet bundle folding processing controller 202 normally rotates the folding drive motor 300 once again. Then, as illustrated in FIG. 13D, the folding blade 86 positioned at the nip position is moved toward the standby position concurrently with the delivery of the sheet bundle by the folding roller 81.

As described above, when the sheet bundle to be folded is the staple-bound sheet bundle bound by the metal staples, it is possible to operate the folding blade 86 and the folding roller 81 at the comparatively high speed VH (in the present embodiment, the rotation speed of the folding roller is 200 mm/sec, and the moving speed of the folding blade is 260 mm/sec), whereby the folding processing can be performed efficiently.

The folding speed is changed while constantly transmitting the drive system to both the folding roller 81 and the folding blade 86 illustrated in FIGS. 13A to 13D and FIGS. 14A to 14D, the operation speed control can be made reliably. Alternatively, however, a configuration may be adopted, in which a one-way clutch is coupled to the shafts 81*ax* and 81*bx* of the folding roller 81 to make the shafts 81*ax* and 81*bx* follow the pushing operation of the folding blade 86. That is, the shafts 81*ax* and 81*bx* are driven into rotation when the folding blade 86 reaches a predetermined pushing position. In this case, change of the folding speed is made by the folding blade.

[Folding Processing for Adhesive-Bound Sheet Bundle]

The folding of the sheet bundle bound by the adhesive-binding unit 50 is also performed by using the folding roller 81 and the folding blade 86, so description with respect to the same member or the same operation will be omitted. The sheet bundle to be folded bound by the adhesive-binding unit 50 is folded with the folding position Y disposed downstream of the above-described staple-binding unit 240 coinciding with a center of the bonding range of the sheet bundle.

Figure 14A:
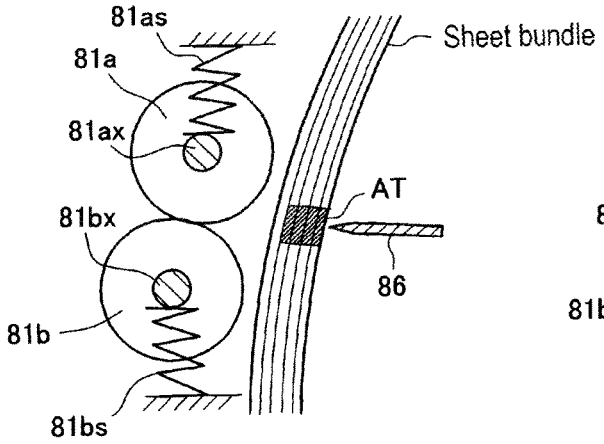

As illustrated in FIG. 14A, there are provided the folding roller 81 for folding the adhesive-bound sheet bundle bound by means of the adhesive AT and the folding blade 86 for inserting the sheet bundle into the nip position of the folding roller 81.

Figure 14B:
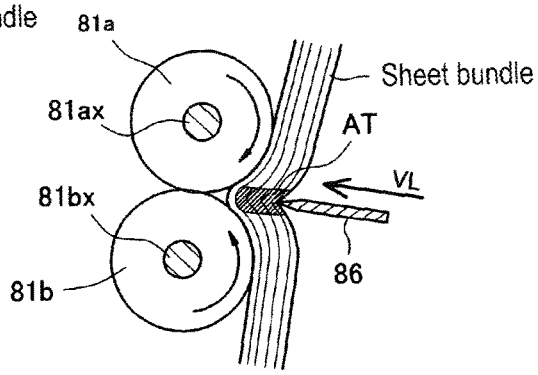

The sheet bundle supported in a bundle in the stacker section 40 is stopped by the stopper section 90 at the leading end of the stacker section 40 in a state illustrated in FIG. 14A, and a fold position of the sheet bundle is set to an adhesive-bound position of the sheet bundle. The sheet bundle folding processing controller 202 moves the folding blade 86 from the standby position to nip position at a comparatively low speed VL (in the present embodiment, the moving speed of the folding blade is 130 mm/sec). Then, as illustrated in FIG. 14B, the sheet bundle is bent by the folding blade 86 at the fold position and is inserted between the rollers 81*a* and 81*b*. At this time, the pair of rollers 81*a* and 81*b* are driven into rotation at the same speed as that of the sheet bundle moved by the folding blade 86.

Figure 14C:
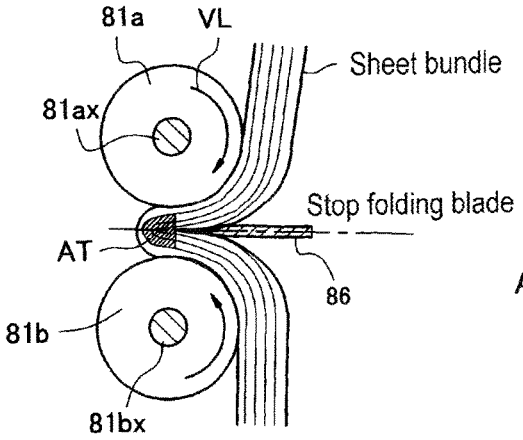
Figure 14D:
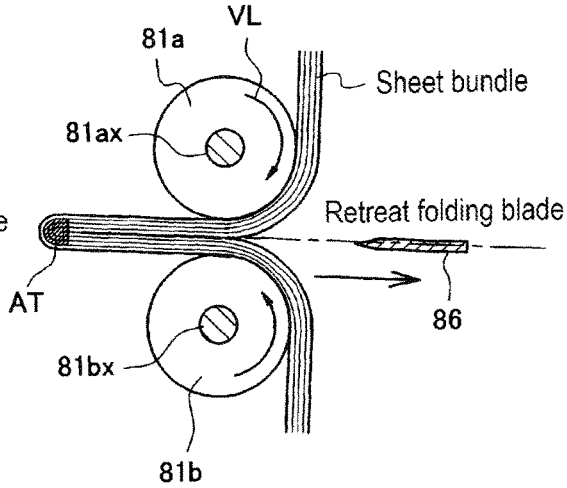

Then, the sheet bundle folding processing controller 202 reversely rotates the folding drive motor 300 after elapse of an estimated time period during which the sheet bundle reaches a predetermined nip position to stop the folding blade 86 at a position illustrated in FIG. 14C. On the other hand, the folding roller 81 continues to be rotated in the folding direction. As a result, the sheet bundle is fed in the delivery direction (leftward in FIG. 14C). Thereafter, the sheet bundle folding processing controller 202 normally rotates the folding drive motor 300 once again. Then, as illustrated in FIG. 14D, the folding blade 86 positioned at the nip position is moved toward the standby position concurrently with the delivery of the sheet bundle by the folding roller 81.

As described above, when the sheet bundle to be folded is the adhesive-bound sheet bundle bound by the adhesive, it is possible to operate the folding blade 86 and the folding roller 81 at the comparatively low speed VL (in the present embodiment, the rotation speed of the folding roller is 100 mm/sec, and the moving speed of the folding blade is 130 mm/sec). This suppresses peeling-off of the sheets from one another or break of the sheets at the bonded portion.

Figure 15A:
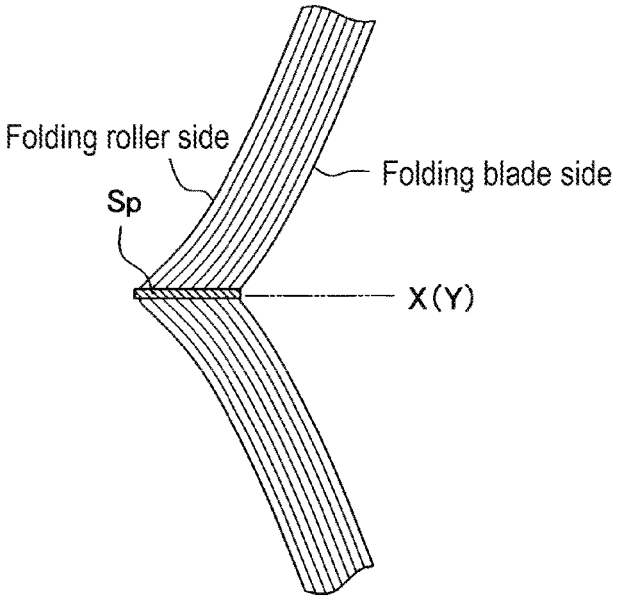
Figure 15B:
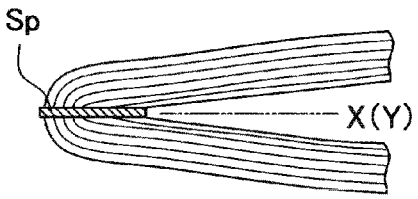
Figure 15C:
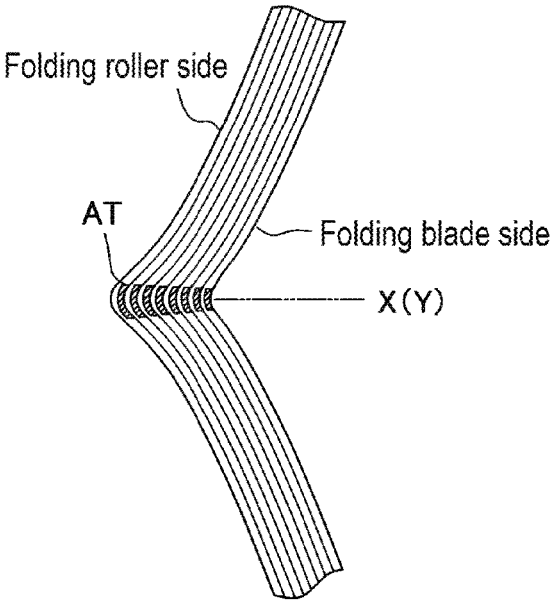
Figure 15D:
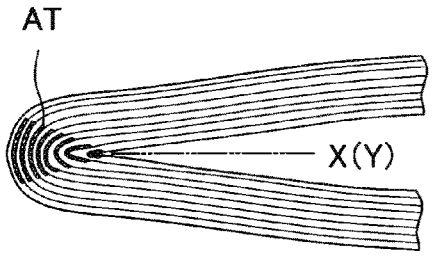
Figure 16A:
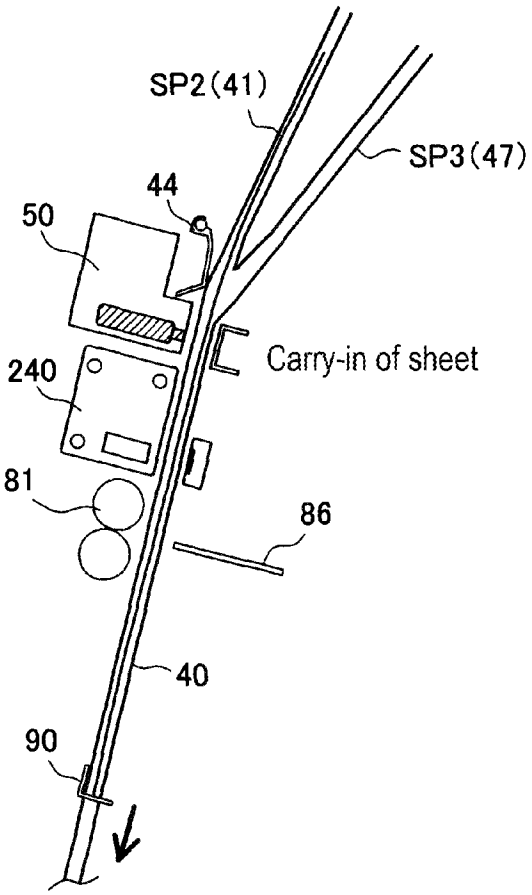
Figure 16B:
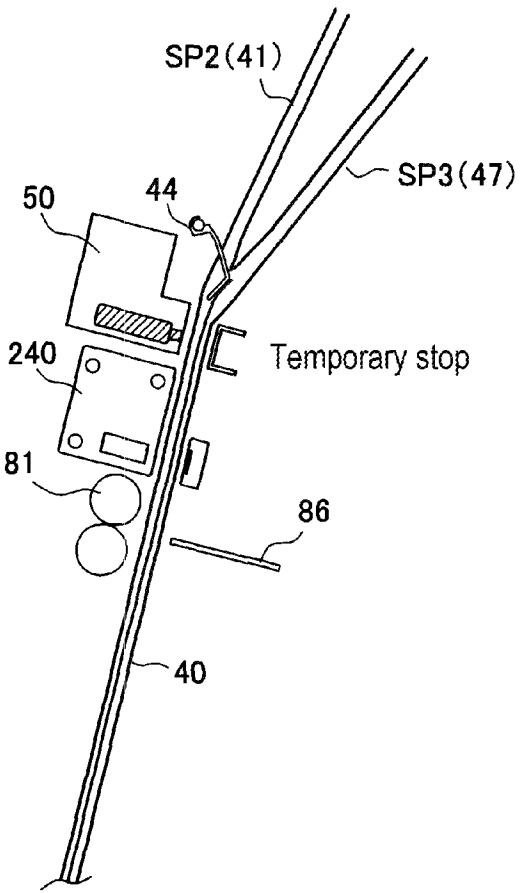

With reference to FIGS. 15A to 15D, the above point will be described more in detail using the bound sheet bundle. The staple-bound sheet bundle illustrated in FIGS. 15A and 15B is subjected to the folding processing at the high speed (VH); on the other hand, the adhesive-bound sheet bundle illustrated in FIGS. 16A and 16B is subjected to the folding processing at the low speed (VL). That is, in a case of the staple-binding, the staples are driven into the sheet bundle to fix the sheets to one another, so that the sheet bundles are bound comparatively strongly and can thereby be folded without displacement. On the other hand, in a case of the sheet bundle bound by means of the adhesive or a tape paste, as illustrated in FIGS. 15C and 15D, a folding area of the sheets on the folding roller side (front cover side) becomes longer upon folding, so that the adhesive on the front cover side is extended. Thus, when the folding operation is performed at high speed like the folding operation for the staple-bound sheet bundle, the adhesive may be peeled off or break or wrinkles of the sheet may be generated. To prevent this, the folding processing for the adhesive-bound sheet bundle is performed at low speed in the present invention.

Referring back to FIG. 2, a sheet transfer path (hereinafter, referred to merely as "transfer path") for guiding the sheet bundle folded in a booklet form to the second sheet discharge tray 22 for storage is provided downstream of the folding roller 81, and the sheet bundle folded in two into a booklet by the folding roller 81 is carried out to the second sheet discharge tray 22 by the bundle discharge roller 95 provided at an exit of the transfer path and having the bundle kick-out piece. The carried-out sheet bundle is stored orderly on the second sheet discharge tray 22 by the bundle press guide 96 and the bundle presser 97 for preventing opening of the folded sheet bundle.

Next, with reference to FIGS. 16A to 16C to FIGS. 18A to 18C, an adhesive-bound sheet bundle generation operation will be described, taking an example in which the adhesive-binding unit 50 in the stacker section 40 is used to apply the adhesive onto three sheets conveyed from the image forming device A. Further, with reference to FIGS. 19A to 19C to FIGS. 21A to 21C, a staple-binding operation will be described, taking an example in which the staple-binding unit 240 that performs saddle stitching is used to staple three sheets.

[Adhesive-Bound Sheet Bundle Generation Operation]

First, a state where the sheets are bonded to one another by an adhesive to generate a sheet bundle will be described. In the image forming device, the "adhesive-bound sheet bundle folding mode" is specified. In the "adhesive-bound sheet bundle folding mode", the sheets discharged from the main body discharge port 3 are bonded to one another to form a sheet bundle, and the sheet bundle is folded in a booklet form and stored on the second sheet discharge tray 22.

FIG. 16A is a view illustrating a state where a first sheet fed from the image forming device A along the sheet carry-in path P1 is passed through the second switchback path SP2 and carried in the stacker section 40 along the carry-in path 41. The stopper section 90 may be in a stand-by state at the Sh1 in FIG. 2 or may descend toward the Sh1 while pulling the sheet as illustrated.

As illustrated in FIG. 16B, when a rear end of the sheet reaches the branching position between the carry-in path 41 and the retreat path 47 constituting the third switchback path SP3, the sheet is once stopped. The sheet rear end is biased to the retreat path 47 side by the deflection guide 44 provided at the branching position.

Figure 16C:
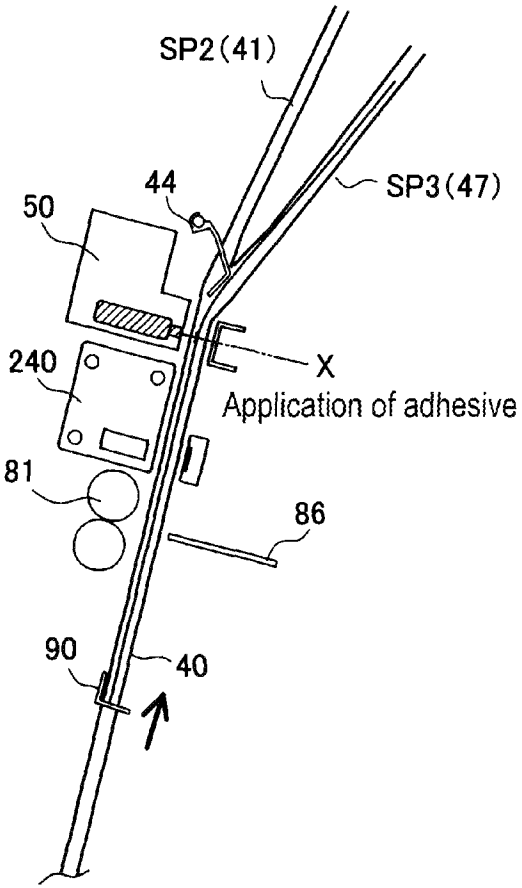

Then, as illustrated in FIG. 16C, when the stopper section 90 is moved up, the sheet rear end side is moved along the retreat path 47. When a half position of the sheet in the sheet conveying direction is situated below the adhesive-binding unit 50, the sheet is once stopped, and the adhesive tape stampers 51 are pushed against the sheet to apply the adhesive. The reason for applying the adhesive during move-up of the sheet is that when the adhesive is applied on ahead during move-down of the sheet, the sheet is conveyed with the adhesive applied thereon. When the adhesive is applied during move-up of the sheet, the sheet is immediately moved to the application retreat position, thereby preventing the adhesive from being adhered to an unnecessary portion.

Figure 17A:
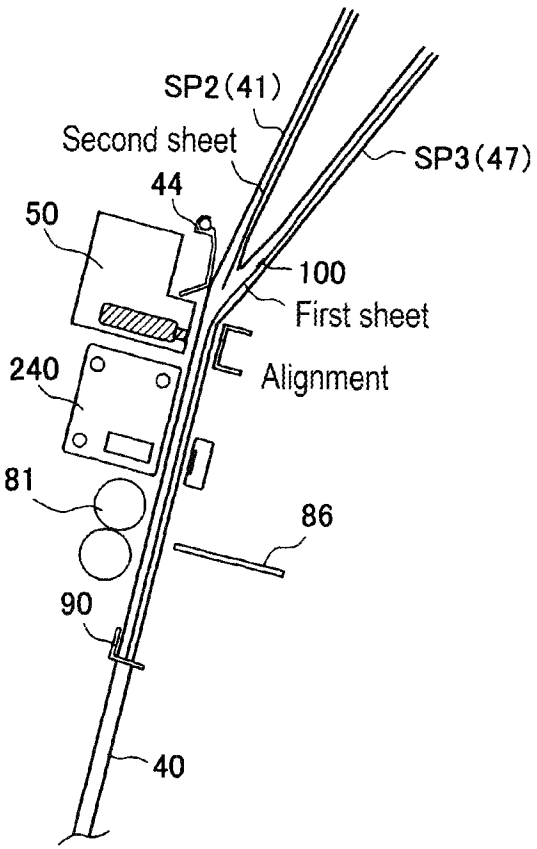

In FIG. 17A, in order for a second sheet to be carried in the carry-in path 41, the application position of the first sheet is retreated to the retreat path 47. As a result, it is possible to carry the second sheet into the stacker section 40 while preventing a leading end of the second sheet from contacting the adhesive-applied position of the first sheet. In a state where the first and second sheets are overlapped with each other, they are aligned by means of the aligning member 48 for arrangement before bonding.

Figure 17B:
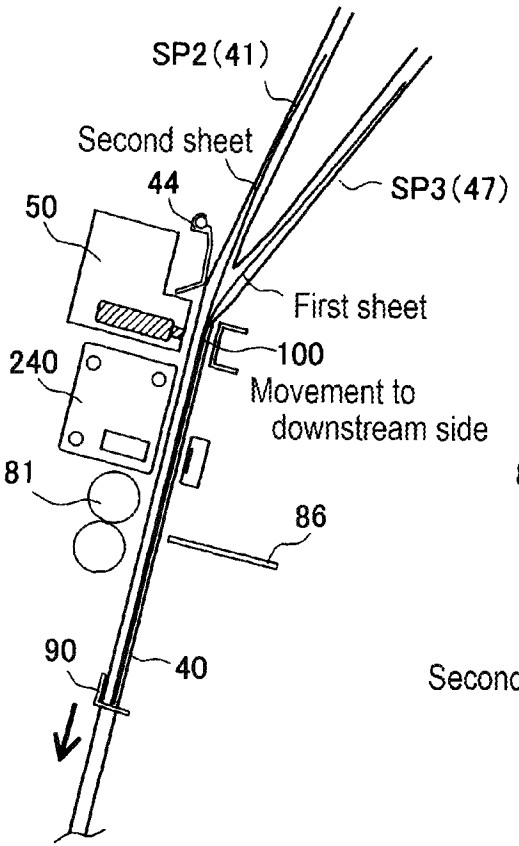

In FIG. 17B, in a state where the stopper section 90 and the pressure roller 49 are pressed against the first and second sheets at a position where the application position of the first sheet is overlapped with a half position of the second sheet, the stopper section 90 is moved downstream to carry the first and second sheets in the stacker section 40.

Figure 17C:
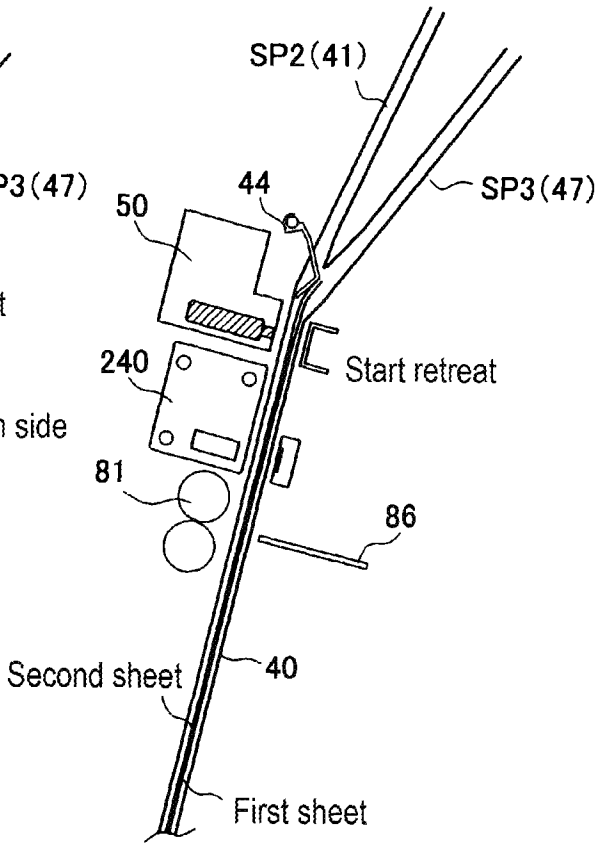

In FIG. 17C, the stopper section 90 is temporarily stopped at a position where rear ends of the two overlapped sheets pass through the branching position. When the stopper section 90 is moved up in this state, the two overlapped is switchback-conveyed (retreated) in the retreat path 47 of the third switchback path SP3 since the rear ends thereof are biased by the deflection guide 44. This operation is the same as that illustrated in FIG. 16B. Thereafter, the tape stampers 51 are pressed against the half position of the sheet to apply the adhesive.

When the sheet is switchback-conveyed, the pressure roller 49 is separated from the sheet.

Figure 18A:
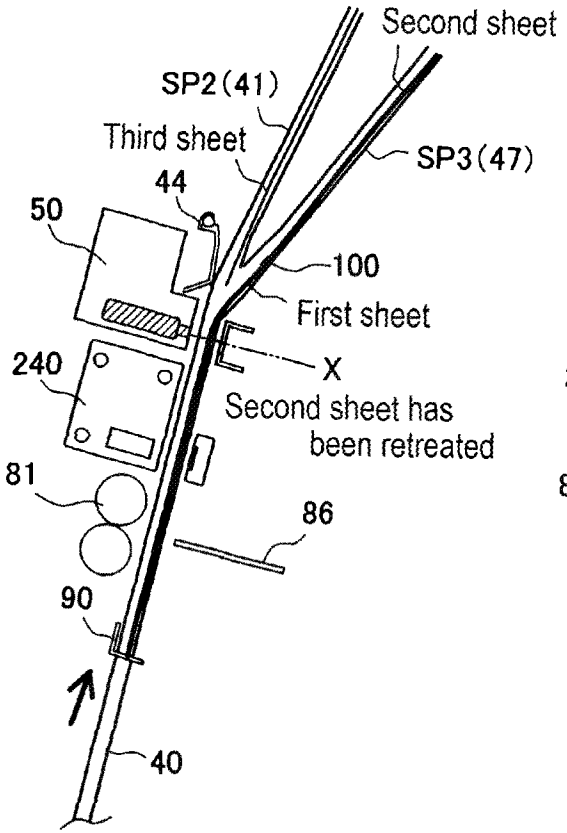
Figure 18B:
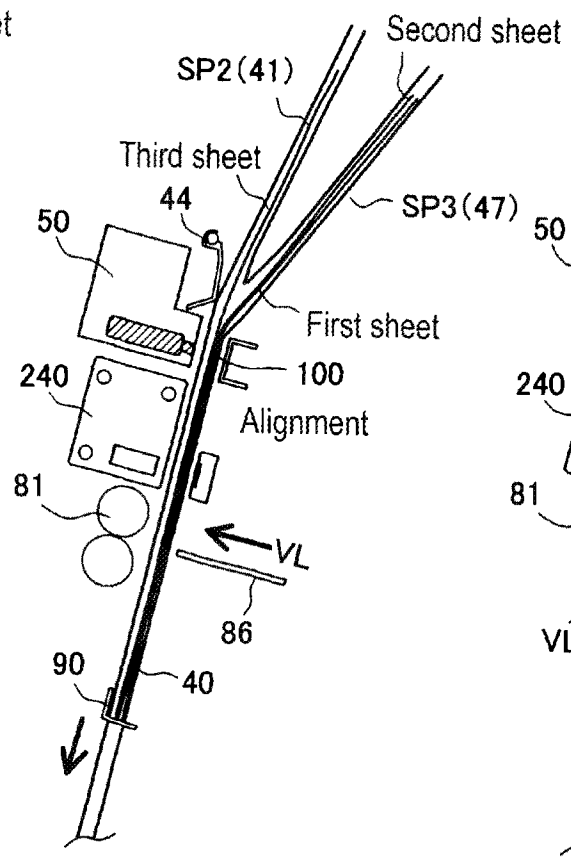
Figure 18C:
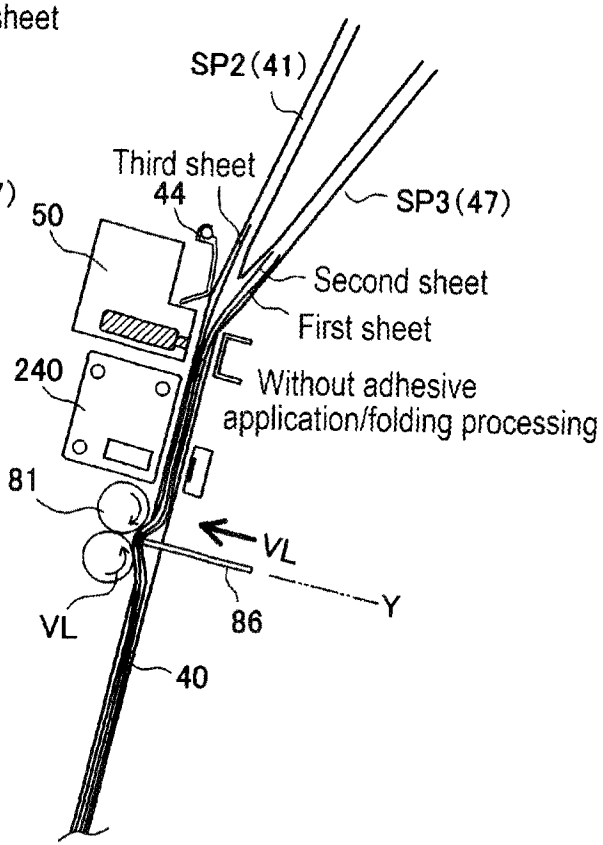

In FIG. 18A, in order for a third sheet to be carried in the carry-in path, the adhesive-applied position of the second sheet is retreated to the retreat path 47. This state is the same as that illustrated in FIG. 17A. Thus, when the third sheet is carried in the stacker section 40, the leading end of the third sheet has no possibility of being caught by the adhesive portion of the second sheet. In FIG. 18B, the three sheets are aligned in a state where a half position of the third sheet is overlapped with the adhesive position of the first and second sheets and moved downstream by the stopper section 90. In FIG. 18C, since the third sheet is the last sheet, it is not subjected to adhesive application by the adhesive-binding unit 50 but pressed by the sheet presser 65 and the pressure roller 49 after being lowered. Then, the third sheet is bonded to the second sheet by the pressing to form the sheet bundle of the first to third sheets, and the half position of the sheet bundle is moved to a position corresponding to the folding roller 81 and the folding blade 86 (folding mechanism section 80). The folding speed (folding speed VL) for this adhesive-bound sheet bundle is lower than the folding speed for a staple-bound sheet bundle. Then, the sheet bundle is pushed into the folding roller 81 by the folding blade 86 for folding, and a booklet obtained through bonding and folding is stored on the second sheet discharge tray.

As described above, when the sheets are bonded by the adhesive-binding unit, the preceding sheet that has been applied with the adhesive is temporarily retreated to the retreat path 47 for each bonding operation to isolate the application position from the leading end of the next sheet. This prevents the adhesive on the preceding sheet from being adhered to an unintended position such as the leading end of the next sheet, whereby a bonded booklet with an excellent finished state can be generated. Further, the adhesive-bound sheet bundle is folded at a comparatively low speed VL (in the present embodiment, the rotation speed of the folding roller is 100 mm/sec, and the moving speed of the folding blade is 130 mm/sec) so that the adhesive on the sheets follows a shape of the folded part well. As a result, peeling-off of the adhesive or break of the sheet upon folding processing can be suppressed.

[Staple-Binding Operation]

The following describes, with reference to FIG. 19A to C to FIGS. 20A to 20C, a state where the staple-binding unit is used to bind three sheets at a center thereof in the sheet conveying direction by means of binding needles such as metal staples to generate a sheet bundle. In this case, in the image forming device, "staple-bound sheet bundle folding mode" in which the sheets from the main body discharge port 3 is aligned in a bundle, saddle-stitched by means of staples, folded into a booklet form, and stored on the second sheet discharge tray 22 is specified.

Figure 19A:
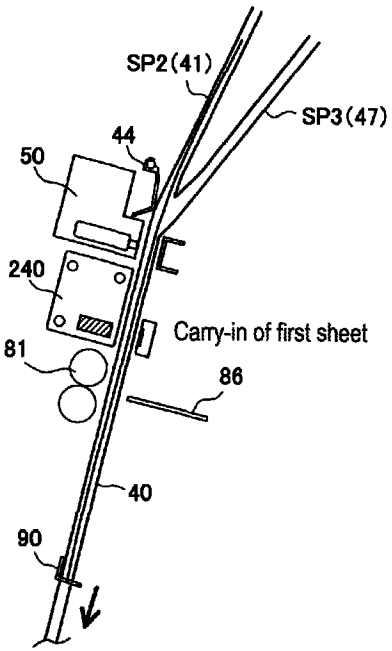

FIG. 19A is a view illustrating a state where a first sheet fed from the image forming device A along the sheet carry-in path P1 is passed through the second switchback path SP2 and carried in the stacker section 40 along the carry-in path 41. The stopper section 90 may be in a stand-by state at the Sh1 in FIG. 2 or may descend toward the Sh1 while pulling the sheet as illustrated.

Figure 19B:
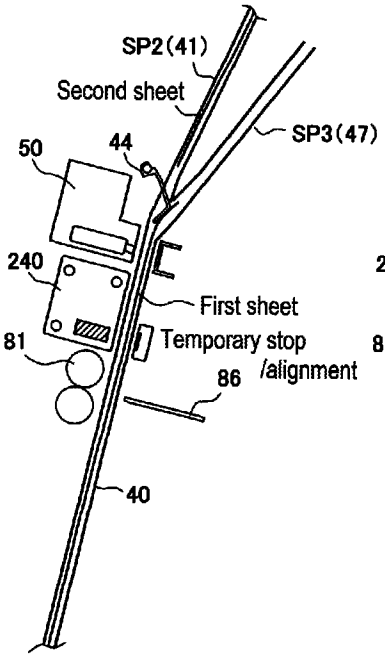

As illustrated in FIG. 19B, when a rear end of the sheet reaches the branching position between the carry-in path 41 and the retreat path 47 constituting the third switchback path SP3, the sheet is once stopped. The sheet rear end is biased to the retreat path 47 side by the deflection guide 44 provided at the branching position. After completion of the carry-in operation, sheet alignment is performed by the aligning member 48.

Figure 19C:
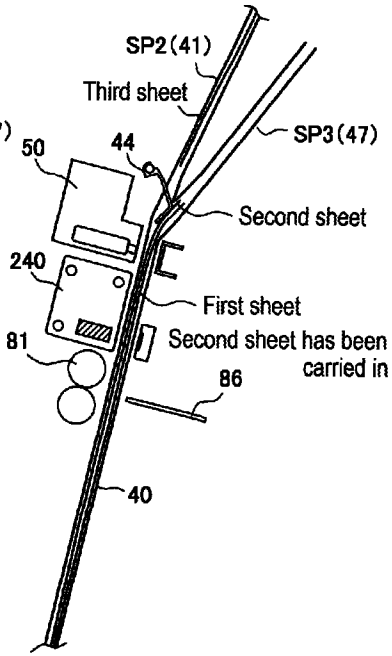

FIG. 19C illustrates a state where a second sheet is carried in with the first sheet biased toward the retreat path 47 side. In this state, a rear end of the second sheet is also biased toward the retreat path 47 side by the deflection guide 44. In this case, after completion of the carry-in operation, sheet alignment is performed by the aligning member 48.

Figure 20A:
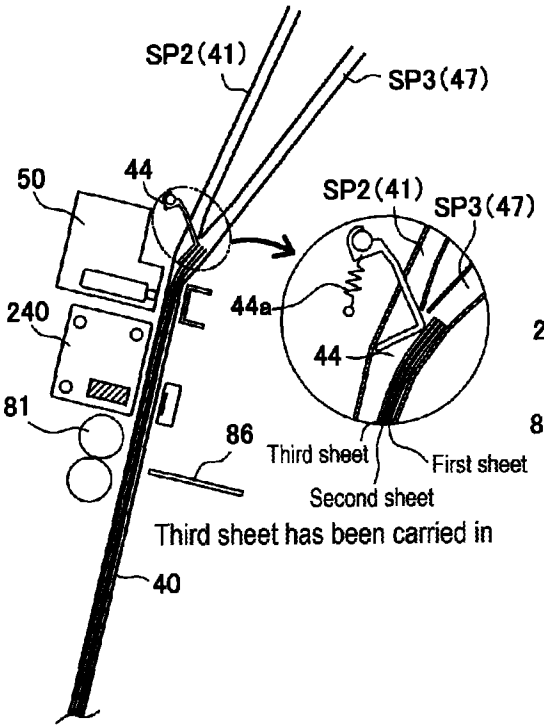

In FIG. 20A, a third sheet has been carried in the stacker section 40, and a rear end thereof is biased toward the retreat path 47 constituting the third switchback path SP3 by the deflection guide 44. As illustrated in an enlarged view, the sheet rear end is biased toward the retreat path by a bending portion of the deflection guide 44. The biasing can prevent the sheet rear end from closing an exit of the carry-in path 41. This allows the next sheet to be carried in the stacker section 40 without being caught by the rear end of the preceding sheet.

In the present embodiment, the deflection guide 44 is biased toward the retreat path 47 side by the guide tension spring 44*a*; alternatively however, the deflection guide may bias the sheet not by means of the spring but by its own weight. Alternatively, the deflection guide 44 may be connected to a solenoid such that it is moved up/down every time the new sheet is carried in the stacker section 40. Further, in order for the new sheet to be carried in the stacker section 40 more smoothly, the rear end of the preceding sheet situated at the retreat path 47 side may be moved to a deep side of the retreat path 47 such that the surface of the preceding sheet guides the next sheet.

Figure 20B:
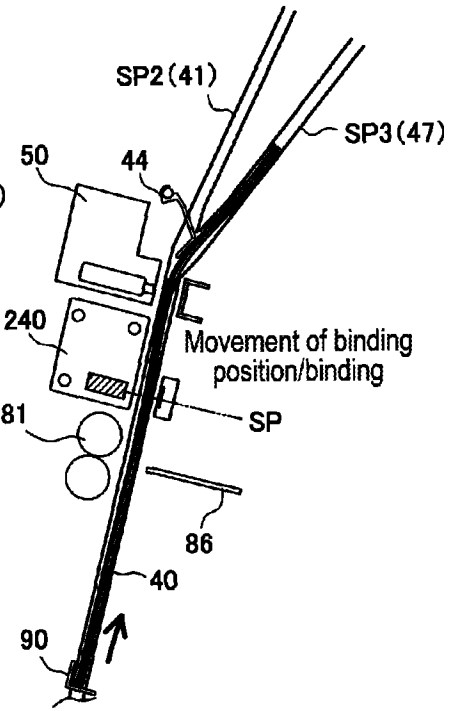

In FIG. 20B, the three sheets have been carried in the stacker section 40, and the sheet alignment is performed by the aligning member 48. Thereafter, the stopper section 90 having the gripper 91 is moved up and stopped at a position where a half position of the sheet in the sheet length direction coincides with the binding position of the staple-binding unit 240. In this case, when the sheet to be carried in is a long sheet, a rear end thereof is moved along the retreat path 47. A moving amount of the sheet to the retreat path 47 when the sheet is bound by the adhesive-binding unit 50 is larger than a moving amount of the sheet to the retreat path 47 when the sheet is bound by the staple-binding unit 240. In other words, since the adhesive-binding unit 50 is disposed closer to the retreat path 47 than the staple-binding unit 240 is to, a length of the retreat path 47 is sufficient for staple-binding operation of the staple-binding unit 240. Thereafter, the staple-binding unit 240 is used to perform the sheet binding by means of the metal staples 239.

Figure 20C:
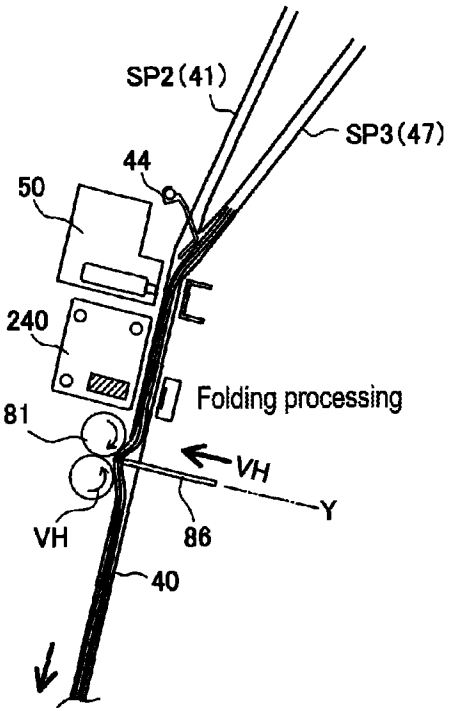

In FIG. 20C, the binding position of the staple-bound sheet bundle is moved to the folding mechanism section 80 (the folding roller 81 and the folding blade 86) disposed downstream of the staple-binding unit 240 for folding processing. The folding roller rotation speed and the folding blade moving speed (in the present embodiment, a rotation speed of the folding roller is 200 mm/sec, and a moving speed of the folding blade is 260 mm/sec) are higher than those in the folding operation for the adhesive-bound sheet bundle. Thereafter, the staple-bound booklet is stored on the second sheet discharge tray.

As described above, in the present embodiment, also when the sheet bundle is staple-bound by the staple-binding unit 240, the sheet rear end is biased toward the retreat path 47 which is used in the adhesive-binding operation of the adhesive-binding unit 50 using the deflection guide 44. Further, for the staple-binding operation, the retreat path which is used for switchback of the sheet in the adhesive-binding operation of the adhesive-binding unit 50 is used as needed.

Thus, the stacker section 40, stopper section, deflection guide 44, and the retreat path 47 are commonly used for staple-binding and adhesive-binding of the sheet bundle by the staple-binding unit 240 and the adhesive-binding unit 50 to simplify the structure of the device and reduce cost.

Further, making the folding speed for the adhesive-bound sheet bundle lower than the folding speed for the staple-bound sheet bundle can suppress peeling-off or deviation of the adhesive or break of the sheet. On the other hand, the folding processing for the staple-bound sheet bundle is performed at high speed, thus preventing productivity of the staple-bound sheet bundle from being degraded.

Hereinafter, folding processing speed setting control will be described using a flowchart of FIG. 21. First, when the "adhesive-bound sheet bundle folding mode" wherein the adhesive is used is set in a "sheet processing mode", the sheet bundle to be folded is determined to be "adhesive-bound sheet bundle" (S01). Here, "adhesive-bound sheet" is set (S02), and the folding speed of the folding roller 81 and the folding blade 86 is set to the low speed VL (in the present embodiment, the rotation speed of the folding roller is 100 mm/sec, and the moving speed of the folding blade is 130 mm/sec) (S03). At a timing when the adhesive-bound sheet bundle reaches the folding position (Y), the folding processing is executed at the low speed VL (S04). When there is a subsequent sheet bundle, the low speed folding processing is repeated (S05). When there is no subsequent sheet bundle, this routine is ended.

When the "staple-bound sheet bundle folding mode" wherein the staples are used to bind the sheet bundle is set in the "sheet processing mode", the sheet bundle to be folded is determined not to be "adhesive-bound sheet bundle" (S01), and the "staple-bound sheet" is set (S10). Accordingly, the folding speed of the folding roller 81 and the folding blade 86 is set to the high speed VH (in the present embodiment, the rotation speed of the folding roller is 200 mm/sec, and the moving speed of the folding blade is 260 mm/sec) (S11). At a timing when the staple-bound sheet bundle reaches the folding position (Y), the folding processing is executed at the high speed VH (S12). When there is a subsequent sheet bundle, the high speed folding processing is repeated (S13). When there is no subsequent sheet bundle, this routine is ended.

Figure 21:
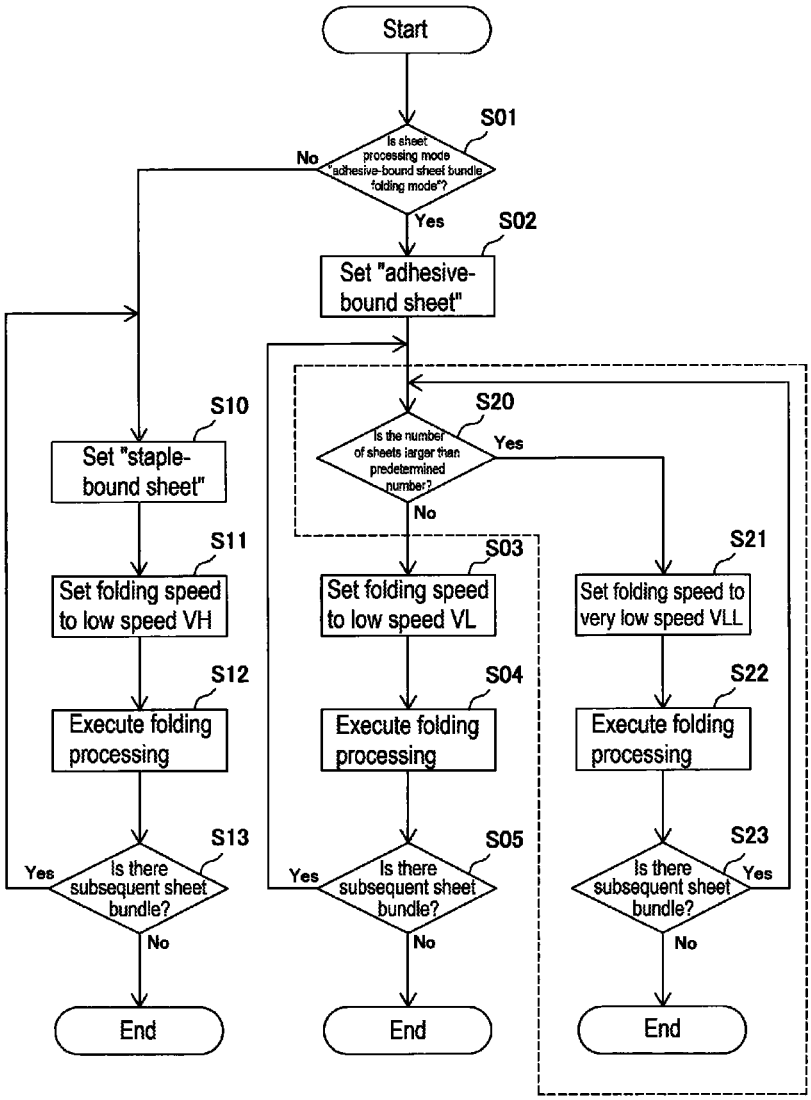
FIG. 21 is a flowchart of sheet bundle folding processing for a staple-bound sheet bundle and an adhesive-bound sheet bundle.

As another embodiment, a flow surrounded by a dashed line of FIG. 21 can be added. After determination of whether or not the sheet processing mode is the "adhesive-bound sheet bundle folding mode" (S01), "whether or not the number of sheets forming the sheet bundle is larger than a predetermined number" is further determined. For example, when the number of sheets forming the sheet bundle is 1 to 10, the flow proceeds to "set folding speed to low speed VL" (03), and the low speed (in the present embodiment, the rotation speed of the folding roller is 100 mm/sec, and the moving speed of the folding blade is 130 mm/sec) is set for folding processing.

When the number of sheets forming the sheet bundle exceeds 10, the folding speed is set to a very low speed VLL (S21). In this case, the folding processing is executed at the very low speed VLL (in the present embodiment, the rotation speed of the folding roller is 70 mm/sec, and the moving speed of the folding blade is 90 mm/sec) (S23). When there is a subsequent sheet bundle, the number of sheets forming the sheet bundle is checked again and, when the number of sheets forming the sheet bundle is 1 to 10, the folding processing is executed at the low speed VL; when the number of sheets forming the sheet bundle exceeds 10, the folding processing is executed at the very low speed VLL.

The number of sheets forming the sheet bundle may be counted as follows. The number of sheets set in the image forming device A may be transmitted from an image forming device controller 180 (to be described later) of the image forming device A to the sheet processing device B. Alternatively, a not illustrated detection sensor provided at the carry-in port of the sheet processing device B may be used to count the number of sheets. Further alternatively, a position of the sheet presser 65 for pressing the adhesive-bound sheet bundle in the adhesive-binding unit 50, that is, a thickness of the adhesive-bound sheet bundle may be detected, followed by conversion of the detected thickness into the number of sheets.

As described above, when the number of sheets to be bound taken into consideration, the sheet bundle formed by a large number of sheets is folded by low speed, so that the folding processing can be performed without loss of the adhesion of the adhesive, especially the adhesive positioned on the folding roller side which may be extended upon the folding operation.

[Control Configuration]

Figure 22:
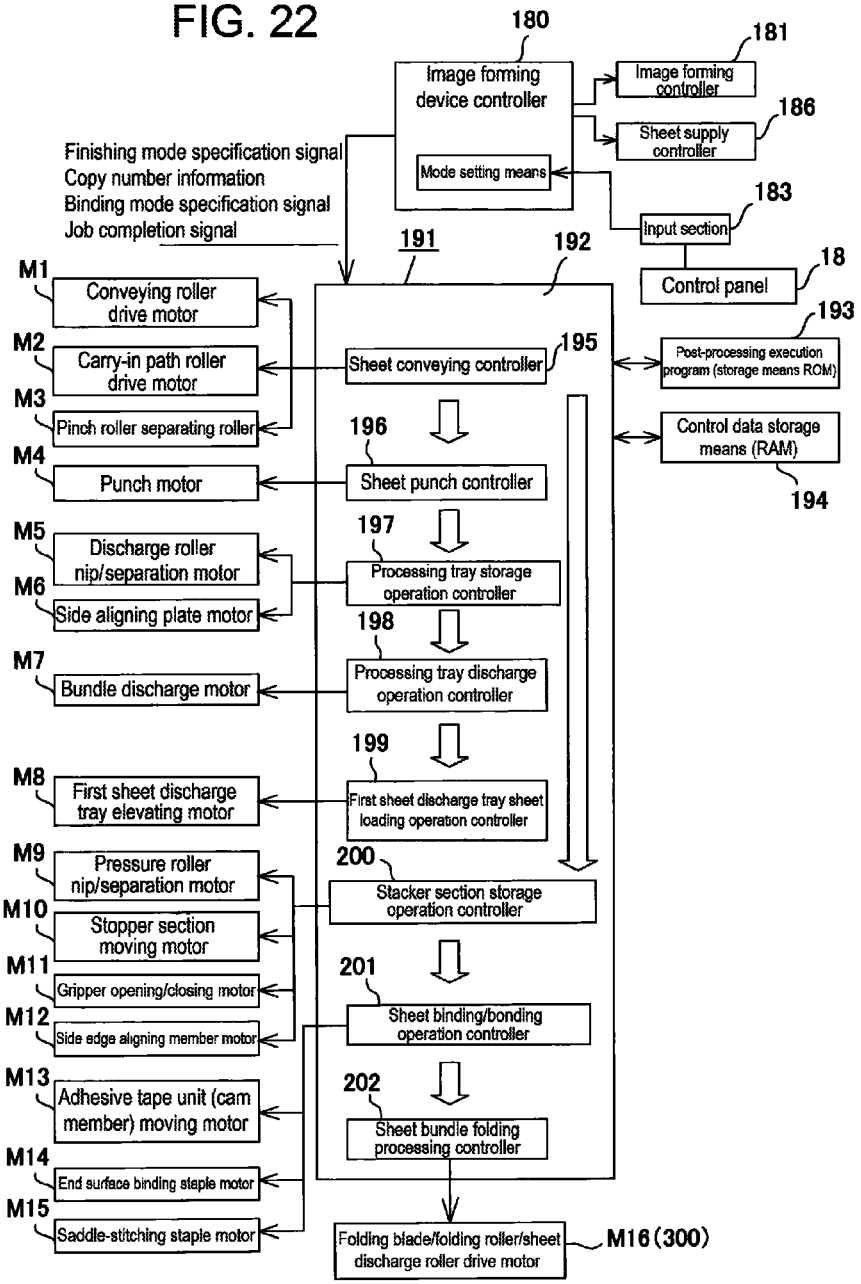
FIG. 22 is an explanatory view of a control configuration of the entire configuration illustrated in FIG. 1.

The following describes a system control configuration of the above-described image forming device with reference to a block diagram of FIG. 22. The system for the image forming device illustrated in FIG. 1 includes an image forming device controller 180 for the image forming device A and a sheet processing controller 191 for the sheet processing device B. The image forming device controller 180 includes an image forming controller 181, a sheet supply controller 186, and an input section 183. A user sets "image forming mode" or "sheet processing mode" through a control panel 18 provided in the input section 183. As described above, in the image forming mode, the image forming conditions such as a print copy count specification, a sheet size specification, a color or black-and-white printing specification, enlarged or reduced printing specification, a single- or double-side printing specification are set. Then, the image forming device controller 180 controls the image forming controller and the sheet supply controller according to the set image forming conditions to form an image onto a predetermined sheet and sequentially carries out the resultant sheet through the main body discharge port 3.

At the same time, the user sets the sheet processing mode through the control panel 18. The sheet processing mode includes, as described above, the "printout mode", the "staple-binding mode", the "adhesive-bound sheet bundle folding mode", and the "staple-bound sheet bundle folding mode". The image forming device controller 180 transfers the set sheet processing mode, the number of sheets, copy number information, and the adhesive-binding mode or the staple-binding mode (binding at one or a plurality of positions, or saddle-stitching) information to the sheet processing controller 191.

The sheet processing controller 191 includes a control CPU 191 that operates the sheet processing device B in accordance with the specified finishing mode, a ROM 193 that stores an operation program, and a RAM 194 that stores control data. The control CPU 192 includes a sheet conveying controller 195 that executes conveyance of the sheet fed to the carry-in port 23, a sheet punch controller 196 that uses a punch unit 28 to perform punch operation for the sheet, a processing tray storage operation controller 197 that uses the processing tray 29 to perform sheet storage operation, a processing tray discharge operation controller 198 that discharges the sheet bundle from the processing tray 29, and a first sheet discharge tray sheet loading operation controller 199 that moves vertically the first sheet discharge tray in accordance with a storage amount of the sheets or sheet bundle discharged from the processing tray 29.

The sheet processing controller 191 further includes a stacker section storage operation controller 200 for controlling bonding and folding operations while storing the sheets in the stacker section 40, a sheet binding/bonding operation controller 201 for instructing a sheet bonding operation, and a sheet bundle folding processing controller 202 for folding the adhesive-bound sheet bundle or staple-bound sheet bundle in two. The sheet binding/bonding operation controller 201 also controls the end surface stapler 35 that binds the sheets stored on the processing tray 29 using a staple, the adhesive-binding unit 50 that bonds the sheets carried in the stacker section 40 to one another, and the staple-binding unit 240 that saddle-stitches the sheets stored in the stacker section 40. Although not illustrated, the above controllers each receive a position signal from a sensor that detects a position of the sheet conveying path or each member.

A connection between the controllers and the motors will be described using FIG. 22. The sheet conveying controller 195 is connected to a control circuit of a drive motor M1 so as to control drive of the carry-in roller 24 and the like that receive the sheet from the image forming device A and conveys it. The sheet conveying controller 195 once switch-back-conveys the sheet to the second switchback path SP2 to put the sheet on standby therein when carrying the sheet in the processing tray 29 and then discharges the sheet together with a next sheet. This is done so as to continue a series of processing without stopping the operation on the image forming device A side. The sheet conveying controller 195 controls the drive motor M2 that can forward/backward rotate the path carry-in roller 45 in the carry-in path 41 so as to enable the switchback conveyance. The sheet conveying controller 195 also controls a separating motor 131 (M3) that separates the pinch roller 125 from the drive roller 120 when sheet alignment is performed with the leading end of the sheet positioned in the stacker section 40 and the rear end thereof positioned in the carry-in path 41.

The sheet punch controller 196 is connected to a control circuit of a punch motor M4 so as to punch a punch hole in the sheet.

The processing tray storage operation controller 197 is connected to a control circuit of a nip/separation motor M5 that nips and separates the sheet discharge roller 25 so as to carry the sheet in the processing tray 29 or first sheet discharge tray 21 or carry out the sheet from the processing tray 29. The processing tray storage operation controller 197 is also connected to a control circuit of a side aligning plate motor M6 that reciprocates the side aligning plate 36 in the sheet width direction so as to align the sheets on the processing tray 29.

The processing tray discharge operation controller 198 is connected to a control circuit of a bundle discharge motor M7 that moves the rear end regulating member 33 toward the sheet discharge port 25*a* so as to discharge, to the first sheet discharge tray, the sheet bundle whose end portion is bound by means of the end surface stapler 35 in the processing tray 29. A control circuit of a first tray elevating motor M8 that elevates the first sheet discharge tray 21 in accordance with an amount of sheets stored therein is connected to the first sheet discharge tray sheet loading operation controller 199 and controlled thereby.

The following describes controllers for applying the adhesive onto the half position of the sheet in the sheet conveying direction to bond the sheets to one another to form the sheet bundle or staple-binding the accumulated sheets to form the sheet bundle and then folding the sheet bundle at the adhesive-applied position or staple-bound position will be described using the drawing.

The stacker section storage operation controller 200 is connected to a control circuit of a pressure roller nip/separation motor 141 (M9) and control the same. The pressure roller nip/separation motor 141 (M9) moves and normally and reversely rotates the pressure roller 49. The pressure roller 49 is positioned around the middle of the stacker section 40 and configured to convey downstream the sheet carried in the stacker section 40 while pressing the sheet. With the drive from the pressure roller nip/separation motor 141 (M9), the pressure roller 49 is moved to a sheet pressing position to convey the sheet or to a separating position separated from the sheet.

The stacker section storage operation controller 200 is further connected to a control circuit of a stopper section 90 moving motor M10 so as to move the stopper section 90 to move the sheet entering the stacker section 40 to the initial home position Sh0, sheet (bundle) rear end branching point passing position Sh1 at which the rear end of the sheet is situated at the branching position between the carry-in path 41 and the retreat path 47, adhesive-bound sheet bundle folding position Sh2 at which the adhesive-bound sheet bundle is folded in two, staple-binding position Sh31 at which the metal staples are driven into a substantially half position of the sheet bundle for binding, adhesive tape transfer position Sh32 at which the adhesive tape AT as an adhesive is applied onto the sheet at a substantially half position, and an adhesive tape concealing position Sh4 to which the preceding sheet is switchback-conveyed so as to prevent the adhesive-applied onto the preceding sheet from being adhered to the next sheet to be carried in the stacker section 40 from the carry-in path 41. The movement of the sheet between the above positions is as described above in detail using FIGS. 16A to 16C to 20A to 20C.

The stacker section storage operation controller 200 is further connected to a control circuit of a gripper opening/closing motor 160 (M11) so as to grip the leading end of the sheet at the leading end of the stopper section and release its gripping. The timing of the gripping operation of the gripper has already been described, so description thereof is omitted. The stacker section storage operation controller 200 is further connected to a control circuit of an aligning motor 117 (M12) that reciprocates, in the sheet width direction, the aligning member 48 that can align even the sheets whose leading ends are positioned at the stacker section 40, while whose rear ends are positioned over the carry-in path 41 and the retreat path 47.

The sheet binding/bonding operation controller 201 is connected to a control circuit of a cam moving motor 60 (M13) that reciprocates the cam member 57 between a position that presses the adhesive tape stampers 51 of the adhesive-binding unit 50 against the sheet to apply the adhesive and a position separated from the sheet. The sheet binding/bonding operation controller 201 is also connected to a control circuit of a saddle-stitching staple motor M15 that saddle-stitches the sheet bundles stored in the stacker section 40 at a center portion thereof by means the metal staples. The sheet binding/bonding operation controller 201 is also connected to an end surface binding staple motor M14 of the processing tray 29.

As already described, the sheet bundle folding processing controller 202 is configured to rotate or reciprocate the folding blade 86, folding rollers 81*a*, 81*b*, and the bundle discharge roller 95 by means of a common motor 300 and is connected to a drive circuit so as to control the drive motor 300 (M16). Further, as already described, the drive motor 300 (M16) is controlled so as to be driven at the low speed VL in the "adhesive-bound sheet bundle folding mode" and at the high speed VH in the "staple-bound sheet bundle folding mode".

The controllers configured as described above control the sheet processing device to execute the following operation modes: the printout mode; the staple-binding mode; the adhesive-bound sheet bundle folding mode; and the staple-bound sheet bundle folding mode. The operations in the respective modes have already been described, so description thereof will be omitted here. In particular, the adhesive-bound sheet bundle folding mode has been described in detail based on FIGS. 16A to 16C to FIGS. 18A to 18C, and the staple-bound sheet bundle folding mode has been described in detail based on FIGS. 19A to 19C and FIGS. 20A to 20C.

Further, the control to drive the drive motor 300 (M16) at a low speed in the "adhesive-bound sheet bundle folding mode" and to drive the drive motor 300 (M16) at a high speed in the "staple-bound sheet bundle folding mode" has been described in detail based on the flowchart of FIG. 21.

[Modification of Folding Drive Path]

Figure 23:
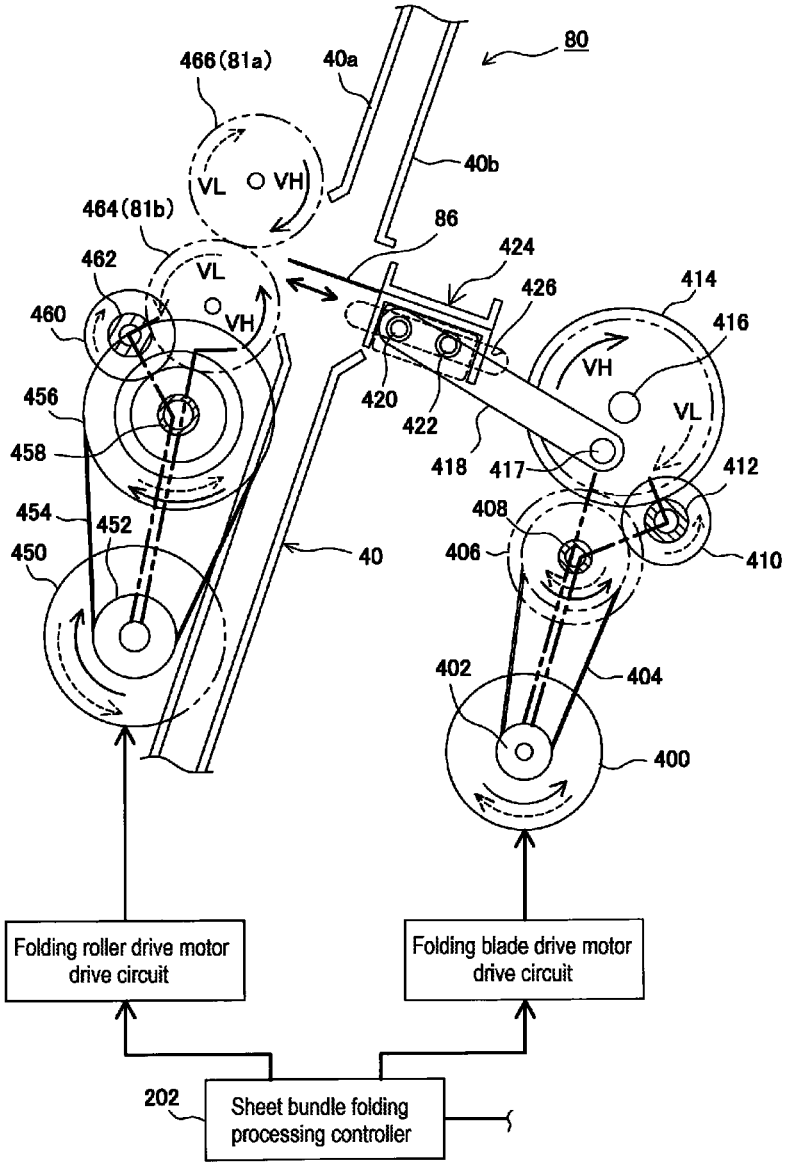
FIG. 23 is an explanatory view of a modification of a drive path in the folding mechanism section illustrated in FIG. 11.
Figure 24:
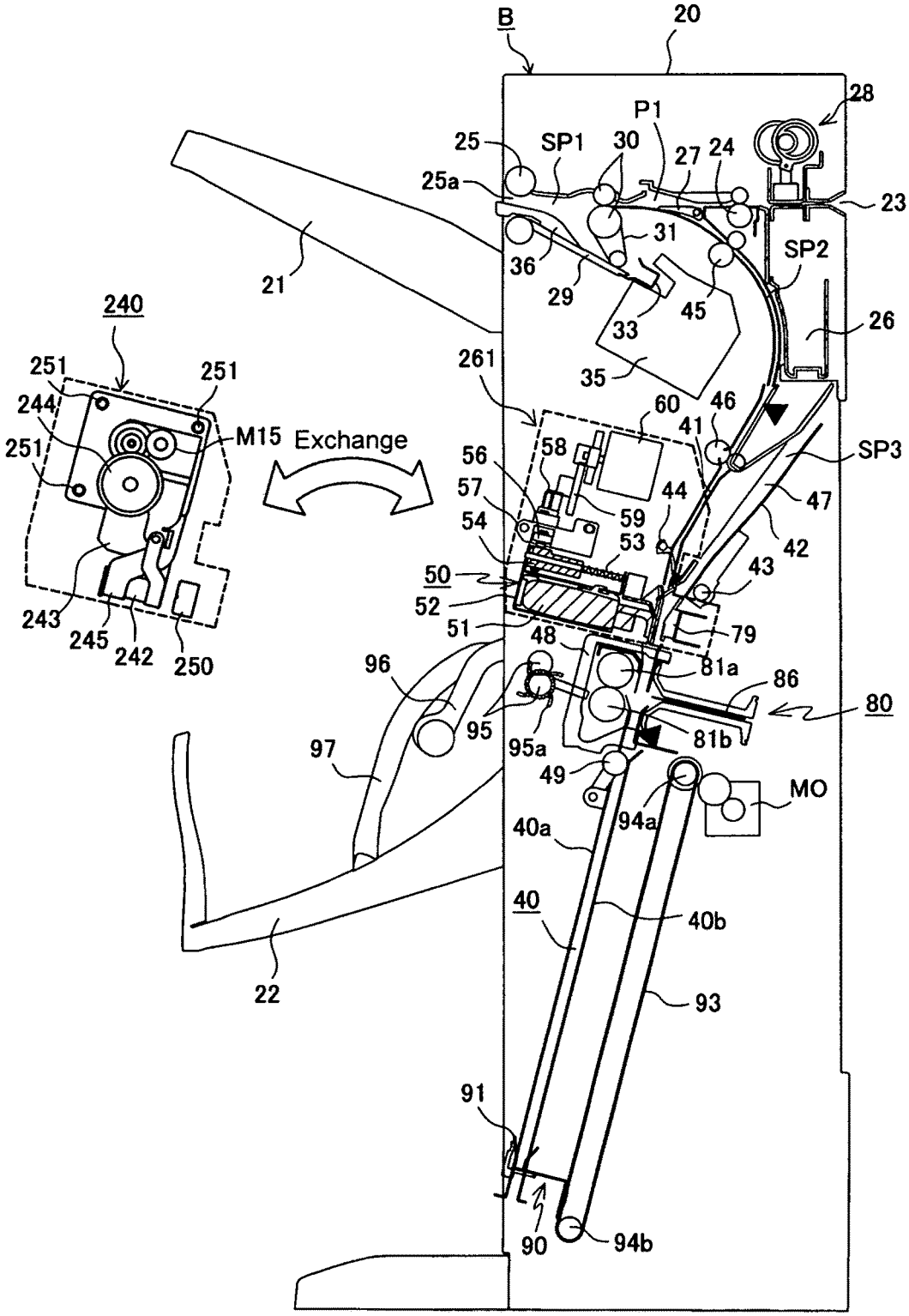
FIG. 24 is an explanatory view of a modification in which the staple-binding unit and the adhesive-binding unit are not juxtaposed but can be selectively attached.

In the embodiment described above, as illustrated in detail in FIGS. 11 and 12, a single folding drive motor 300 (M16) is used to drive rotation of the folding roller 81 and reciprocation of the folding blade, and a supply current to the folding drive motor 300 is controlled to change the rotation speed of the folding roller 81 and the moving speed of the folding blade 86. Alternatively, as illustrated in FIG. 23, the rotation drive of the folding roller 81 and the moving drive of the folding blade 86 may be separated. In this configuration, the rotation directions of the respective drive motors are switched between the normal/reverse directions to switch a drive transmission path for speed change or torque change.

That is, in FIG. 23, a folding blade drive motor 400 for reciprocating the folding blade 86 and a folding roller drive motor 450 for driving the folding roller 81 are disposed at the front and rear of the stacker section 40.

Drive of the folding blade drive motor 400 is transmitted to a blade selection gear 406 by a transmission belt 404 wound around an output pulley 402. A drive transmission path is switched (between a long dashed short dashed arrow route and a long dashed double-short dashed arrow route) depending on a rotation direction of the blade selection gear 406. Then, a blade moving gear 414 receives the drive from one of the two paths to be rotated about a moving gear rotary shaft 416.

The blade moving gear 414 is connected to a moving lever 418 whose one end is fixed to the blade moving gear 414 and other end is connected to a blade unit 424 supporting the folding blade 86. In the blade unit 424, a connection pin 420 and a guide pin 422 can be slid along a frame guide groove 426 formed in a not illustrated frame. Thus, when the blade moving gear is rotated in illustrated arrow directions (continuous arrow direction/dashed arrow direction), the folding blade 86 is reciprocated between an insertion position into the folding roller 81 and a stand-by (home) position separated from the folding roller 81.

The moving speed of the folding blade 86 changes depending on the rotation direction of the blade drive motor 400. When the folding blade drive motor 400 is rotated in the continuous arrow direction, the blade moving gear 414 receives the drive directly from the blade selection gear 406 to be moved at a high speed. On the other hand, when the folding blade drive motor 400 is rotated in the illustrated dashed arrow direction, the drive is transmitted from the blade selection gear 406 to the blade moving gear 414 not directly but through a deceleration gear 410. That is, the drive is transmitted with deceleration, with the result that the folding blade is reciprocated at a low speed.

Similarly, the folding roller drive motor 450 illustrated in FIG. 23 has substantially the same two (continuous line/dashed line) drive systems. That is, drive from an output pulley 452 is transmitted to a folding roller selection gear 456 through a transmission belt 454 so as to allow the folding roller selection gear 456 to be rotated normally or reversely. When the folding roller drive motor 450 is rotated in the illustrated continuous arrow direction, the folding roller 81*b* drive gear receives the drive directly from the folding roller selection gear 456 to be rotated at the high speed VH. On the other hand, when the folding roller drive motor 450 is rotated in the illustrated dashed arrow direction, the drive is transmitted from the folding roller selection gear 456 to the folding roller 81*b* drive gear not directly but through a deceleration gear one-way clutch, with the result that the folding roller 81*b* drive gear is rotated at the low speed VL. The above switching of the drive direction is made by the folding roller selection gear 456 and the one-direction drive transmission mechanism of the deceleration gear one-way clutch 462 which is driven by rotation of the folding roller selection gear 456 in one direction.

With the above configuration, in the modification illustrated in FIG. 23, by selecting the rotation directions of the respective folding blade drive motor 400 and the folding roller drive motor 450, the folding roller and the folding blade 86 can be driven at a low speed (in the present embodiment, the rotation speed of the folding roller is 100 mm/sec, and the moving speed of the folding blade is 130 mm/sec) in the folding processing for the adhesive-bound sheet bundle, and the folding roller 81 and the folding blade 86 can be driven at a high speed (in the present embodiment, the rotation speed of the folding roller is 200 mm/sec, and the moving speed of the folding blade is 260 mm/sec) in the folding processing for the staple-bound sheet bundle. Further, in this case, a torque is not reduced in the low-speed folding operation, whereby the sheet bundle can be folded reliably.

[Modification of Binding Unit Arrangement]

In the embodiment described above, particularly as illustrated in FIGS. 2 and 3, the adhesive-binding unit 50 that binds the sheets by means of an adhesive and the staple-binding unit 240 that binds the sheets by means of staples are arranged in this order from the upstream side of the stacker section 40 as the second processing tray. With this arrangement, the adhesive-binding can be done with a comparatively short movement of the adhesive-applied position. However, the adhesive-binding unit 50 may be disposed downstream of the staple-binding unit 240.

Further, a configuration may be possible, in which the adhesive-binding unit 50 and the staple-binding unit 240 are not juxtaposed. That is, a unit housing 261 replaceably housing the adhesive-binding unit 50 and the staple-binding unit 240 is provided in the casing 20 of the sheet processing device B, as illustrated. In this case, a not illustrated attachment detection sensor is used to detect which one of the binding units 50 and 240 is currently attached. When the adhesive-binding unit 50 is attached, the folding processing is performed at a comparatively low speed, and when the staple-binding unit 240 is attached, the folding processing is performed at a comparatively high speed.

[Transfer of Adhesive by Adhesive Tape Stamper]

Figure 25A:
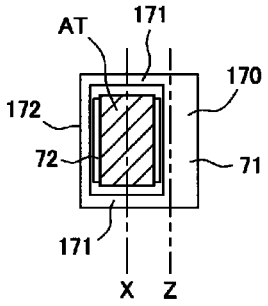

The following describes, with reference to FIGS. 25A to 25D and FIGS. 26A to 26C, the adhesive application (transfer) position by the adhesive tape stamper 51 described in FIGS. 5A to 5C to FIGS. 7A to 7C. FIG. 25A is a bottom view of the adhesive tape stamper 51. As illustrated in FIG. 25A, the adhesive tape stamper 51 includes a pressing portion 170 having a substantially quadrangular shape and configured to press a comparatively wide area of the sheet, a side pressing portion 171 extending from both sides of the pressing portion 170, and a leading end pressing portion 172 connecting leading sides of the side pressing portions 171. Inside the above pressing portions, the transfer head 72 supporting the adhesive tape AT is positioned. A symbol X in the drawing denotes a center position of the adhesive tape AT, and the adhesive of the adhesive tape is applied onto the sheet with the position X as a center. A symbol Z denotes a sheet pressing position at which the adhesive-applied positions of the sheets preceding a last sheet to be described later are subjected to pressing.

Figure 25B:
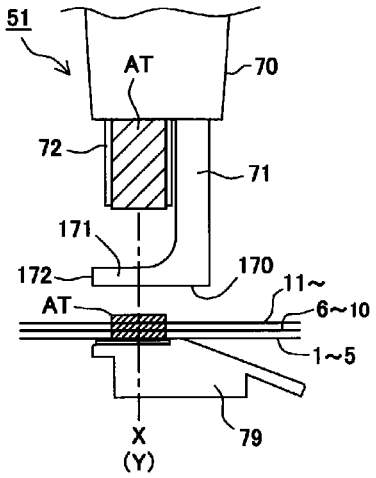

FIG. 25B is a cross-sectional side view of the adhesive tape stamper 51, explaining that the adhesives are transferred with the same length. FIG. 25B illustrates a state where the adhesive tape AT is applied onto a newly conveyed and positioned sheet. For descriptive convenience, the sheets are illustrated every five sheets. Further, in FIG. 25B, for all 11 sheets, the adhesive is applied across the folding position Y. As already described, first the paper sheets are pressed against the platen by the sheet pressing slider 71. Then, with the movement of the sheet pressing slider 71, a new adhesive surface of the adhesive tape AT is exposed, and the transfer head 72 is pressed against the sheet on the platen 79. As a result, the adhesive of the adhesive tape AT is applied onto a new sheet, and preceding first to 10th sheets and the new 11th sheet are bonded to one another at the adhesive-applied position. After completion of the adhesive application and the sheet bonding, the transfer head 72 and the sheet pressing slider 71 are separated from the sheet as illustrated.

The above adhesive application and sheet bonding are repeated up to carry-in of the next-to-last sheet. The adhesive application and sheet bonding are performed for each carry-in of the paper sheet, and the carried-in paper sheets are bound together.

Figure 25C:
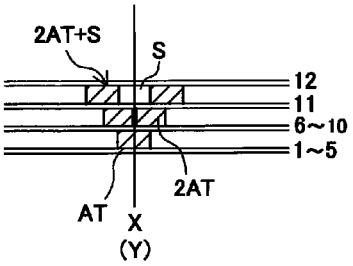

In FIG. 25C, the adhesive of the adhesive tape AT is applied onto the first to fifth sheets at the folding position Y, and the adhesive application different from that for the first to fifth sheets is performed for the sixth and subsequent sheets. That is, for sixth to 10th sheets, the adhesive is applied at two positions slightly separated from each other (very close to each other) in the sheet conveying direction across the folding position. As a result, the adhesive-applied position becomes wider in the sixth to 11th sheets which are the outside sheets in the sheet folded state, so that even when the resultant sheet bundle is folded at the folding position Y, peeling-off the adhesive is prevented. Further, for the 11th sheet, the adhesive is applied at two positions further separated from each other across the folding position Y. When the adhesive tape AT is applied at two positions as described above, the adhesive is not applied in a solid manner between the 11th and 12th sheets, so that the sheets are easily folded, and the adhesive is comparatively unlikely to be peeled-off. Further, an amount of the adhesive to be used can be reduced.

Figure 26A:
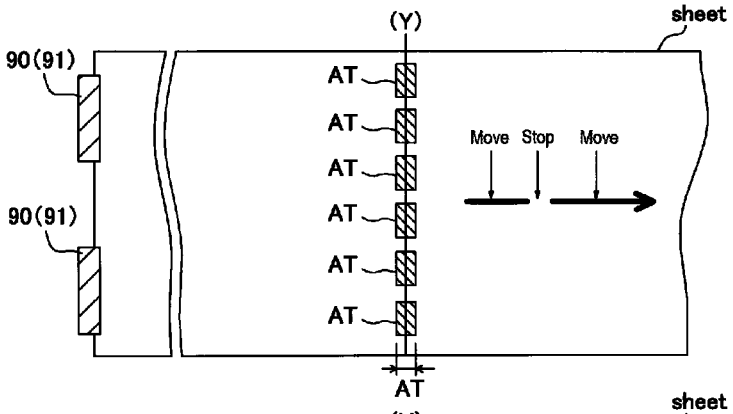
Figure 26B:
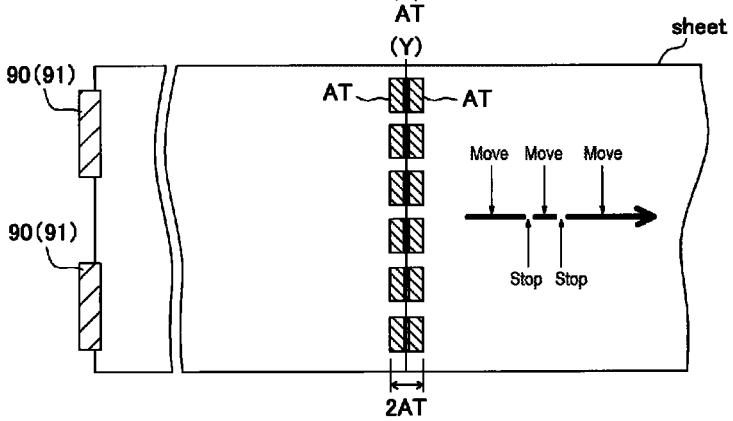
Figure 26C:
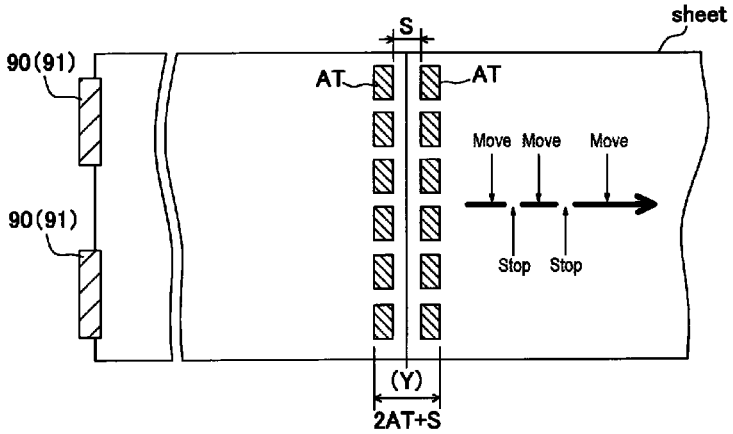

An application method of the adhesive of the adhesive tape AT performed in FIG. 25C will be described using FIGS. 26A to 26C. FIGS. 26A to 26C illustrate the gripper 91 and the stopper section 90 of the stacker section 40 illustrated in FIG. 2, in which the adhesive portion of the adhesive tape AT is represented in a sheet-like shape (AT) for descriptive convenience. As described above, in order for the adhesive of the adhesive tape AT to be applied onto the sheet, the transfer head 72 of the adhesive tape stamper 51 is pressed against the sheet. Thus, it is possible to adjust the application position of the adhesive by moving the sheet by means of the stopper section 90.

In FIG. 26A, for first to fifth sheets, the adhesive is applied across the folding position of the sheet. In this case, the sheet is moved to the right in the drawing (upward in the stacker section). Then, movement of the stopper section 90 is temporarily stopped when the folding position reaches just below the transfer head 72, and the transfer head 72 is pressed against the sheet. More specifically, as to the movement of the sheet, at a timing when the rear end of the sheet carried in the stopper section 90 passes through a merging position between the carry-in path 41 and the retreat path 47, the sheet is switchback-conveyed toward the retreat path 47 side. This movement is denoted by a right arrow in the drawing. Thereafter, when the folding position Y of the sheet coincides with the bonding position X, the movement of the sheet is stopped, and the transfer head 72 of the adhesive tape stamper 51 is pressed against the sheet to transfer the adhesive tape AT onto the sheet. The transferred six adhesive tapes are each represented as "AT" in FIG. 26A. Then, in order for the transferred adhesive tape AT position to be moved to the retreat path 47, the sheet is moved to the right by the stopper section 90. In the present embodiment, the above operation is performed for the first to fifth sheets. The resultant state is denoted by "1 to 5" in FIG. 25C.

FIG. 26B illustrates the transfer position of the adhesive tape AT for sixth to 10th sheets. In this case, in the process of movement of the rear end side of the sheet toward the retreat path 47 side, the movement of the sheet is stopped slightly before the folding position Y, and the adhesive tape AT is transferred. Thereafter, the sheet is slightly moved and then stopped for transfer of the adhesive tape AT. The transferred two adhesive tapes AT are very close to each other (2AT) across the folding position Y. The resultant state is denoted by "6 to 10" in FIG. 25C. When the sheet bundle is folded in this state, the sheets forming the sheet bundle are bonded to one another in a wider area by the adhesive tape AT serving as an adhesive between the sheets.

FIG. 26C illustrates the transfer position of the adhesive tape AT for an 11th sheet. The adhesive tape AT is applied at two positions spaced apart from each other across the folding position in the sheet conveying direction. In this case, in the process of movement of the rear end side of the sheet toward the retreat path 47 side, the movement of the sheet is stopped before the folding position Y (at a position more distant from the folding position Y than in FIG. 26B), and the adhesive tape AT is transferred. Thereafter, the sheet is moved to be spaced apart from the previously transferred first adhesive tape AT by a predetermined interval (S) and then stopped for transfer of the second adhesive tape AT. The transferred two adhesive tapes AT are spaced apart from each other (2AT) by the interval (S) across the folding position Y (a state of "2AT+S"). The state of "2AT+S" is denoted by "11" in FIG. 25C. To fold the sheet bundle at the folding position Y in this state is to fold the interval position between the two adhesive tapes AT, so that the sheet bundle is more easily folded and an amount of the adhesive to be used is more reduced than in the case where the adhesive is applied in a solid manner. In addition, since the sheets are bonded to one another at two positions in the sheet conveying direction, suppressing peeling-off of the bonded sheets forming a booklet from one another.

Figure 25D:
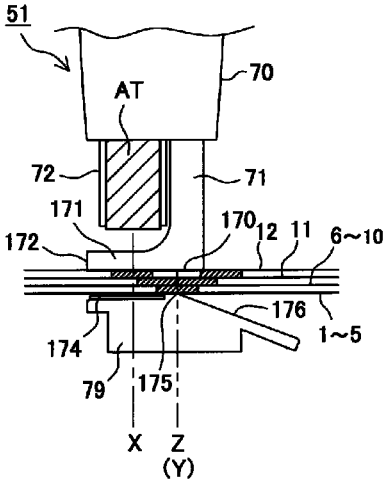

Here, a state where a 12th sheet is bonded to the 11th sheet will be described using FIG. 25D. The adhesive is not applied onto the 12th sheet, so that, as illustrated, the pressing portion 170 of the sheet pressing slider 71 is pressed against a last sheet pressing portion of the platen 79. In FIG. 25D, a sheet pressing position (Z) is set as a position to be pressed without adhesive by the pressing portion 170. With this pressing, the 12th sheet is reliably bonded to the 11th sheet. Further, by moving the pressing portion in a pressing state, adhesion between the 12 sheets is further strengthened.

The platen 79 includes a platen guide portion 176 for guiding conveyance of the sheet from the upstream side, a last sheet pressing portion 175, and a platen cushioning portion 174 positioned facing the transfer head 72 and applied with a slightly elastic sheet for backup of the adhesive application and sheet bonding. With this configuration, the sheets are reliably bonded to one another.

[Folding Operation]

The following describes an operation of folding, by the folding mechanism section illustrated in FIGS. 11 and 12, the sheet bundle obtained by bonding the sheets by means of the adhesive of the adhesive tape AT. The folding operation for a sheet bundle formed by a small number of sheets has been described in FIGS. 14A to 14D and is thus omitted here. Here, the folding operation for a sheet bundle formed by a large number of sheets (that is, for a sheet bundle that has been subjected to the processing as illustrated in FIG. 26C will be described using FIGS. 27A to 27D.

[Folding Processing for Bonded Sheet Bundle Formed by Large Number of Sheets]

Figure 27A:
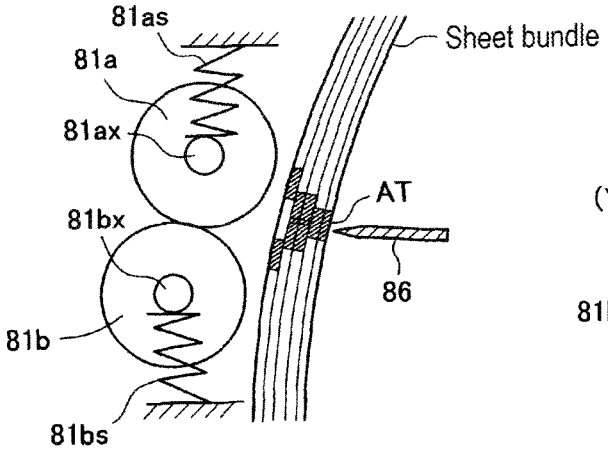

FIGS. 27A to 27D are views for explaining folding processing for a sheet bundle formed by a large number of sheets (in the present embodiment, 12 sheets) exceeding a predetermined number. The folding processing for a sheet bundle formed by a large number of sheets bonded by the adhesive-binding unit 50 is also performed by the folding roller 81 (81*a* and 81*b*) and the folding blade 86 illustrated in FIGS. 14A to 14D. That is, as illustrated in FIG. 27A, the folding roller 81 for folding the sheet bundle bonded by means of the applied adhesive tape AT and the folding blade 81 for inserting the sheet bundle into the nip position of the folding roller 81 are provided.

Figure 27B:
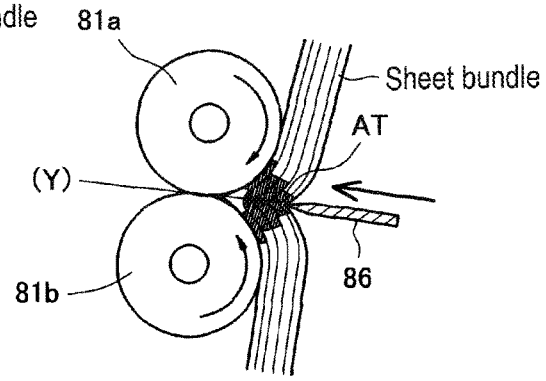

The sheet bundle supported in a bundle by the stacker section 40 is stopped by the stopper section 90 at the leading end of the stacker section 40 in a state illustrated in FIG. 27A, and the folding position of the sheet bundle is positioned as a center position of the bonding by the adhesive-binding unit 50. The sheet bundle folding processing controller 202 performs control such that the folding position of the sheet bundle is bent by the folding blade 86 as illustrated in FIG. 27B to be inserted between the rollers. At this time, the pair of folding rollers are driven into rotation at the same speed as that of the sheet bundle moved by the folding blade 86.

Figure 27C:
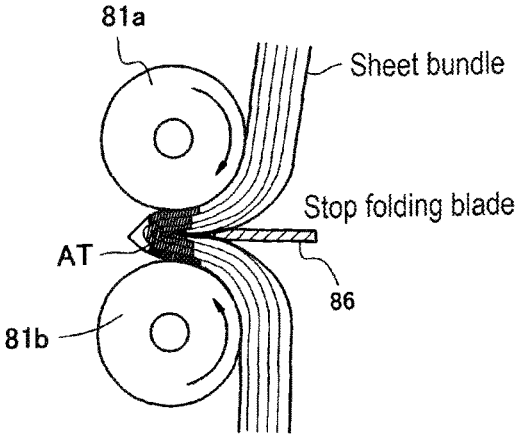
Figure 27D:
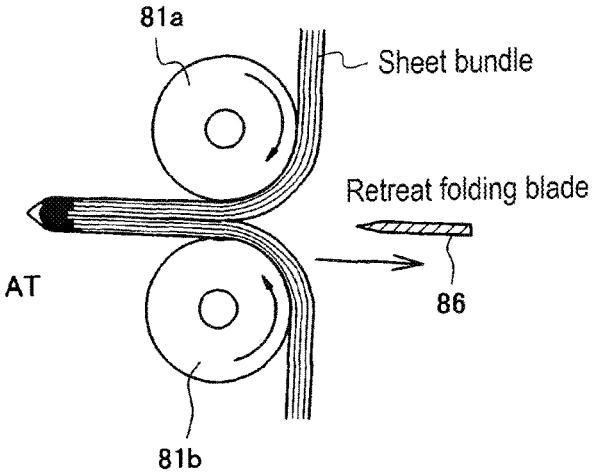

Then, the sheet bundle folding processing controller 202 reversely rotates the folding drive motor 300 illustrated in FIGS. 11 and 12 after elapse of an estimated time period during which the sheet bundle reaches a predetermined nip position to stop the folding blade 86 at a position illustrated in FIG. 27C. On the other hand, the folding roller 81 continues to be rotated in the folding direction. As a result, the sheet bundle is fed in a delivery direction (leftward in FIG. 27C). Thereafter, the sheet bundle folding processing controller 202 normally rotates the folding drive motor 300 once again. Then, as illustrated in FIG. 27D, the folding blade 86 positioned at the nip position is moved toward the standby position concurrently with the delivery of the sheet bundle by the folding roller 81.

As illustrated in FIG. 26C, in the sheet bundle to be folded illustrated in FIGS. 27A to 27D, the adhesive is applied at one position on the folding position for the bonded first to fifth sheets, and the adhesive of the adhesive tape AT is applied at two positions very close to each other in the sheet conveying direction across the folding position for the sixth to 10th sheets. Further, for the 11th sheet (between the 11th and 12th sheets), the adhesive is applied at two positions separated from each other across the folding position Y by the interval (S). This allows the sheet bundle to be easily nipped between the folding rollers 81 (81*a* and 81*b*) as illustrated in FIG. 27B.

Figure 28A:
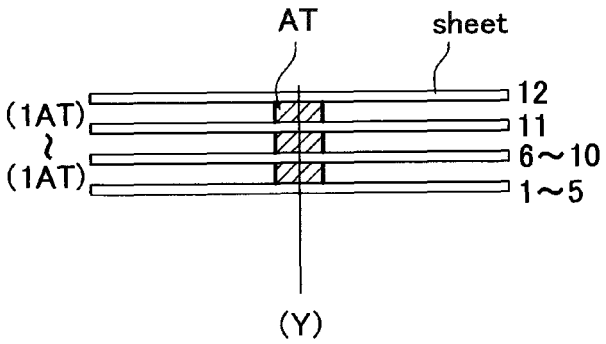
Figure 28B:
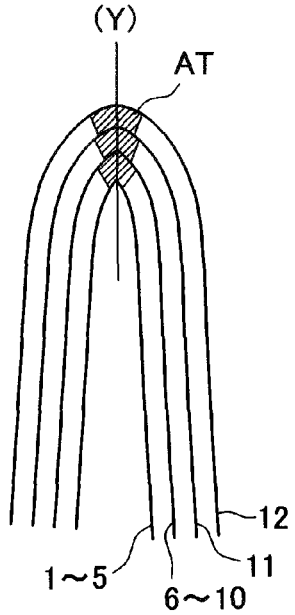

FIGS. 28A to 28D are views illustrating an adhesive-bound sheet bundle and a folded state thereof. FIG. 28A is a view for explaining a state where the adhesives are applied with the same length irrespective of whether the number of sheets is small or large. In the above description, the adhesive tape AT is applied at one position across the folding position when the number of sheets to be bonded is small; however, whether or not the adhesive tape AT is applied in such a manner may be determined by an operator on a case-by-case basis. That is, when a high adhesion is not required, the adhesive tape AT may be applied at one position across the folding position even when the number of sheets to be bonded is large. FIG. 28A illustrates a state where the adhesive of the adhesive tape AT is applied onto the 11 sheets at the folding positions thereof. In this case, when the sheets are folded, the adhesive is slightly extended at the bent portion of the folded sheet bundle at the outside thereof as illustrated in FIG. 28B, but the adhesive is likely to be peeled-off.

Figure 28C:
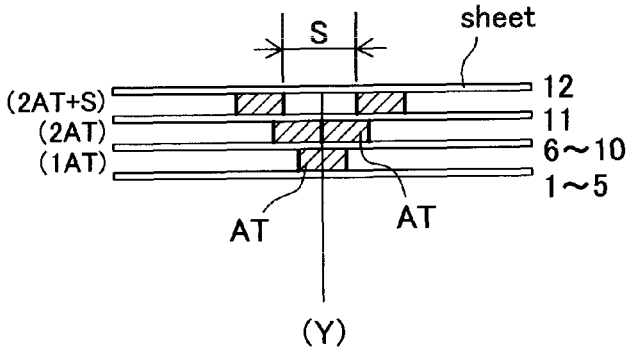
Figure 28D:
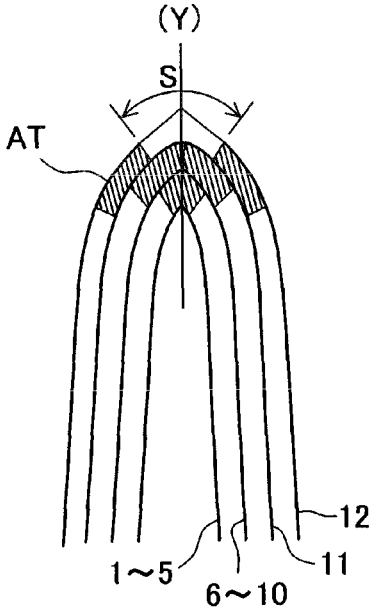

As described above, the adhesive is applied such that the bonding area is increased as the number of sheets is increased, and when the number of sheets exceeds a predetermined number, the adhesive is applied at two positions separated from each other by a predetermined interval. This state is illustrated in FIG. 28C. That is, the sheets are bonded as illustrated in FIG. 25C, FIG. 26C, and FIGS. 27A to 27D. When this adhesive-bound sheet bundle is folded, the adhesive is not applied onto a portion to be nipped first by the folding roller 81, as can be seen in FIG. 28D, thus making it easy for the sheet bundle to be nipped. The resultant booklet illustrated in FIG. 28D has advantages of reducing an amount of the adhesive to be used and allowing the pages comparatively to be easily opened.

[Procedure of Sheet Bonding Depending on Number of Sheets]

Figure 29:
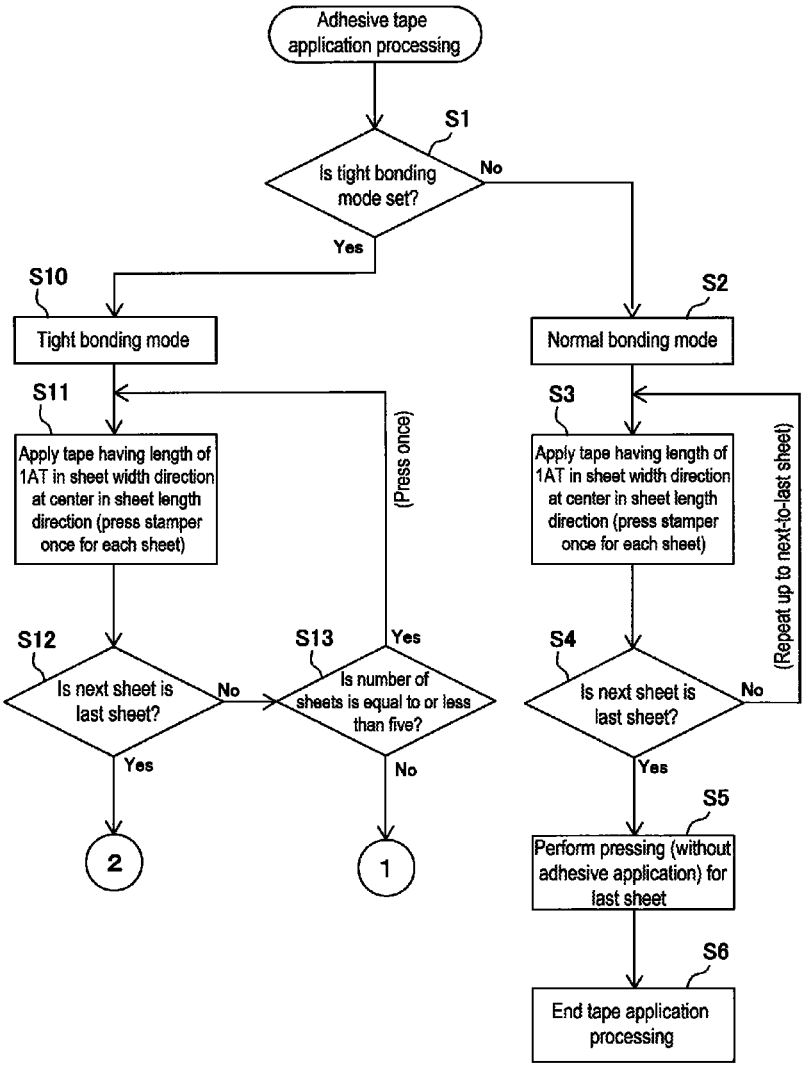
FIG. 29 is a flowchart illustrating adhesive tape (adhesive) application processing.
Figure 30:
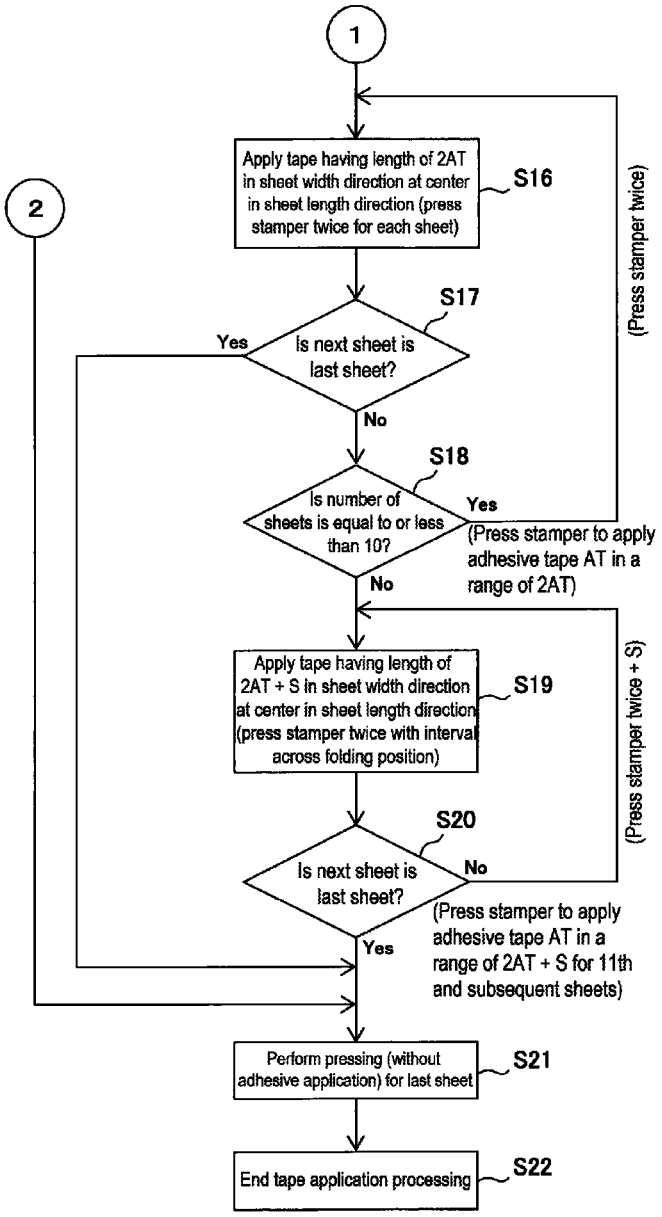
FIG. 30 is a flowchart illustrating a processing flow of "tight bonding mode" continued from that of FIG. 29.
Figure 31:
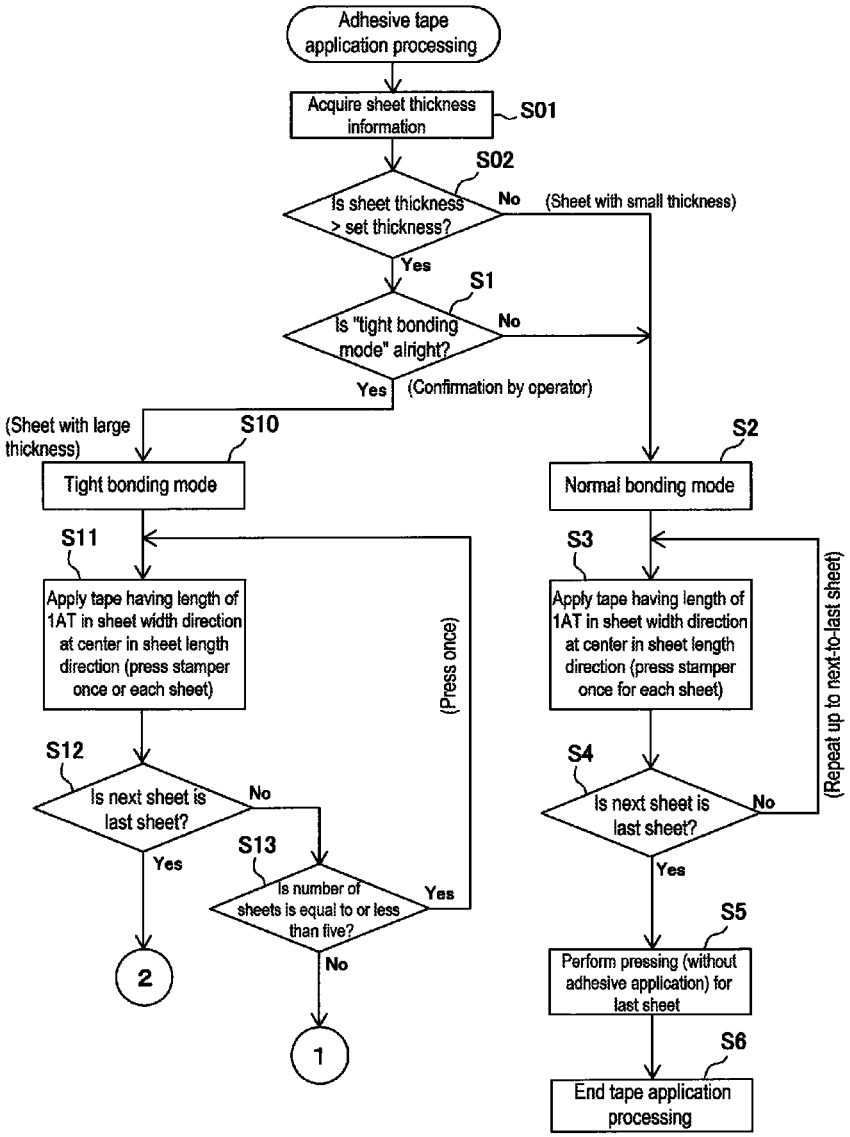
FIG. 31 is a flowchart illustrating a modification of the adhesive tape (adhesive) application processing.

The following describes, with reference to flowcharts of FIGS. 29 to 31, a procedure of switching the application position of the adhesive tape (adhesive) AT depending on the number of sheets to be bonded. First, with reference to FIGS. 29 and 30, a procedure of increasing an application range of the adhesive tape AT depending on the number of sheets will be described.

An operator specifies the above-described "adhesive-bound sheet bundle folding mode", and the adhesive tape application processing is executed. Here, it is checked whether or not a "tight bonding mode" in which the application range of the adhesive tape AT is increased depending on the number of sheets is performed (S1). When "NO" (not execute) is selected, the bonding mode is shifted to a "normal bonding mode" (S2). In the normal bonding mode, the transfer head 72 of the adhesive tape stamper 51 is pressed, once for each sheet, against a position corresponding to the folding position Y which is a substantially center position in the conveying direction of the sheets to be bonded (S3). As a result, the adhesive tape AT is applied onto the sheet. This operation is repeated up to the next-to-last sheet (S4). For the last sheet, the sheet pressing is performed using the pressing portion 170 illustrated in FIG. 25D (S5). As a result, the adhesive tape AT is applied as illustrated in FIG. 28A. Then, when the folding processing as illustrated in FIGS. 14A to 14D is executed, the folded sheet bundle with adhesive tapes AT having substantially the same size is created as illustrated in FIG. 28B. Although the obtained booklet is not so strong in terms of adhesion between sheets, it can be created comparatively fast.

On the other hand, when the operator selects "YES" (execute) for the "tight bonding mode" (S1) in the flowchart of FIG. 29, the bonding mode is shifted to the "tight bonding mode" (S10). Assuming that 15 sheets are to be bonded, for every five sheets, the application range of the adhesive tape AT is increased, and the application position of the adhesive tape AT is adjusted. First, for the first to fifth sheets, the same procedure as that in the normal bonding mode is taken. That is, as illustrated in FIG. 26A, the transfer head 72 of the adhesive tape stamper 51 is pressed, once for each sheet, against a position corresponding to the folding position Y which is a substantially center position in the conveying direction of the sheets to be bonded (S11).

If the number of sheets to be bonded is equal to or less than five, the pressing portion 170 is pressed against the last sheet without application of the adhesive tape AT thereto as illustrated in FIG. 25D, and the adhesive tape application processing is ended (S21, S22).

Then, as illustrated in the flowchart of FIG. 30, for the sixth and subsequent sheets, the adhesive tape AT is applied at two positions very close to each other in the sheet conveying direction across a position corresponding to the folding position Y which is the substantially center position in the conveying direction of the sheets to be bonded, as illustrated in FIG. 26B (S16). Also in this case, if the number of sheets to be bonded is equal to or less than ten, the pressing portion 170 is pressed against the last sheet without application of the adhesive tape AT thereto, and the adhesive tape application processing is ended (S21, S22).

For the 11th and subsequent sheets, the adhesive tape AT is applied at two positions separated from each other by a predetermined interval (S) across a position corresponding to the folding position Y which is the substantially center position in the conveying direction of the sheets to be bonded, as illustrated in FIG. 26C (S19). As a result, two adhesive tapes AT are applied with an interval interposed therebetween. When the next sheet is the last 15th sheet, the pressing portion 170 is pressed against the last sheet without application of the adhesive tape AT thereto, and the adhesive tape application processing is ended (S21, S22).

When, for example, a sheet bundle formed by 12 sheets is subjected to the folding processing according to the above procedure, a sheet bundle bonded and folded in a state as illustrated in FIGS. 28C and 28D is obtained. Thus, it is possible to reduce an amount of the adhesive tape AT while maintaining a binding strength of the booklet and to allow the booklet to be easily opened at time of use.

[Another Procedure of Sheet Bonding Depending on Number of Sheets]

The following describes, with reference to FIG. 31, a modification of the procedure illustrated in FIGS. 29 and 30. The procedure of FIG. 31 differs from that of FIGS. 29 and 30 in that the sheet processing device B acquires sheet thickness information (S01) and that when it is determined, based on the acquired sheet thickness information, that a sheet thickness is smaller than a prescribed sheet thickness, the "normal bonding mode" is set (S2). On the other hand, when it is determined that the sheet thickness is larger than a prescribed sheet thickness, the "tight bonding mode" is set (S10). In S1, an operator is made to confirm the setting of the "tight bonding mode". An amount of the adhesive tape AT to be used is increased in the "tight bonding mode" and, thus, whether or not the "tight bonding mode" is appropriate for a usage of the booklet is confirmed here. The procedure after the confirmation is the same as that described in FIGS. 29 and 30, so description thereof will be omitted. Further, in this modification, when the sheet thickness is small, the sheets are unlikely to be peeled-off from one another even with the bonding range therebetween is small, so that the "normal bonding mode" is automatically set.

It should be appreciated that the present invention is not limited to the present embodiment, and various modifications may be made thereto. Further, all technical matters included in the technical ideas set forth in the claims should be covered by the present invention. While the invention has been described based on a preferred embodiment, various substitutions, corrections, modifications, or improvements may be made from the content disclosed in the specification by a person skilled in the art, which are included in the scope defined by the appended claims.

This application is based upon and claims the benefit of priority from prior Japanese Patent Application No. 2015-088021 filed Apr. 23, 2015, and Japanese Patent Applications No. 2015-107405 and No. 2015-107406, both filed May 27, 2015, the entire contents of which are incorporated herein by reference.

What is claimed is:

1. A sheet processing device that binds sheets and then folds a resultant sheet bundle, comprising:

a stacker section that stores sheets conveyed along a conveying path;

an adhesive-binding unit that applies an adhesive onto the sheets stored in the stacker section to adhesive-bind the sheets;

a staple-binding unit that binds the sheets stored in the stacker section by means of staples;

a folding mechanism section that includes a folding roller that folds a sheet bundle in two at a binding position of the sheet bundle by the adhesive-binding unit or a binding position thereof by the staple-binding unit and a folding blade that pushes the sheet bundle into the folding roller; and a controller that controls the folding mechanism section, wherein the controller controls a folding speed of the folding mechanism section such that a folding speed for the sheet bundle bound by the adhesive-binding unit is lower than a folding speed for the sheet bundle bound by the staple-binding unit.

2. The sheet processing device according to claim 1, wherein the folding speed is at least a pushing speed of the folding blade that pushes the sheet bundle into the folding roller.

3. The sheet processing device according to claim 2, wherein the adhesive-binding unit includes a transfer tape having an adhesive on a tape base material and presses the transfer tape to transfer the adhesive onto the sheet from the transfer tape in application of the adhesive onto the sheet and thereby bonds a plurality of sheets forming the sheet bundle to one another.

4. The sheet processing device according to claim 3, wherein rotation of the folding roller and movement of the folding blade are made by a single drive motor, and the folding speed is changed by the controller increasing/decreasing a rotation amount of the drive motor.

5. The sheet processing device according to claim 3, wherein rotation of the folding roller and movement of the folding blade are each made by an independent drive motor capable being normally and reversely rotated and drive paths that transmit drive of the motor, and the folding speed is changed by switching between the drive paths by the normal/reverse rotation of the drive motor.

6. The sheet processing device according to claim 5, wherein the adhesive-binding unit and the staple-binding unit are juxtaposed in the stacker section.

7. The sheet processing device according to claim 5, wherein there is provided a unit housing section that selectively houses the adhesive-binding unit and the staple-binding unit for sheet binding.

8. A sheet processing device that binds sheets and then folds a resultant sheet bundle, comprising:

a stacker section that stores sheets conveyed along a conveying path;

a sheet regulating member that regulates the sheets conveyed to the stacker section;

a retreat path that branches off from the conveying path at a position upstream of the stacker section and can convey the sheet carried in the stacker section in a reverse direction to the carry-in direction;

an adhesive-binding unit that is positioned at a merging point between the conveying path and the retreat path and applies an adhesive onto the sheets to adhesive-bind the sheets;

a staple-binding unit that binds the sheets stored in the stacker section by means of staples;

a folding mechanism section that folds a sheet bundle that has been bound by the adhesive-binding unit or staple-binding unit and stored into the stacker section; and a controller that controls the folding mechanism section, wherein the retreat path is a path along which an adhesive applied position of a preceding sheet that has been applied with an adhesive is retreated when a next sheet is carried into the stacker section, the staple-binding unit is disposed in the stacker section at a position between the adhesive-binding unit and the folding mechanism section, and the controller controls a folding speed of the folding mechanism unit such that a folding speed for the sheet bundle bound by the adhesive-binding unit is lower than a folding speed for the sheet bundle bound by the staple-binding unit.

9. The sheet processing device according to claim 8, wherein there is provided a deflection guide that positions, when the staple-binding unit is used to perform sheet binding, a conveying direction rear end of the sheet in the retreat path every time the sheet is carried into the stacker section, and when the adhesive-binding unit is used to perform sheet binding, the deflection guide serves as a guide for guiding the sheet toward the retreat path.

10. The sheet processing device according to claim 9, wherein the adhesive-binding unit includes a transfer tape having an adhesive on a tape base material and presses the transfer tape to transfer the adhesive onto the sheet from the transfer tape in application of the adhesive onto the sheet and thereby bonds a plurality of sheets forming the sheet bundle to one another.

11. The sheet processing device according to claim 10, wherein when the number of sheets forming a sheet bundle exceeds a predetermined number, the controller further reduces the speed of the folding processing for the sheet bundle bound by the adhesive-binding unit.

12. An image forming device comprising:

an image forming section that sequentially forms an image onto sheets; and a sheet processing device that applies predetermined processing to the sheet delivered from the image forming section, the sheet processing device being provided with a configuration as claimed in claim 1.

* * * * *